US007171131B2

(12) United States Patent
Maruyama et al.

(10) Patent No.: US 7,171,131 B2
(45) Date of Patent: Jan. 30, 2007

(54) IMAGE FORMING APPARATUS, IMAGE FORMING SYSTEM, AND COMPUTER-READABLE STORAGE MEDIUM

(75) Inventors: Akira Maruyama, Nagano-ken (JP); Osamu Ishibashi, Nagano-ken (JP); Ken Yoshizuka, Nagano-ken (JP); Masahiro Owa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 209 days.

(21) Appl. No.: 10/936,457

(22) Filed: Sep. 8, 2004

(65) Prior Publication Data

US 2005/0078983 A1 Apr. 14, 2005

(30) Foreign Application Priority Data

Sep. 11, 2003 (JP) ..... 2003-320047
Sep. 11, 2003 (JP) ..... 2003-320048

(51) Int. Cl.
*G03G 15/01* (2006.01)

(52) U.S. Cl. ..... 399/12; 399/13; 399/81; 399/227

(58) Field of Classification Search ..... 399/227, 399/223, 12, 13, 112
See application file for complete search history.

(56) References Cited

U.S. PATENT DOCUMENTS 4,998,145 A * 3/1991 Haneda et al. ..... 399/82 X
6,029,018 A * 2/2000 Rogers et al. ..... 399/12
6,301,460 B1 * 10/2001 Elliott ..... 399/227 X
2003/0095804 A1 * 5/2003 Tanaka et al. ..... 399/13
2005/0013625 A1 * 1/2005 Yoshizuka et al. ..... 399/81
2005/0041995 A1 * 2/2005 Owa et al. ..... 399/223
2005/0105921 A1 * 5/2005 Yoshizuka et al. ..... 399/12

FOREIGN PATENT DOCUMENTS

JP 06-019256 A * 1/1994
JP 2002-333756 11/2002
JP 2003-043773 A * 2/2003

* cited by examiner

*Primary Examiner*—Sophia S. Chen
(74) *Attorney, Agent, or Firm*—Hogan & Hartson LLP

(57) ABSTRACT

An image forming apparatus includes attach/detach sections to/from each of which a developer container for containing developer can be attached/detached, and an image bearing body for bearing a latent image. When a developer container is attached to each of the attach/detach sections, the apparatus is usable as a color image forming apparatus. When a developer container is attached to only one of the attach/detach sections, the apparatus is usable as a single-color image forming apparatus. The image forming apparatus has a device ID that is sent to a computer when it communicates with the computer and that is used by the computer to recognize devices capable of communicating therewith. The device ID of the image forming apparatus for when it is being used as the color image forming apparatus matches the device ID of the image forming apparatus for when it is being used as the single-color image forming apparatus.

21 Claims, 23 Drawing Sheets

| case | attachment information value | | | | setting operation of apparatus-type information |
|---|---|---|---|---|---|
| | black | magenta | cyan | yellow | |
| A | 0 | 0 | 0 | 0 | do not set |
| B | 0 | 0 | 0 | 1 | |
| C | 0 | 0 | 1 | 0 | |
| D | 0 | 0 | 1 | 1 | |
| E | 0 | 1 | 0 | 0 | |
| F | 0 | 1 | 0 | 1 | |
| G | 0 | 1 | 1 | 0 | |
| H | 0 | 1 | 1 | 1 | |
| I | 1 | 0 | 0 | 0 | set "1" (monochrome printer) |
| J | 1 | 0 | 0 | 1 | set "0" (color printer) |
| K | 1 | 0 | 1 | 0 | |
| L | 1 | 0 | 1 | 1 | |
| M | 1 | 1 | 0 | 0 | |
| N | 1 | 1 | 0 | 1 | |
| P | 1 | 1 | 1 | 0 | |
| Q | 1 | 1 | 1 | 1 | |

FIG. 11

| apparatus-type information | information in control signal COM | whether or not to form image |
|---|---|---|
| color | color | yes |
| color | monochrome | yes |
| mono-chrome | color | no |
| mono-chrome | monochrome | yes |

FIG. 18

| case | attachment information value | | | | setting operation of apparatus-type information |
|---|---|---|---|---|---|
| | black | magenta | cyan | yellow | |
| A | 0 | 0 | 0 | 0 | do not set |
| B | 0 | 0 | 0 | 1 | |
| C | 0 | 0 | 1 | 0 | |
| D | 0 | 0 | 1 | 1 | |
| E | 0 | 1 | 0 | 0 | |
| F | 0 | 1 | 0 | 1 | |
| G | 0 | 1 | 1 | 0 | |
| H | 0 | 1 | 1 | 1 | |
| I | 1 | 0 | 0 | 0 | set "1" (monochrome printer) |
| J | 1 | 0 | 0 | 1 | set "0" (color printer) |
| K | 1 | 0 | 1 | 0 | |
| L | 1 | 0 | 1 | 1 | |
| M | 1 | 1 | 0 | 0 | |
| N | 1 | 1 | 0 | 1 | |
| P | 1 | 1 | 1 | 0 | |
| Q | 1 | 1 | 1 | 1 | |

FIG. 20

IMAGE FORMING APPARATUS, IMAGE FORMING SYSTEM, AND COMPUTER-READABLE STORAGE MEDIUM

CROSS-REFERENCE TO RELATED APPLICATIONS

The present application claims priority upon Japanese Patent Application No. 2003-320047 filed Sep. 11, 2003 and Japanese Patent Application No. 2003-320048 filed Sep. 11, 2003, which are herein incorporated by reference.

BACKGROUND OF THE INVENTION

1. Field of the Invention

The present invention relates to image forming apparatuses, image forming systems, and computer-readable storage media.

2. Description of the Related Art (1) There are known image forming apparatuses that are provided with, for example, a plurality of attach/detach sections to and from each of which a developing unit (which serves as an example of a developer container for containing developer) can be attached and detached, and an image bearing body for bearing a latent image. These image forming apparatuses form images by developing the latent image borne on the image bearing body with the developer contained in the developing unit(s) attached to the attach/detach section(s). When image signals are transmitted from an external device such as a computer, the image forming apparatus moves the developing units to thereby locate one of the developing units at a developing position opposing the image bearing body. A developer image is formed by developing the latent image formed on the image bearing body, and the image is temporarily transferred onto an intermediate transferring body. The developer image formed on the intermediate transferring body is then transferred onto a medium to form an image thereon. (See, for example, JP 2002-333756A.)

Devices, such as the image forming apparatuses described above, that are capable of communicating with computers generally have device IDs. A device ID is used by the computer to recognize the device when, for example, the device is electrically connected to the computer. By receiving the device ID from the device, the computer carries out, for example, settings relating to the devices, such as allocation of hardware resources, and operations such as prompting a user to install a device driver for that device (which is also referred to simply as a "driver" below).

In some situations, a user may wish to use a color image forming apparatus as a monochrome image forming apparatus by attaching, for example, only a black developing unit, which contains black developer, to the image forming apparatus. In order to fulfill such a desire, it is advantageous to use an image forming apparatus in which, when a developing unit is attached to each of the plurality of attach/detach sections, the image forming apparatus can be used as a color image forming apparatus for forming a color image by developing the latent image borne on the image bearing body with the developer contained in each of the developing units; and on the other hand, when a developing unit is attached to only one of the plurality of attach/detach sections, the image forming apparatus can be used as a single-color image forming apparatus for forming a single-color image by developing the latent image borne on the image bearing body with the developer contained in that developing unit.

Further, as for the driver for the image forming apparatus, it is preferable to use a single-color driver that suits the single-color image forming apparatus when the image forming apparatus is being used as a single-color image forming apparatus, and use a color driver that suits the color image forming apparatus when the image forming apparatus is being used as a color image forming apparatus.

Therefore, in cases where the image forming apparatus is switched from the single-color image forming apparatus to the color image forming apparatus, or from the color image forming apparatus to the single-color image forming apparatus, it is recommended, for example, that the user turns the power of the computer OFF, performs switching, and then turns the power of the computer ON again to install the driver that suits the image forming apparatus that has been switched.

Incidentally, it is preferable to provide the user with some variety of choices in the timing for installing the driver (i.e., when to install the driver), in consideration, for example, of the necessity of preparing the driver to be installed. In the procedure described above, this objective is achieved by adjusting the timing at which the user turns the power of the computer ON.

However, there are cases in which the user inadvertently performs switching of the image forming apparatus without turning the power of the computer OFF (i.e., while the power of the computer is still ON). Even in such cases, it is still demanded that the user be provided with a variety of choices in the driver-installing timing described above.

(2) There are also known image forming systems that are provided with, for example: an image forming apparatus including a plurality of attach/detach sections to and from each of which a developing unit (which serves as an example of a developer container for containing developer) can be attached and detached, and an image bearing body for bearing a latent image; and a computer that is capable of communicating with the image forming apparatus and that is provided with a control program capable of instructing execution of image formation to the image forming apparatus. The image forming apparatus of the type described above forms images by developing the latent image borne on the image bearing body with the developer contained in the developing unit(s) attached to the attach/detach section(s). In such image forming systems, when image data are transmitted from the computer in accordance with instructions given by the control program to execute image formation, the image forming apparatus moves the developing units to thereby locate one of them at a developing position opposing the image bearing body. A developer image is formed by developing the latent image formed on the image bearing body, and the image is temporarily transferred onto an intermediate transferring body. The developer image formed on the intermediate transferring body is then transferred onto a medium to form an image thereon. (See, for example, JP 2002-333756A.)

In some situations, a user may wish to use a color image forming apparatus as a monochrome image forming apparatus by attaching, for example, only a black developing unit, which contains black developer, to the image forming apparatus. In order to fulfill such a desire, it is advantageous to use an image forming apparatus in which, when a developing unit is attached to each of the plurality of attach/detach sections, the image forming apparatus can be used as a color image forming apparatus for forming a color image by developing the latent image borne on the image bearing body with the developer contained in each of the developing units; and on the other hand, when a developing unit is attached to only one of the plurality of attach/detach sections, the image forming apparatus can be used as a single-color image forming apparatus for forming a single-color image by developing the latent image borne on the image bearing body with the developer contained in that developing unit.

In the image forming system described above, a different control program is used for when the image forming apparatus is being used as a color image forming apparatus and for when it is being used as a single-color image forming apparatus. That is, when the image forming apparatus is to be used as a color image forming apparatus, the color control program installed to the computer is used for executing image formation, whereas when the image forming apparatus is to be used as a single-color image forming apparatus, the single-color control program installed to the computer is used for executing image formation.

Each of the color control program and the single-color control program has recorded thereon setting information (for example, information about the print media and paper supply sections that is displayed on a display device of the computer) which is changeable. The setting information has different initial setting values between the color control program and the single-color control program. Therefore, the image forming system performs image formation using the initial setting values of the setting information of the respective control programs that differ between when the image forming apparatus is to be used as a color image forming apparatus and when it is to be used as a single-color image forming apparatus. It should be noted that the user can change the initial setting values of the setting information to a different setting value before making the control program instruct image formation.

Incidentally, the user often sets this changeable setting information to specific setting values before instructing the control program to execute image formation. When the image forming apparatus is switched, however, the setting values of the setting information of a control program that was used before performing switching of the image forming apparatus may differ from the initial setting values of the setting information of a control program that is used after switching. In this case, the user has to change the initial setting values of the latter control program to the specific setting values in order to execute image formation after switching of the image forming apparatus using the specific setting values, which differ from the initial setting values of the control program that is used after switching of the image forming apparatus. Therefore, when switching of the image forming apparatus is performed, the user will have to carry out burdensome tasks.

SUMMARY OF THE INVENTION

The present invention has been made in view of the above and other issues, and an object thereof is to provide an image forming apparatus, an image forming system, and a computer-readable storage medium that are convenient for users.

(1) An aspect of the present invention is an image forming apparatus comprising: a plurality of attach/detach sections to and from each of which a developer container for containing developer can be attached and detached; and an image bearing body for bearing a latent image; wherein when a developer container is attached to each of the plurality of attach/detach sections, the image forming apparatus is usable as a color image forming apparatus for forming a color image by developing the latent image borne on the image bearing body with the developer contained in each developer container; wherein when a developer container is attached to only one of the plurality of attach/detach sections, the image forming apparatus is usable as a single-color image forming apparatus for forming a single-color image by developing the latent image borne on the image bearing body with the developer contained in the developer container; wherein the image forming apparatus has a device ID that is sent to a computer when the image forming apparatus communicates with the computer and that is used by the computer to recognize devices capable of communicating with the computer; and wherein the device ID of the image forming apparatus for when the image forming apparatus is being used as the color image forming apparatus matches the device ID of the image forming apparatus for when the image forming apparatus is being used as the single-color image forming apparatus.

(2) Another aspect of the present invention is an image forming system comprising: an image forming apparatus that has a plurality of attach/detach sections to and from each of which a developer container for containing developer can be attached and detached, and an image bearing body for bearing a latent image; and a computer that is capable of communicating with the image forming apparatus and that has at least one control program for instructing the image forming apparatus to perform image formation; wherein when a developer container is attached to each of the plurality of attach/detach sections, the image forming apparatus is usable as a color image forming apparatus for forming a color image by developing the latent image borne on the image bearing body with the developer contained in each developer container; wherein when a developer container is attached to only one of the plurality of attach/detach sections, the image forming apparatus is usable as a single-color image forming apparatus for forming a single-color image by developing the latent image borne on the image bearing body with the developer contained in the developer container; wherein when the image forming apparatus is used as a color image forming apparatus, a color control program instructs the color image forming apparatus to perform image formation using setting information that is changeable and that is recorded on the color control program; wherein when the image forming apparatus is used as a single-color image forming apparatus, a single-color control program instructs the single-color image forming apparatus to perform image formation using setting information that is changeable and that is recorded on the single-color control program; and wherein when the image forming apparatus is switched from the single-color image forming apparatus to the color image forming apparatus or from the color image forming apparatus to the single-color image forming apparatus, at least a portion of the setting information of the control program that is used after the switching is kept the same as a portion of the setting information of the control program that was used before the switching.

Features and objects of the present invention other than the above will become clear by reading the description of the present specification with reference to the accompanying drawings.

BRIEF DESCRIPTION OF THE DRAWINGS

In order to facilitate further understanding of the present invention and the advantages thereof, reference is now made to the following description taken in conjunction with the accompanying drawings wherein:

FIG. 11 shows a relationship between values of attachment information and operations of setting apparatus-type information according to the first embodiment;

FIG. 18 is a diagram showing a relationship between execution/non-execution of image formation, the apparatus-type information, and the information in the control signals COM according to the second embodiment;

FIG. 20 is a diagram showing a relationship between the values of the attachment information and the operations of setting the apparatus-type information according to the second embodiment;

DETAILED DESCRIPTION OF THE INVENTION

Figure 1:
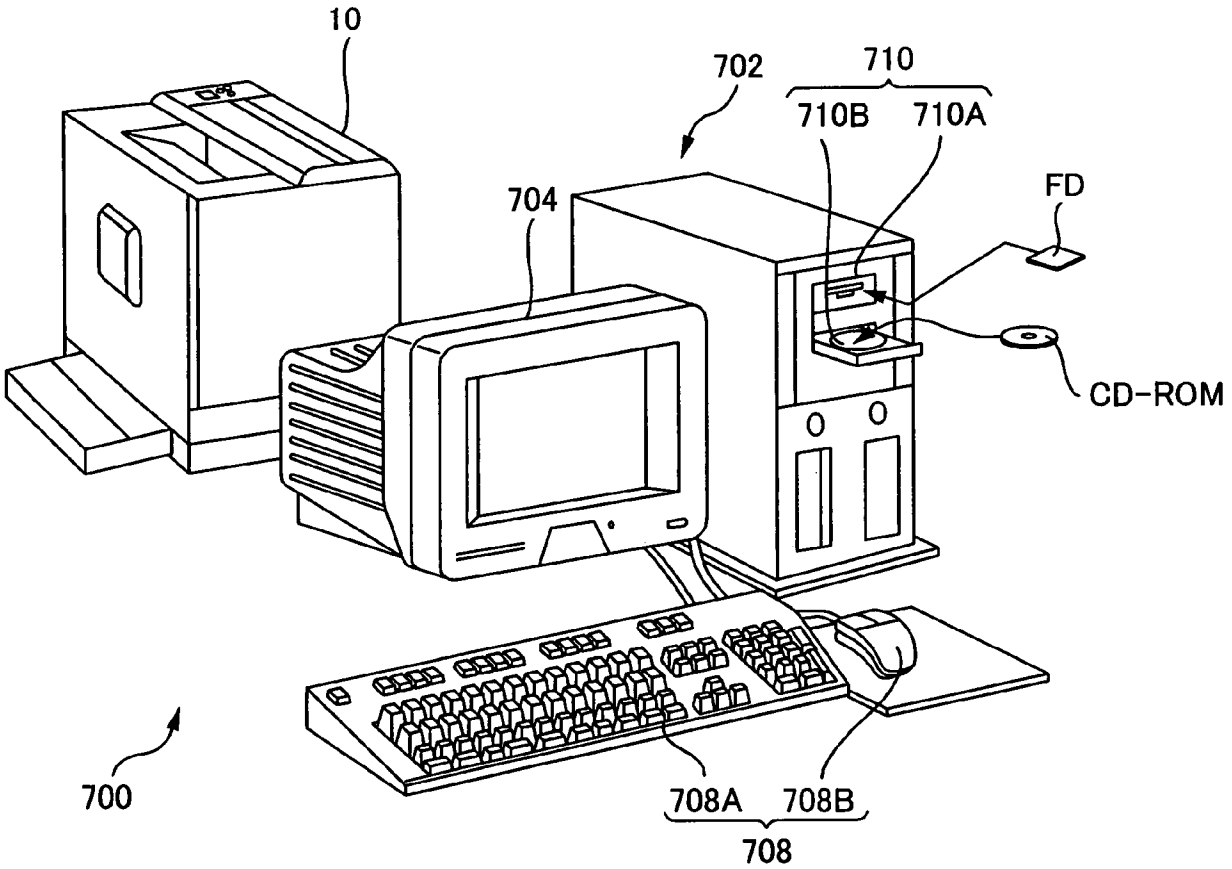
FIG. 1 is an explanatory diagram showing an external configuration of an image forming system 700 according to an embodiment of the present invention.

At least the following matters will be made clear by the explanation in the present specification and the description of the accompanying drawings.

(1) An aspect of the present invention is an image forming apparatus comprising: a plurality of attach/detach sections to and from each of which a developer container for containing developer can be attached and detached; and an image bearing body for bearing a latent image; wherein when a developer container is attached to each of the plurality of attach/detach sections, the image forming apparatus is usable as a color image forming apparatus for forming a color image by developing the latent image borne on the image bearing body with the developer contained in each developer container; wherein when a developer container is attached to only one of the plurality of attach/detach sections, the image forming apparatus is usable as a single-color image forming apparatus for forming a single-color image by developing the latent image borne on the image bearing body with the developer contained in the developer container; wherein the image forming apparatus has a device ID that is sent to a computer when the image forming apparatus communicates with the computer and that is used by the computer to recognize devices capable of communicating with the computer; and wherein the device ID of the image forming apparatus for when the image forming apparatus is being used as the color image forming apparatus matches the device ID of the image forming apparatus for when the image forming apparatus is being used as the single-color image forming apparatus.

It is possible to achieve an image forming apparatus that is convenient for users by making the device ID of the image forming apparatus for when it is being used as the color image forming apparatus match the device ID of the image forming apparatus for when it is being used as the single-color image forming apparatus.

Further, the image forming apparatus may have information indicative of whether the image forming apparatus is being used as the color image forming apparatus or whether the image forming apparatus is being used as the single-color image forming apparatus.

In this way, it is possible to distinguish certainly whether the image forming apparatus is being used as a color image forming apparatus or as a single-color image forming apparatus.

Further, the single-color image forming apparatus may be a monochrome image forming apparatus that forms monochrome images, when a developer container is attached to only one of the plurality of attach/detach sections, by developing the latent image borne on the image bearing body with the developer contained in the developer container.

It is possible to achieve an image forming apparatus that is convenient for users by making the device ID of the image forming apparatus for when it is being used as the color image forming apparatus match the device ID of the image forming apparatus for when it is being used as the monochrome image forming apparatus.

Further, the device ID does not have to be updated at the time when the image forming apparatus is switched from the single-color image forming apparatus to the color image forming apparatus or from the color image forming apparatus to the single-color image forming apparatus.

It is possible to achieve an image forming apparatus that is convenient for users by the device ID not being updated at the time when the image forming apparatus is switched from the single-color image forming apparatus to the color image forming apparatus or from the color image forming apparatus to the single-color image forming apparatus.

It is also possible to achieve an image forming apparatus comprising: a plurality of attach/detach sections to and from each of which a developer container for containing developer can be attached and detached; and an image bearing body for bearing a latent image; wherein: when a developer container is attached to each of the plurality of attach/detach sections, the image forming apparatus is usable as a color image forming apparatus for forming a color image by developing the latent image borne on the image bearing body with the developer contained in each developer container; when a developer container is attached to only one of the plurality of attach/detach sections, the image forming apparatus is usable as a single-color image forming apparatus for forming a single-color image by developing the latent image borne on the image bearing body with the developer contained in the developer container; the image forming apparatus has a device ID that is sent to a computer when the image forming apparatus communicates with the computer and that is used by the computer to recognize devices capable of communicating with the computer; the device ID of the image forming apparatus for when the image forming apparatus is being used as the color image forming apparatus matches the device ID of the image forming apparatus for when the image forming apparatus is being used as the single-color image forming apparatus; the image forming apparatus has information indicative of whether the image forming apparatus is being used as the color image forming apparatus or whether the image forming apparatus is being used as the single-color image forming apparatus; the single-color image forming apparatus is a monochrome image forming apparatus that forms monochrome images, when a developer container is attached to only one of the plurality of attach/detach sections, by developing the latent image borne on the image bearing body with the developer contained in the developer container; and the device ID is not updated at the time when the image forming apparatus is switched from the single-color image forming apparatus to the color image forming apparatus or from the color image forming apparatus to the single-color image forming apparatus.

Another aspect of the present invention is an image forming system comprising: an image forming apparatus that includes a plurality of attach/detach sections to and from each of which a developer container for containing developer can be attached and detached and an image bearing body for bearing a latent image; and a computer that is capable of communicating with the image forming apparatus; wherein when a developer container is attached to each of the plurality of attach/detach sections, the image forming apparatus is usable as a color image forming apparatus for forming a color image by developing the latent image borne on the image bearing body with the developer contained in each developer container; wherein when a developer container is attached to only one of the plurality of attach/detach sections, the image forming apparatus is usable as a single-color image forming apparatus for forming a single-color image by developing the latent image borne on the image bearing body with the developer contained in the developer container; wherein the image forming apparatus has a device ID that is sent to the computer when the image forming apparatus communicates with the computer and that is used by the computer to recognize devices capable of communicating with the computer; and wherein the device ID of the image forming apparatus for when the image forming apparatus is being used as the color image forming apparatus matches the device ID of the image forming apparatus for when the image forming apparatus is being used as the single-color image forming apparatus.

It is possible to achieve an image forming system that is convenient for users by making the device ID of the image forming apparatus for when it is being used as the color image forming apparatus match the device ID of the image forming apparatus for when it is being used as the single-color image forming apparatus.

Further, the image forming apparatus may have information indicative of whether the image forming apparatus is being used as the color image forming apparatus or whether the image forming apparatus is being used as the single-color image forming apparatus.

In this way, it is possible to distinguish certainly whether the image forming apparatus is being used as a color image forming apparatus or as a single-color image forming apparatus.

Further, the single-color image forming apparatus may be a monochrome image forming apparatus that forms monochrome images, when a developer container is attached to only one of the plurality of attach/detach sections, by developing the latent image borne on the image bearing body with the developer contained in the developer container.

It is possible to achieve an image forming system that is convenient for users by making the device ID of the image forming apparatus for when it is being used as the color image forming apparatus match the device ID of the image forming apparatus for when it is being used as the monochrome image forming apparatus.

Further, the device ID does not have to be updated at the time when the image forming apparatus is switched from the single-color image forming apparatus to the color image forming apparatus or from the color image forming apparatus to the single-color image forming apparatus.

It is possible to achieve an image forming system that is convenient for users by the device ID not being updated at the time when the image forming apparatus is switched from the single-color image forming apparatus to the color image forming apparatus or from the color image forming apparatus to the single-color image forming apparatus.

Further, among a color driver that corresponds to the image forming apparatus when the apparatus is used as the color image forming apparatus, and a single-color driver that corresponds to the image forming apparatus when the apparatus is used as the single-color image forming apparatus, the computer may only have the color driver; and the device ID does not have to be updated at the time when the image forming apparatus is switched from the color image forming apparatus to the single-color image forming apparatus.

In this way, it is possible to achieve an image forming system that is convenient for users because the device ID is not updated at the time when the image forming apparatus is switched from the color image forming apparatus to the single-color image forming apparatus.

Further, among a color driver that corresponds to the image forming apparatus when the apparatus is used as the color image forming apparatus, and a single-color driver that corresponds to the image forming apparatus when the apparatus is used as the single-color image forming apparatus, the computer may only have the single-color driver; and the device ID is does not have to be updated at the time when the image forming apparatus is switched from the single-color image forming apparatus to the color image forming apparatus.

In this way, it is possible to achieve an image forming system that is convenient for users because the device ID is not updated at the time when the image forming apparatus is switched from the single-color image forming apparatus to the color image forming apparatus.

It is also possible to achieve an image forming system comprising: an image forming apparatus that includes a plurality of attach/detach sections to and from each of which a developer container for containing developer can be attached and detached and an image bearing body for bearing a latent image; and a computer that is capable of communicating with the image forming apparatus; wherein when a developer container is attached to each of the plurality of attach/detach sections, the image forming apparatus is usable as a color image forming apparatus for forming a color image by developing the latent image borne on the image bearing body with the developer contained in each developer container; wherein when a developer container is attached to only one of the plurality of attach/detach sections, the image forming apparatus is usable as a single-color image forming apparatus for forming a single-color image by developing the latent image borne on the image bearing body with the developer contained in the developer container; wherein the image forming apparatus has a device ID that is sent to the computer when the image forming apparatus communicates with the computer and that is used by the computer to recognize devices capable of communicating with the computer; wherein the device ID of the image forming apparatus for when the image forming apparatus is being used as the color image forming apparatus matches the device ID of the image forming apparatus for when the image forming apparatus is being used as the single-color image forming apparatus; wherein the image forming apparatus has information indicative of whether the image forming apparatus is being used as the color image forming apparatus or whether the image forming apparatus is being used as the single-color image forming apparatus; wherein the single-color image forming apparatus is a monochrome image forming apparatus that forms monochrome images, when a developer container is attached to only one of the plurality of attach/detach sections, by developing the latent image borne on the image bearing body with the developer contained in the developer container; wherein among a color driver that corresponds to the image forming apparatus when the apparatus is used as the color image forming apparatus, and a single-color driver that corresponds to the image forming apparatus when the apparatus is used as the single-color image forming apparatus, the computer has only the single-color driver; and wherein the device ID is not updated at the time when the image forming apparatus is switched from the single-color image forming apparatus to the color image forming apparatus.

(2) Another aspect of the present invention is an image forming system comprising: an image forming apparatus that has a plurality of attach/detach sections to and from each of which a developer container for containing developer can be attached and detached, and an image bearing body for bearing a latent image; and a computer that is capable of communicating with the image forming apparatus and that has at least one control program for instructing the image forming apparatus to perform image formation; wherein when a developer container is attached to each of the plurality of attach/detach sections, the image forming apparatus is usable as a color image forming apparatus for forming a color image by developing the latent image borne on the image bearing body with the developer contained in each developer container; wherein when a developer container is attached to only one of the plurality of attach/detach sections, the image forming apparatus is usable as a single-color image forming apparatus for forming a single-color image by developing the latent image borne on the image bearing body with the developer contained in the developer container; wherein when the image forming apparatus is used as a color image forming apparatus, a color control program instructs the color image forming apparatus to perform image formation using setting information that is changeable and that is recorded on the color control program; wherein when the image forming apparatus is used as a single-color image forming apparatus, a single-color control program instructs the single-color image forming apparatus to perform image formation using setting information that is changeable and that is recorded on the single-color control program; and wherein when the image forming apparatus is switched from the single-color image forming apparatus to the color image forming apparatus or from the color image forming apparatus to the single-color image forming apparatus, at least a portion of the setting information of the control program that is used after the switching is kept the same as a portion of the setting information of the control program that was used before the switching.

According to such an image forming system, it becomes possible to achieve a system that is convenient for users.

Further, in the image forming system, the setting information of the color control program and the setting information of the single-color control program may include information that is changeable by a user.

According to such an image forming system, the user does not have to change the setting information of the control program after switching of the image forming apparatus, even if the user sets the setting values of the setting information of the control program used before switching of the image forming apparatus to be different from the initial setting values of the setting information of the control program used after switching of the image forming apparatus.

Further, in the image forming system, the information that is changeable by a user may include medium information about a medium on which an image is formed.

In this case, the image forming system can form images according to various information that has been set about the media, and on the other hand, the user often makes the image forming system form images by setting the above-mentioned information to specific setting values. However, if the specific setting value about the medium information of the control program used before switching of the image forming apparatus is different from the initial setting value about the medium information of the control program used after switching of the image forming apparatus, then the user will have to change the initial setting value to the specific setting value. Therefore, the effect of the present invention, that is, the effect of being able to achieve an image forming system that is convenient for users, is achieved more advantageously.

Further, in the image forming system, the medium information may include information about the size of the medium.

In this case, the image forming system can form images on media of various sizes, and on the other hand, the user often makes the image forming system form images with respect to media of a specific size. However, if the specific setting value about the size of the medium of the control program used before switching of the image forming apparatus is different from the initial setting value about the size of the medium of the control program used after switching of the image forming apparatus, then the user will have to change the initial setting value to the specific setting value. Therefore, the effect of the present invention, that is, the effect of being able to achieve an image forming system that is convenient for users, is achieved more advantageously.

Further, in the image forming system, the information that is changeable by a user may be provided in the image forming apparatus, and may include information about a medium-supplying section for containing a medium on which an image is formed.

The image forming apparatus often has a plurality of medium-supplying sections, and each medium-supplying section is able to contain media of different sizes. On the other hand, the user often makes the image forming system form images after selecting a specific medium-supplying section. However, if the specific setting value about the medium-supplying section of the control program used before switching of the image forming apparatus is different from the initial setting value about the medium-supplying section of the control program used after switching of the image forming apparatus, then the user has to change the initial setting value to the specific setting value. Therefore, the effect of the present invention, that is, the effect of being able to achieve an image forming system that is convenient for users, is achieved more advantageously.

Further, in the image forming system, the image forming apparatus may have information indicative of whether the image forming apparatus is being used as the color image forming apparatus or whether the image forming apparatus is being used as the single-color image forming apparatus.

According to such an image forming system, by using the information indicative of whether the image forming apparatus is being used as the color image forming apparatus or as the single-color image forming apparatus, it becomes possible to find out whether the image forming apparatus is being used as a color image forming apparatus or a single-color image forming apparatus when switching of the image forming apparatus is to be performed.

Further, in the image forming system, the single-color image forming apparatus may be a monochrome image forming apparatus that forms monochrome images, when a developer container is attached to only one of the plurality of attach/detach sections, by developing the latent image borne on the image bearing body with the developer contained in the developer container.

According to such an image forming system, even when the apparatus is switched to a monochrome image forming apparatus for forming monochrome images, which is used most often, it is possible to minimize the amount of changes in the setting information of the single-color control program that is used after switching of the image forming apparatus.

It is also possible to achieve an image forming system comprising: an image forming apparatus that has a plurality of attach/detach sections to and from each of which a developer container for containing developer can be attached and detached, and an image bearing body for bearing a latent image; and a computer that is capable of communicating with the image forming apparatus and that has at least one control program for instructing the image forming apparatus to perform image formation; wherein when a developer container is attached to each of the plurality of attach/detach sections, the image forming apparatus is usable as a color image forming apparatus for forming a color image by developing the latent image borne on the image bearing body with the developer contained in each developer container; wherein when a developer container is attached to only one of the plurality of attach/detach sections, the image forming apparatus is usable as a single-color image forming apparatus for forming a single-color image by developing the latent image borne on the image bearing body with the developer contained in the developer container; wherein when the image forming apparatus is used as a color image forming apparatus, a color control program instructs the color image forming apparatus to perform image formation using setting information that is changeable and that is recorded on the color control program; wherein when the image forming apparatus is used as a single-color image forming apparatus, a single-color control program instructs the single-color image forming apparatus to perform image formation using setting information that is changeable and that is recorded on the single-color control program; wherein when the image forming apparatus is switched from the single-color image forming apparatus to the color image forming apparatus or from the color image forming apparatus to the single-color image forming apparatus, at least a portion of the setting information of the control program that is used after the switching is kept the same as a portion of the setting information of the control program that was used before the switching; wherein the setting information of the color control program and the setting information of the single-color control program include information that is changeable by a user; wherein the information that is changeable by a user includes medium information about a medium on which an image is formed; wherein the medium information includes information about the size of the medium; wherein the information that is changeable by a user is provided in the image forming apparatus, and includes information about a medium-supplying section for containing the medium on which an image is formed; wherein the image forming apparatus has information indicative of whether the image forming apparatus is being used as the color image forming apparatus or whether the image forming apparatus is being used as the single-color image forming apparatus; and wherein the single-color image forming apparatus is a monochrome image forming apparatus that forms monochrome images, when a developer container is attached to only one of the plurality of attach/ detach sections, by developing the latent image borne on the image bearing body with the developer contained in the developer container.

It is also possible to achieve a computer-readable storage medium having recorded thereon a control program that is for a computer being capable of communicating with an image forming apparatus, and that is for instructing the image forming apparatus to perform image formation, the image forming apparatus having a plurality of attach/detach sections to and from each of which a developer container for containing developer can be attached and detached, and an image bearing body for bearing a latent image, wherein when a developer container is attached to each of the plurality of attach/detach sections, the image forming apparatus is usable as a color image forming apparatus for forming a color image by developing the latent image borne on the image bearing body with the developer contained in each developer container, wherein when a developer container is attached to only one of the plurality of attach/detach sections, the image forming apparatus is usable as a single-color image forming apparatus for forming a single-color image by developing the latent image borne on the image bearing body with the developer contained in the developer container, wherein when the image forming apparatus is used as a color image forming apparatus and the control program is a color control program, the control program instructs the color image forming apparatus to perform image formation using setting information that is changeable and that is recorded on the color control program, wherein when the image forming apparatus is used as a single-color image forming apparatus and the control program is a single-color control program, the control program instructs the single-color image forming apparatus to perform image formation using setting information that is changeable and that is recorded on the single-color control program, and wherein when the image forming apparatus is switched from the single-color image forming apparatus to the color image forming apparatus or from the color image forming apparatus to the single-color image forming apparatus, at least a portion of the setting information of the control program that is used after the switching is kept the same as a portion of the setting information of the control program that was used before the switching.

<<<Embodiment of Image Forming System Etc.>>>

===Overall Configuration Example of Image Forming System===

Figure 2:
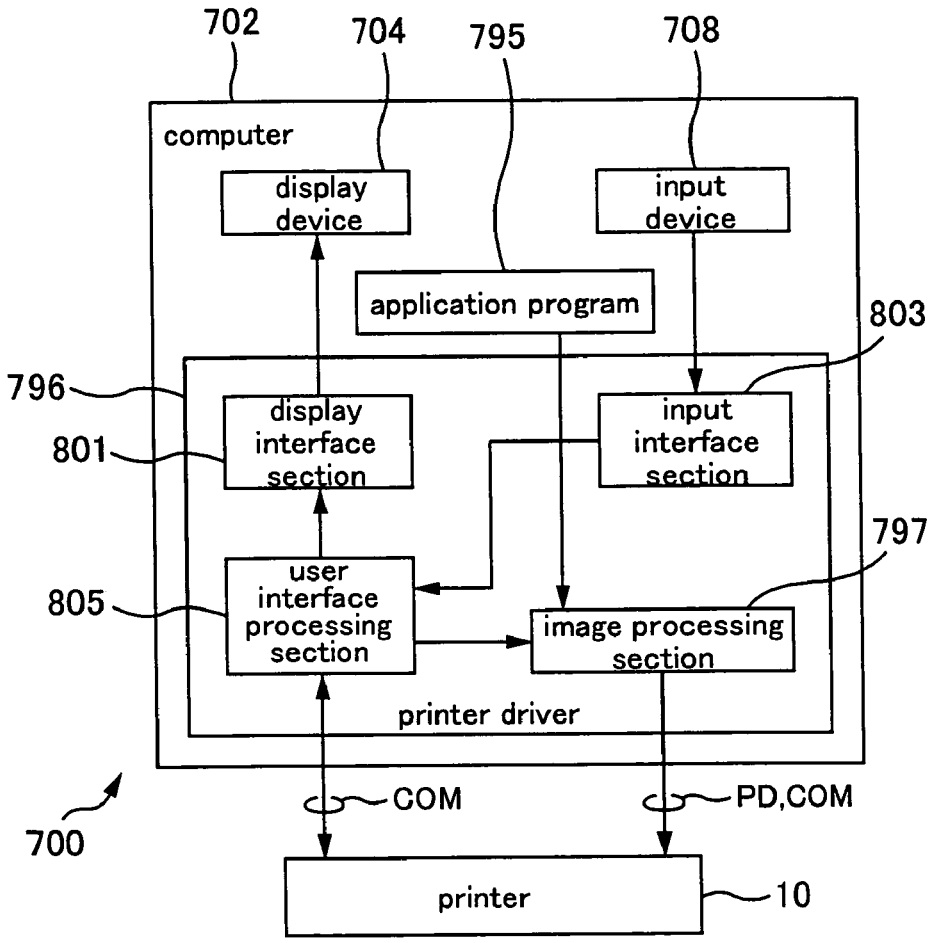
FIG. 2 is a block diagram showing a portion of the structure of the image forming system 700 shown in FIG. 1.

Next, with reference to FIG. 1 and FIG. 2, an outline of an image forming system 700 is described. FIG. 1 is an explanatory diagram showing an external configuration of an image forming system 700. FIG. 2 is a block diagram showing a portion of the structure of the image forming system 700 shown in FIG. 1. The image forming system 700 includes a laser beam printer 10 (which is also referred to as a "printer" below) that serves as an image forming apparatus, and a computer 702 that is capable of communicating with the printer 10.

The computer 702 is provided with a display device 704, such as a CRT (Cathode Ray Tube), a liquid crystal display device, or a plasma display, that serves as an example of a displaying section for displaying information, an input device 708 such as a keyboard 708A and a mouse 708B, a reading device 710 such as an FD (Flexible Disk) device 710A, a CD-ROM drive device 710B, an MO (Magneto Optical) disk drive device (not shown), a DVD (Digital Versatile Disk) device (not shown), an internal memory (not shown) such as a RAM, and an external memory (not shown) such as a hard disk drive unit. Furthermore, in the present embodiment, the computer 702 is contained in a mini-tower-type casing, but this is not a limitation.

The computer 702 also has an operating system, an application program 795 that runs under the operating system, and a printer driver 796 which serves as an example of a driver or a control program. The printer driver 796 includes an image processing section 797, a display interface section 801, an input interface section 803, and a user interface processing section 805.

The application program 795 is a program in the computer 702 that makes the printer 10 carry out image formation. In accordance with image-formation execution commands from the application program 795, image data AD in the application program are sent to the printer driver 796.

The image processing section 797 has the functions of receiving the image data AD, which can be interpreted by the application program 795, converting the data AD into image data PD which can be interpreted by the printer 10, and sending the converted image data PD to the printer 10 along with various control signals COM. In other words, the image processing section 797 of the printer driver 796 instructs execution of image formation to the printer 10 after carrying out the above-described image processing. In order to achieve the functions described above, the image processing section 797 executes, for example, resolution conversion, conversion of color components, and so forth.

The display interface section 801 has the function of displaying, on the display device 704, various user-interface windows relating to image formation. The input interface section 803 has the function of receiving input information that has been input by the user with the input device 708 through the user-interface windows.

The user interface processing section 805 has the function of serving as an interface between the printer 10 and the display interface section 801 or the input interface section 803. For example, the user interface processing section 805 receives the input information from the input interface section 803, and interprets the input information. The user interface processing section 805 then sends various command signals COM to the printer 10 and/or the image processing section 797. The user interface processing section 805 also interprets the various command signals COM received from the printer 10 and sends display-related information to the display interface section 801.

It should be noted that the printer driver 796 of the computer 702 is supplied in a form recorded on computer-readable storage media. Various kinds of computer-readable storage media can be used for these storage media, such as flexible disks, CD-ROMs, magneto-optical disks, IC cards, ROM cartridges, punched cards, printed articles on which codes such as barcodes have been printed, internal storage devices in computers (e.g., memories such as RAMs and ROMs), and external storage devices. Furthermore, such computer programs may be downloaded to the computer 702 via the Internet.

Further, although detailed description will be given further below, when developing units are attached to each of the attach/detach sections, the printer 10 according to the present embodiment can be used as a color printer (which serves as an example of a color image forming apparatus) that forms color images by developing a latent image borne on a photoconductor with toner contained in those developing units, and when a developing unit is attached to only one of the attach/detach sections, the printer 10 can be used as a monochrome printer (which serves as an example of a single-color image forming apparatus) that forms monochrome images by developing a latent image borne on the photoconductor with the toner contained in that developing unit. As regards the printer driver 796, a color driver that corresponds to the printer 10 when it is used as a color printer and a monochrome driver that corresponds to the printer 10 when it is used as a monochrome printer are supplied.

Basically, the user will install a color driver to the computer 702 when the printer 10 is to be used as a color printer, and install a monochrome driver to the computer 702 when the printer 10 is to be used as a monochrome printer. There is no problems however, in using a monochrome driver when the printer 10 is being used as a color printer, or using a color driver when the printer 10 is being used as a monochrome printer, if functional restrictions are not taken into consideration.

The color driver and the monochrome driver differ in terms of the following aspects. First, the monochrome driver does not have functions specific to colors. For example, information specific to colors is not shown on the user-interface windows displayed on the display device 704 by the display interface section 801 of the monochrome driver, and the input interface section 803 of the monochrome driver does not accept input information specific to colors.

On the other hand, the color driver is capable of instructing both execution of color-image formation and execution of monochrome-image formation to the printer 10. More specifically, the display interface section 801 of the color driver displays, on the display device 704, a user-interface window for allowing a user to select either execution of color-image formation or execution of monochrome-image formation. Then, the input interface section 803 receives input information that has been entered by the user through the user-interface window using the input device 708, i.e., information that indicates either execution of color-image formation or execution of monochrome-image formation. The image processing section 797 then receives the information through the user interface processing section 805; if the information indicates execution of color-image formation, then the image processing section executes image processing for forming color images, whereas if the information indicates execution of monochrome-image formation, then it executes image processing for forming monochrome images. After image processing is finished, the monochrome or color image data PD that have been processed are sent to the printer. It should be noted that the monochrome driver can only instruct the printer 10 to execute monochrome-image formation.

===Overall Configuration Example of Image Forming Apparatus===

Figure 3:
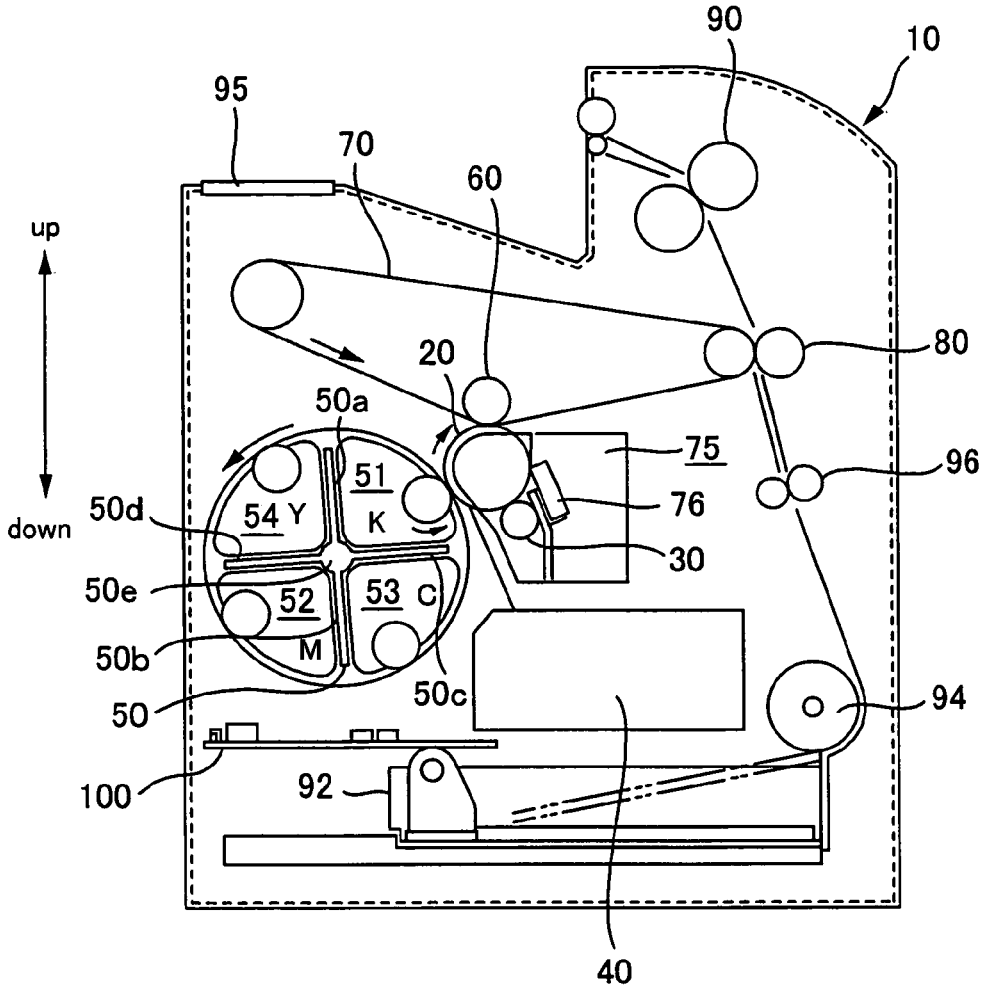
FIG. 3 is a diagram showing main structural components that structure a printer 10 when the printer 10 is used as a color printer.
Figure 4:
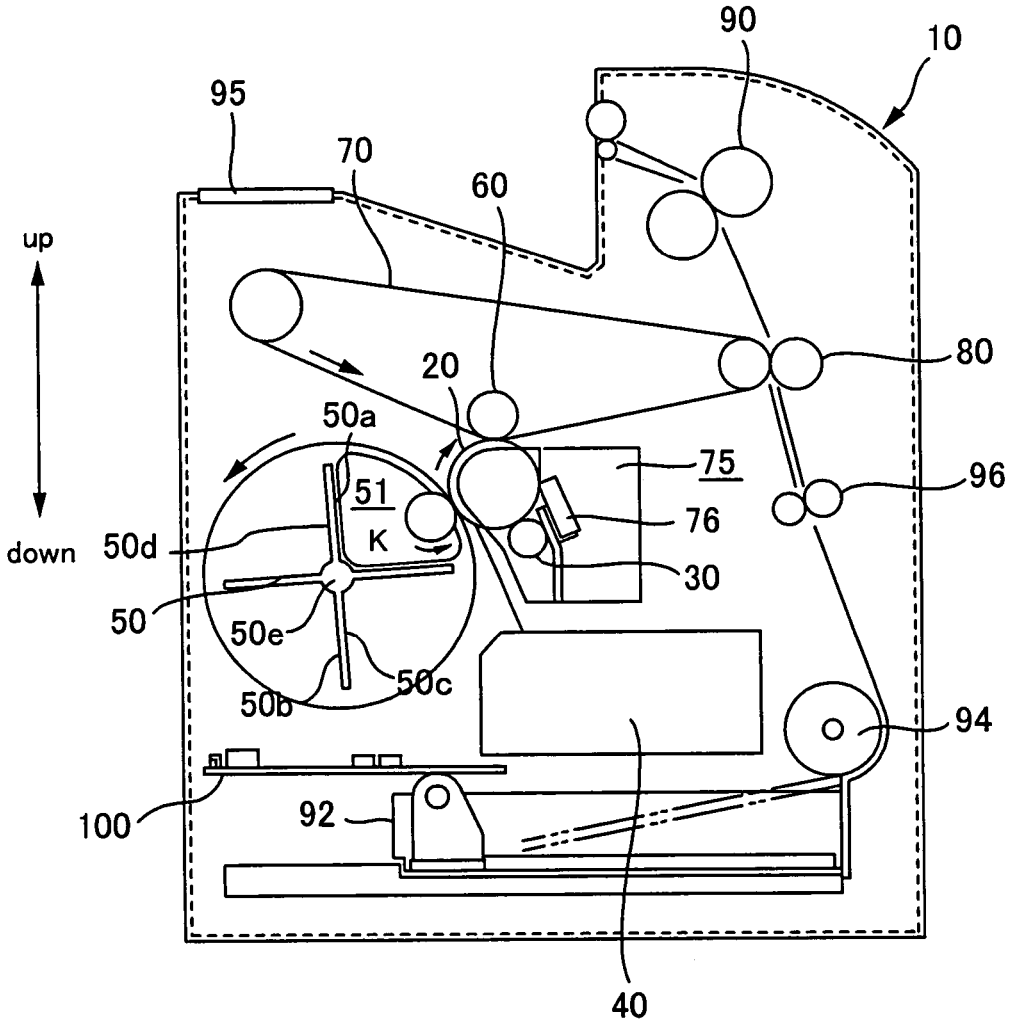
FIG. 4 is a diagram showing main structural components that structure the printer 10 when the printer 10 is used as a monochrome printer.

Next, with reference to FIG. 3 and FIG. 4, an outline of the printer 10, which is an example of an image-forming apparatus, will be described. FIG. 3 and FIG. 4 are diagrams showing main structural components constructing the printer 10. FIG. 3 is a diagram showing the main structural components for when the printer 10 is used as a color printer, and FIG. 4 is a diagram showing the main structural components for when the printer 10 is used as a monochrome printer. The usage of the printer 10 as a color printer or a monochrome printer will be described in detail further below. Note that in FIG. 3 and FIG. 4, the vertical direction is shown by the arrow, and, for example, a paper supply tray 92 (which serves as an example of a medium-supplying section for containing the media) is arranged at a lower section of the printer 10, and a fusing unit 90 is arranged at an upper section of the printer 10.

As shown in FIG. 3 and FIG. 4, the printer 10 includes a charging unit 30, an exposing unit 40, a YMCK developing device 50, a first transferring unit 60, an intermediate transferring body 70, and a cleaning unit 75, all of which being arranged in the direction of rotation of a photoconductor 20 which is for bearing a latent image. The printer 10 further includes a second transferring unit 80, a fusing unit 90, a displaying unit 95 constructed of a liquid-crystal panel and serving as means for making notifications to the user etc., and a control unit 100 for controlling these units etc. and managing their operations as a printer.

The photoconductor 20 has a cylindrical conductive base and a photoconductive layer formed on the outer peripheral surface of the conductive base, and it is rotatable about its central axis. In the present embodiment, the photoconductor 20 rotates clockwise, as shown by the arrow in FIG. 3 and FIG. 4.

The charging unit 30 is a device for charging the photoconductor 20. The exposing unit 40 is a device for forming a latent image on the charged photoconductor 20 by radiating a laser beam thereon. The exposing unit 40 has, for example, a semiconductor laser, a polygon mirror, and an F-θ lens, and radiates a modulated laser beam onto the charged photoconductor 20 according to image information having been input from a not-shown computer such as a personal computer or a word processor.

The YMCK developing device 50 has a plurality of attach/detach sections 50*a*, 50*b*, 50*c*, and 50*d* to and from which developing units, which serve as an example of developer containers, can be attached an detached. The YMCK developing device 50 is a device for developing a latent image formed on the photoconductor 20 using toner T, which serves as an example of developer contained in each of the developing units attached to and held by the attach/detach sections.

As described above, when the developing units are attached to each of the attach/detach sections 50*a*, 50*b*, 50*c*, and 50*d*, the printer 10 according to the present embodiment can be used as a color printer for forming color images by developing the latent image borne on the photoconductor 20 using the toner T contained in each of the developing units. On the other hand, when a developing unit is attached to only one of the attach/detach sections 50*a*, 50*b*, 50*c*, or 50*d*, then the printer 10 can be used as a monochrome printer for forming monochrome images by developing the latent image borne on the photoconductor 20 using the toner T contained in that developing unit. In conventional printers, it is not possible to form monochrome images unless all of developing units, which contain toner of different colors, are attached to the YMCK developing device such that the printer is always ready to be able to form color images. On the contrary, the printer 10 according to the present embodiment operates as a monochrome printer that is able to form monochrome images on a medium using a black developing unit 51, even in a state where only the black developing unit 51 is attached.

When the printer 10 is used as a color printer, four developing units—a black developing unit 51, a magenta developing unit 52, a cyan developing unit 53, and a yellow developing unit 54—are attached to the attach/detach sections 50*a*, 50*b*, 50*c*, and 50*d* of the YMCK developing device 50, as shown in FIG. 3, and the latent image formed on the photoconductor 20 is developed with the toner T contained in each of the developing units.

The YMCK developing device 50 can rotate to move the positions of the four developing units 51, 52, 53, and 54. More specifically, the four developing units 51, 52, 53, and 54 can be rotated about a rotating shaft 50*e* while maintaining their relative positions. Every time an image forming process for one page is finished, each of the developing units selectively opposes the photoconductor 20 to successively develop the latent image formed on the photoconductor 20 using the toner T contained in each of the developing units 51, 52, 53, and 54.

On the other hand, when the printer 10 is used as a monochrome printer, a developing unit is attached to only one of the attach/detach sections of the YMCK developing device 50, as shown in FIG. 4, and the latent image formed on the photoconductor 20 is developed by the toner T contained in that developing unit. More specifically, the black developing unit 51 is attached to an attach/detach section 50*a*, among the four attach/detach sections 50*a*, 50*b*, 50*c*, and 50*d*, and when an image is to be formed, the black developing unit 51 is moved by the rotation of the YMCK developing device 50 to a position in opposition to the photoconductor 20. The latent image formed on the photoconductor 20 is then developed with the black toner T contained in the black developing unit 51.

It should be noted that the developing units and the attach/detach sections according to the present embodiment are physically structured such that a developing unit can only be attached to one attach/detach section corresponding to that developing unit. More specifically, among the four attach/detach sections 50*a*, 50*b*, 50*c*, and 50*d*, the black developing unit 51 can only be attached to the attach/detach section 50*a*, the magenta developing unit 52 can only be attached to the attach/detach section 50*b*, the cyan developing unit 53 can only be attached to the attach/detach section 50*c*, and the yellow developing unit 54 can only be attached to the attach/detach section 50*d*.

Further, details on the YMCK developing device 50 and the developing units will be described further below.

The first transferring unit 60 is a device for transferring, onto the intermediate transferring body 70, a toner image formed on the photoconductor 20.

The intermediate transferring body 70 is a laminated endless belt that is made by providing an aluminum layer on the surface of a PET film by vapor deposition, and then further applying semiconducting coating on the outer layer thereof. The intermediate transferring body 70 is driven to rotate at substantially the same circumferential speed as the photoconductor 20.

The second transferring unit 80 is a device for transferring the toner image formed on the intermediate transferring body 70 onto a medium such as paper, film, and cloth.

The fusing unit 90 is a device for fusing the toner image, which has been transferred onto the medium, to the medium to make it into a permanent image.

The cleaning unit 75 is a device that is provided between the first transferring unit 60 and the charging unit 30, that has a rubber cleaning blade 76 made to abut against the surface of the photoconductor 20, and that is for removing the toner T remaining on the photoconductor 20 by scraping it off with the cleaning blade 76 after the toner image has been transferred onto the intermediate transferring body 70 by the first transferring unit 60.

It should be noted that although only one paper supply tray 92 is shown in FIG. 3 and FIG. 4, it is possible to mount a plurality of paper supply trays to the printer 10.

Figure 5:
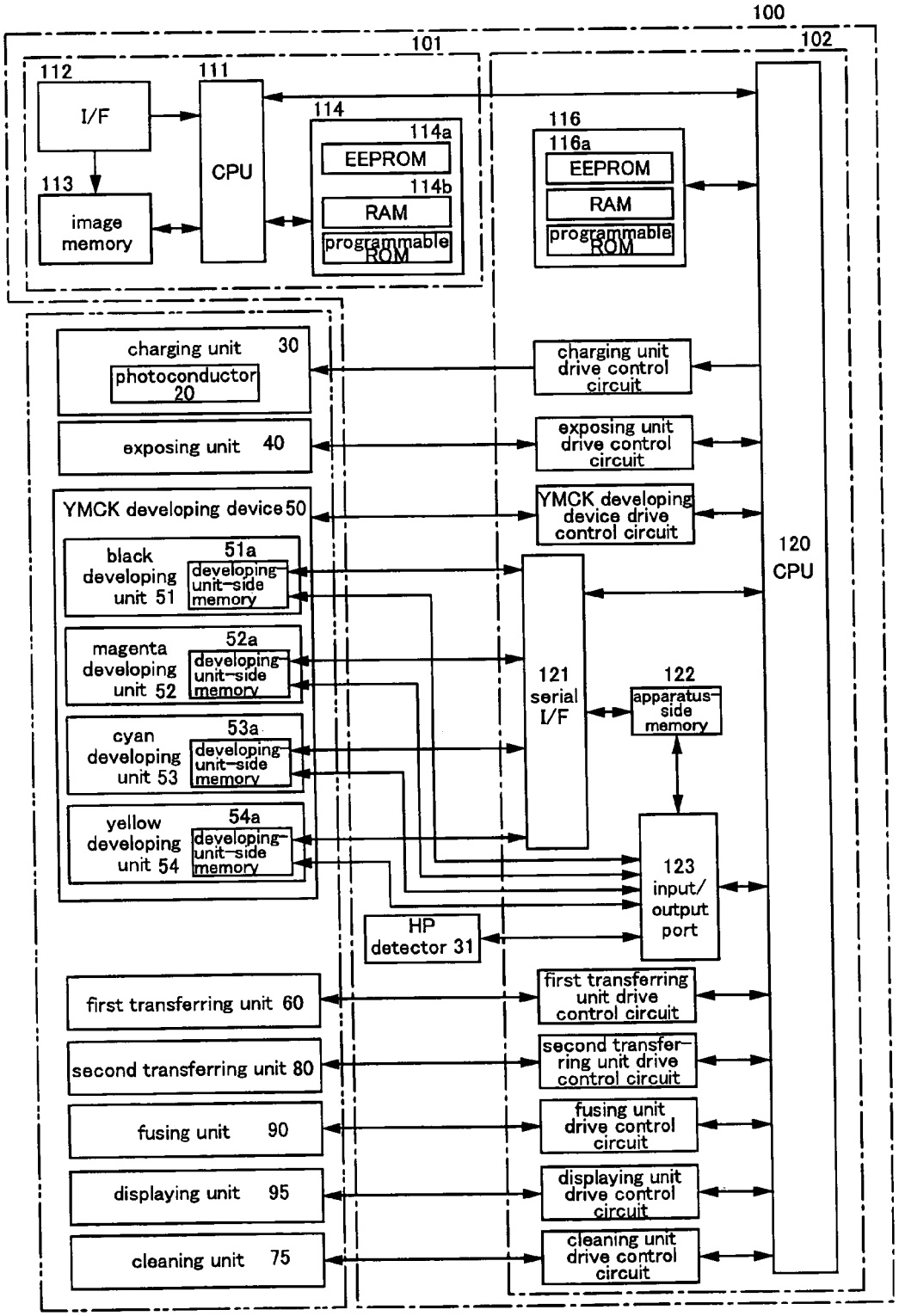
FIG. 5 is a block diagram showing a control unit 100 of the printer 10.

The control unit 100 includes a main controller 101 and a unit controller 102 as shown in FIG. 5. Image data PD and control signals COM are input from the above-described computer 702 to the main controller 101, and according to instructions based on these image data PD and control signals COM, the unit controller 102 controls each of the above-mentioned units etc. to form an image.

===Example of Operation of Image Forming Apparatus===

Next, operations of the printer 10 structured as above are described separately for when color images are to be formed and for when monochrome images are to be formed. It should be noted that even when the printer 10 is used as a color printer, the printer 10 is able to form not only color images but also monochrome images. Therefore, the operations described below for when monochrome images are to be formed apply both to the case in which the printer 10 is being used as the above-described color printer to form monochrome images, and the case in which the printer 10 is being used as a monochrome printer to form monochrome images.

<Forming Color Images>

First, the operations of the printer 10 for when color images are to be formed are described below.

When image data PD and control signals COM are input from the computer 702 to the main controller 101 of the printer 10 through an interface (I/F) 112, the photoconductor 20, a developing roller which is provided in each developing unit, and the intermediate transferring body 70 rotate under the control of the unit controller 102 based on the instructions from the main controller 101. While being rotated, the photoconductor 20 is successively charged by the charging unit 30 at a charging position.

With the rotation of the photoconductor 20, the charged area of the photoconductor 20 reaches an exposing position. A latent image that corresponds to the image information about the first color, for example, yellow Y, is formed in that area by the exposing unit 40. The YMCK developing device 50 is positioned such that the yellow developing unit 54, which contains yellow (Y) toner, is at the developing position opposing the photoconductor 20.

With the rotation of the photoconductor 20, the latent image formed on the photoconductor 20 reaches the developing position, and is developed with the yellow toner by the yellow developing unit 54. Thus, a yellow toner image is formed on the photoconductor 20.

With the rotation of the photoconductor 20, the yellow toner image formed on the photoconductor 20 reaches a first transferring position, and is transferred onto the intermediate transferring body 70 by the first transferring unit 60. At this time, a first transferring voltage, which is in an opposite polarity to the polarity to which the toner T is charged, is applied to the first transferring unit 60. It should be noted that, during this process, the photoconductor 20 and the intermediate transferring body 70 are placed in contact with each other, and the second transferring unit 80 is kept separated from the intermediate transferring body 70.

By subsequently performing the above-mentioned processes for the second, the third, and the fourth colors for each of the developing units, toner images in four colors corresponding to the respective image data PD are transferred onto the intermediate transferring body 70 in a superimposed manner. As a result, a full-color toner image is formed on the intermediate transferring body 70.

With the rotation of the intermediate transferring body 70, the full-color toner image formed on the intermediate transferring body 70 reaches a second transferring position, and is transferred onto a medium by the second transferring unit 80. It should be noted that the medium is carried from the paper supply tray 92 to the second transferring unit 80 via the paper-feed roller 94 and resisting rollers 96. During transferring operations, a second transferring voltage is applied to the second transferring unit 80 and also the unit 80 is pressed against the intermediate transferring body 70.

The full-color toner image transferred onto the medium is heated and pressurized by the fusing unit 90 and fused to the medium.

On the other hand, after the photoconductor 20 passes the first transferring position, the toner T adhering to the surface of the photoconductor 20 is scraped off by the cleaning blade 76 that is supported on the cleaning unit 75, and the photoconductor 20 is prepared for charging for forming the next latent image. The scraped-off toner T is collected into a remaining-toner collector of the cleaning unit 75.

<Forming Monochrome Images>

Next, the operations of the printer 10 for when monochrome images are to be formed are described below.

When image data PD and control signals COM are input from the computer 702 to the main controller 101 of the printer 10 through the interface (I/F) 112, the photoconductor 20, the developing roller which is provided in each developing unit, and the intermediate transferring body 70 rotate under the control of the unit controller 102 based on the instructions from the main controller 101. While being rotated, the photoconductor 20 is successively charged by the charging unit 30 at the charging position.

With the rotation of the photoconductor 20, the charged area of the photoconductor 20 reaches the exposing position. A latent image that corresponds to the image information is formed in that area by the exposing unit 40. The YMCK developing device 50 is positioned such that the black developing unit 51, which contains black toner, is at the developing position opposing the photoconductor 20.

With the rotation of the photoconductor 20, the latent image formed on the photoconductor 20 reaches the position where development is possible, and is developed by the black developing unit 51. Thus, a toner image is formed on the photoconductor 20.

With the rotation of the photoconductor 20, the toner image formed on the photoconductor 20 reaches the first transferring position, and is transferred onto the intermediate transferring body 70 by the first transferring unit 60. At this time, a first transferring voltage, which is in an opposite polarity to the polarity to which the toner is charged, is applied to the first transferring unit 60. It should be noted that, during this process, the second transferring unit 80 is kept separated from the intermediate transferring body 70.

With the rotation of the intermediate transferring body 70, the toner image formed on the intermediate transferring body 70 reaches the second transferring position, and is transferred onto a medium by the second transferring unit 80. It should be noted that the medium is carried from the paper supply tray 92 to the second transferring unit 80 via the paper-feed roller 94 and the resisting rollers 96. During transferring operations, a second transferring voltage is applied to the second transferring unit 80 and also the unit 80 is pressed against the intermediate transferring body 70.

The toner image transferred onto the medium is heated and pressurized by the fusing unit 90 and fused to the medium.

On the other hand, after the photoconductor 20 passes the first transferring position, the toner T adhering to the surface of the photoconductor 20 is scraped off by the cleaning blade 76 that is supported on the cleaning unit 75, and the photoconductor 20 is prepared for charging for forming the next latent image. The scraped-off toner T is collected into the remaining-toner collector of the cleaning unit 75.

===Configuration Example of Developing Unit===

Figure 6:
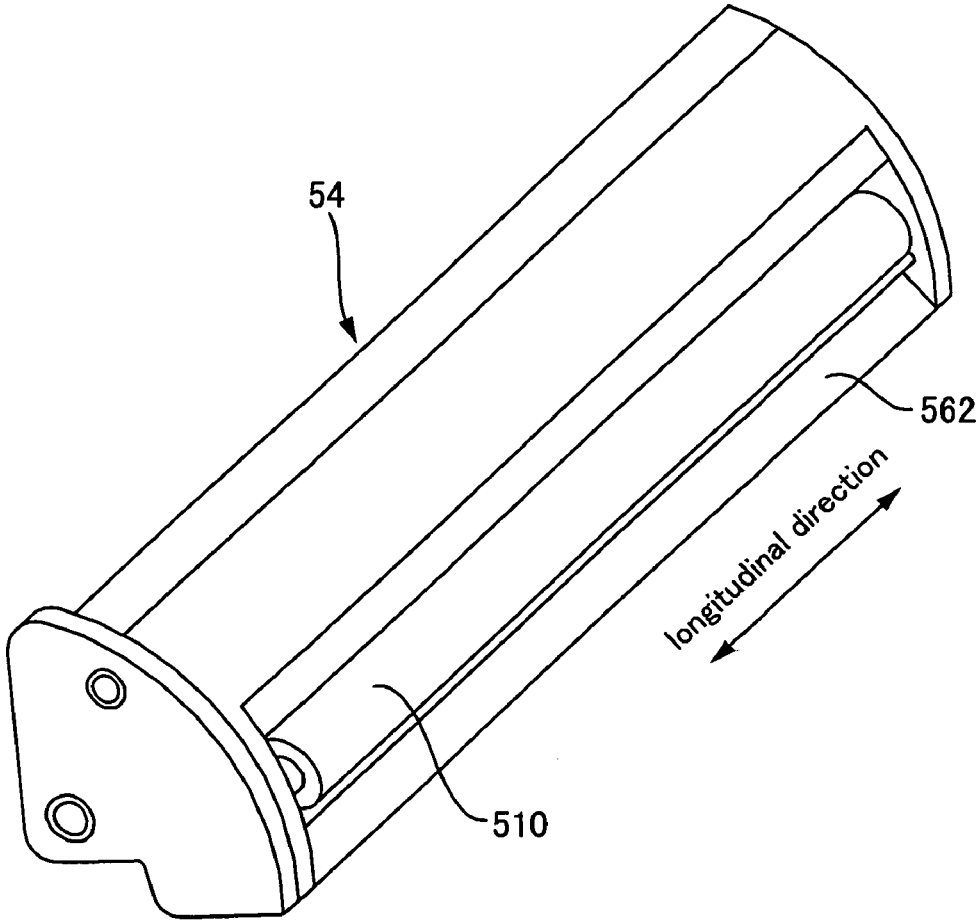
FIG. 6 is a conceptual diagram of a developing unit.
Figure 7:
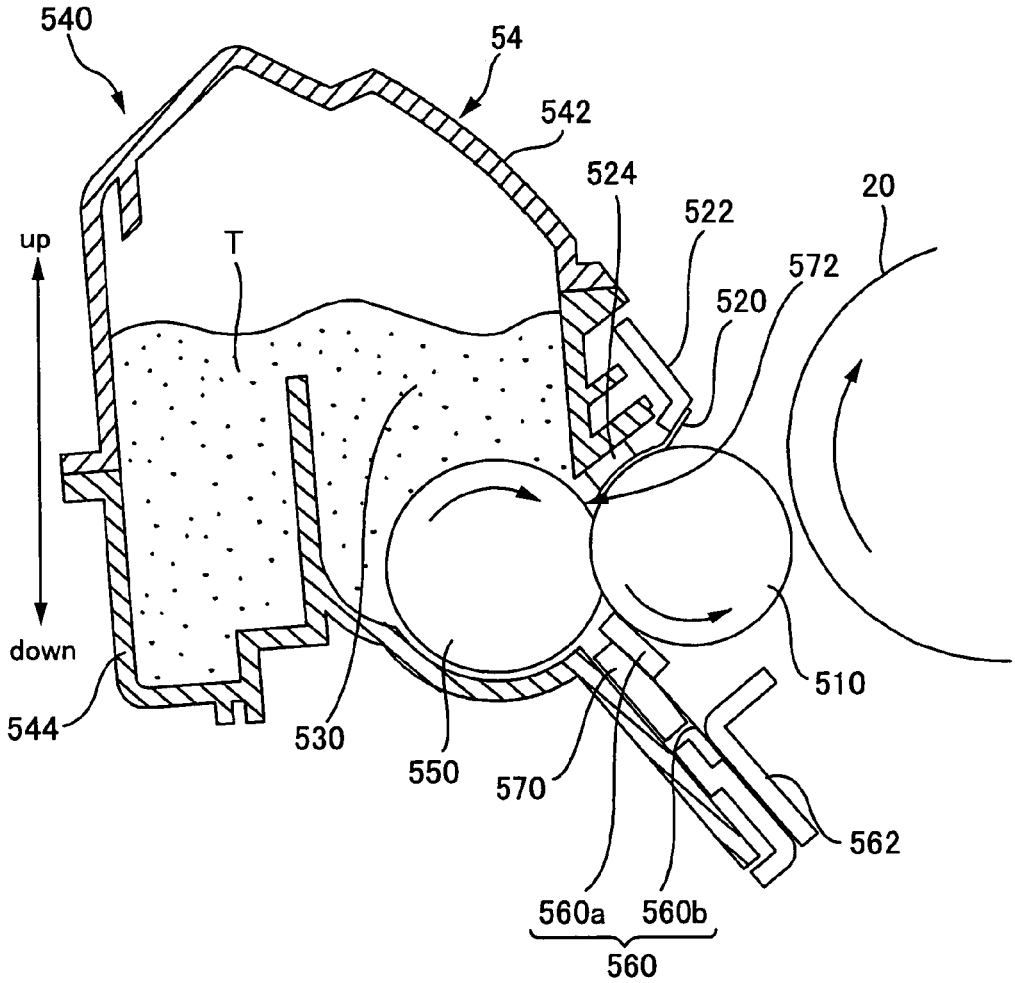
FIG. 7 is a section view showing main structural components of the developing unit.

Next, with reference to FIG. 6 and FIG. 7, an example of a configuration of the developing units will be described. FIG. 6 is a conceptual diagram of a developing unit. FIG. 7 is a section view showing main structural components of the developing unit. Note that the section view shown in FIG. 7 is a cross section of the developing unit cut off by a plane perpendicular to the longitudinal direction shown in FIG. 6. Further, in FIG. 7, the arrow indicates the vertical direction as in FIG. 3, and, for example, the central axis of the developing roller 510 is located below the central axis of the photoconductor 20. Further, in FIG. 7, the yellow developing unit 54 is shown to be in a state in which it is positioned at the developing position opposing the photoconductor 20.

To the YMCK developing device 50, it is possible to attach: the black developing unit 51 containing black (K) toner; the magenta developing unit 52 containing magenta (M) toner; the cyan developing unit 53 containing cyan (C) toner; and the yellow developing unit 54 containing yellow (Y) toner. Since the configuration of each of the developing units is the same, description will be made only about the yellow developing unit 54 below.

The yellow developing unit 54 has, for example, the developing roller 510, a sealing member 520, a toner containing section 530, a housing 540, a toner supplying roller 550, and a restriction blade 560.

The developing roller 510 bears toner T and delivers it to the developing position opposing the photoconductor 20. The developing roller 510 is made of metal and manufactured from, for example, aluminum alloy such as aluminum alloy 5056 or aluminum alloy 6063, or iron alloy such as STKM, and the roller 510 is plated with, for example, nickel plating or chromium plating, as necessary.

Further, as shown in FIG. 6, the developing roller 510 is supported at both ends in its longitudinal direction and is rotatable about its central axis. As shown in FIG. 7, the developing roller 510 rotates in the opposite direction (counterclockwise in FIG. 7) from the rotating direction of the photoconductor 20 (clockwise in FIG. 7). The central axis of the roller 510 is located below the central axis of the photoconductor 20. Further, as shown in FIG. 7, in the state where the yellow developing unit 54 opposes the photoconductor 20, a gap exists between the developing roller 510 and the photoconductor 20. That is, the yellow developing unit 54 develops the latent image formed on the photoconductor 20 in a non-contacting state. Note that an alternating field is generated between the developing roller 510 and the photoconductor 20 upon development of the latent image formed on the photoconductor 20.

The sealing member 520 prevents the toner T in the yellow developing unit 54 from spilling out therefrom, and also collects the toner T, which is on the developing roller 510 that has passed the developing position, into the developing unit without scraping it off. The sealing member 520 is a seal made of, for example, polyethylene film. The sealing member 520 is supported by a seal-supporting metal plate 522, and is attached to the housing 540 by means of the seal-supporting metal plate 522. A seal-urging member 524 made of, for example, Moltoprene is provided on one side of the sealing member 520 opposite to the side of the developing roller 510. The sealing member 520 is pressed against the developing roller 510 by the elastic force of the seal-urging member 524. Note that the abutting position at which the sealing member 520 abuts against the developing roller 510 is situated above the central axis of the developing roller 510.

The housing 540 is manufactured by welding together a plurality of integrally-molded housing sections, that is, an upper housing section 542 and a lower housing section 544. As shown in FIG. 7, the housing 540 has an opening 572 opening toward the outside of the housing 540. The above-mentioned developing roller 510 is arranged from the outside of the housing 540 with its peripheral surface facing the opening 572 in such a state that a part of the roller 510 is exposed to the outside. The restriction blade 560, which is described in detail below, is also arranged from the outside of the housing 540 facing the opening 572.

Further, the housing 540 forms a toner containing section 530 that is capable of containing toner T. The toner containing section 530 may be provided with a stirring member for stirring the toner T. In the present embodiment, however, a stirring member is not provided in the toner containing section 530 because each of the developing units (i.e., the black developing unit 51, the magenta developing unit 52, the cyan developing unit 53, and the yellow developing unit 54) is rotated as the YMCK developing device 50 rotates nd thereby the toner T in each developing unit is stirred.

The toner supplying roller 550 is provided in the toner containing section 530 described above and supplies the toner T contained in the toner containing section 530 to the developing roller 510. The toner supplying roller 550 is made of, for example, polyurethane foam, and is made to abut against the developing roller 510 in an elastically deformed state. The toner supplying roller 550 is arranged at a lower section of the toner containing section 530. The toner T contained in the toner containing section 530 is supplied to the developing roller 510 by the toner supplying roller 550 at the lower section of the toner containing section 530. The toner supplying roller 550 is rotatable about its central axis. The central axis of the toner supplying roller 550 is situated below the central axis of rotation of the developing roller 510. Further, the toner supplying roller 550 rotates in the opposite direction (clockwise in FIG. 7) from the rotating direction of the developing roller 510 (counter-clockwise in FIG. 7). Note that the toner supplying roller 550 has the function of supplying the toner T contained in the toner containing section 530 to the developing roller 510 as well as the function of stripping off, from the developing roller 510, the toner T remaining on the developing roller 510 after development.

The restriction blade 560 restricts the thickness of the layer of the toner T borne by the developing roller 510 and also gives charge to the toner T borne by the developing roller 510. This restriction blade 560 has a rubber section 560*a* and a rubber-supporting section 560*b*. The rubber section 560*a* is made of, for example, silicone rubber or urethane rubber. The rubber-supporting section 560*b* is a thin plate that is made of, for example, phosphor bronze or stainless steel, and that has a springy characteristic. The rubber section 560*a* is supported by the rubber-supporting section 560*b*. The rubber-supporting section 560*b* is attached to the housing 540 via a pair of blade-supporting metal plates 562 in a state that one end of the rubber-supporting section 560*b* is pinched between and supported by the blade-supporting metal plates 562. Further, a blade-backing member 570 made of, for example, Moltoprene is provided on one side of the restriction blade 560 opposite from the side of the developing roller 510.

The rubber section 560*a* is pressed against the developing roller 510 by the elastic force caused by the flexure of the rubber-supporting section 560*b*. Further, the blade-backing member 570 prevents the toner T from entering in between the rubber-supporting section 560*b* and the housing 540, stabilizes the elastic force caused by the flexure of the rubber-supporting section 560*b*, and also, applies force to the rubber section 560*a* from the back thereof towards the developing roller 510 to press the rubber section 560*a* against the developing roller 510. In this way, the blade-backing member 570 makes the rubber section 560*a* abut against the developing roller 510 more evenly.

The end of the restricting blade 560 opposite from the end that is supported by the blade-supporting metal plates 562, i.e., the tip end, is not placed in contact with the developing roller 510; rather, a section at a predetermined distance from the tip end is placed in contact with the developing roller 510 with some breadth. That is, the restriction blade 560 does not abut against the developing roller 510 at its edge, but abuts against the roller 510 near its central portion. Further, the restriction blade 560 is arranged such that its tip end faces towards the upstream side of the rotating direction of the developing roller 510, and thus, makes a so-called counter-abutment with respect to the roller 510. It should be noted that the abutting position at which the restriction blade 560 abuts against the developing roller 510 is below the central axis of the developing roller 510 and is also below the central axis of the toner supplying roller 550.

In the yellow developing unit 54 structured as above, the toner supplying roller 550 supplies the toner T contained in the toner containing section 530 to the developing roller 510. With the rotation of the developing roller 510, the toner T, which has been supplied to the developing roller 510, reaches the abutting position of the restriction blade 560. Then, as the toner T passes the abutting position, the toner is electrically charged and its layer thickness is restricted. With further rotation of the developing roller 510, the toner T on the developing roller 510, whose layer thickness has been restricted, reaches the developing position opposing the photoconductor 20. Then, under the alternating field, the toner T is used at the developing position for developing the latent image formed on the photoconductor 20. With further rotation of the developing roller 510, the toner T on the developing roller 510, which has passed the developing position, passes the sealing member 520 and is collected into the developing unit without being scraped off by the sealing member 520. Then, the toner T that still remains on the developing roller 510 can be stripped off by the toner supplying roller 550.

Each developing unit 51, 52, 53, and 54 is also provided with a storage element (which is also referred to below as a "developing-unit-side memory") 51*a*, 52*a*, 53*a*, and 54*a* that is for storing various kinds of information about the developing unit, such as color information about the color of the toner contained in each developing unit and toner consumption amount, and that is, for example, a non-volatile storage memory such as a serial EEPROM.

Developing-unit-side connectors 51*b*, 52*b*, 53*b*, and 54*b*, which are provided on one end surface of the respective developing units, come into connection, as necessary, with an apparatus-side connector 34, which is provided on the apparatus side (i.e., the printer side), and in this way, the developing-unit-side memories 51*a*, 52*a*, 53*a*, and 54*a* are electrically connected to the unit controller 102 of the control unit 100 of the apparatus.

===Overview of YMCK Developing Device===

Next, an overview of the YMCK developing device 50 will be described with reference to FIG. 8A, FIG. 8B, and FIG. 8C. It should be noted that in the present section, an example is described in which four developing units 51, 52, 53, and 54 are attached to the respective attach/detach sections 50*a*, 50*b*, 50*c*, and 50*d*, for the sake of convenience. The description below, however, is also applicable to cases in which a developing unit is attached to only one of the four attach/detach sections 50*a*, 50*b*, 50*c*, and 50*d*.

The YMCK developing device 50 has a rotating shaft 50*e* positioned at the center. A support frame 55 for holding the developing units is fixed to the rotating shaft 50*e*. The rotating shaft 50*e* is provided extending between two frame side plates (not shown) which form a casing of the printer 10, and both ends of the shaft 50*e* are supported. It should be noted that the axial direction of the rotating shaft 50*e* intersects with the vertical direction.

The support frame 55 is provided with the four attach/detach sections 50*a*, 50*b*, 50*c*, and 50*d*, by which the above-described developing units 51, 52, 53, and 54 of the four colors are held in an attachable/detachable manner about the rotating shaft 50*e*, in the circumferential direction at an interval of 90°.

A pulse motor, which is not shown, is connected to the rotating shaft 50*e* via a clutch. By driving the pulse motor, it is possible to rotate the support frame 55 and position the four developing units 51, 52, 53, and 54 mentioned above at predetermined positions.

Figure 8A:
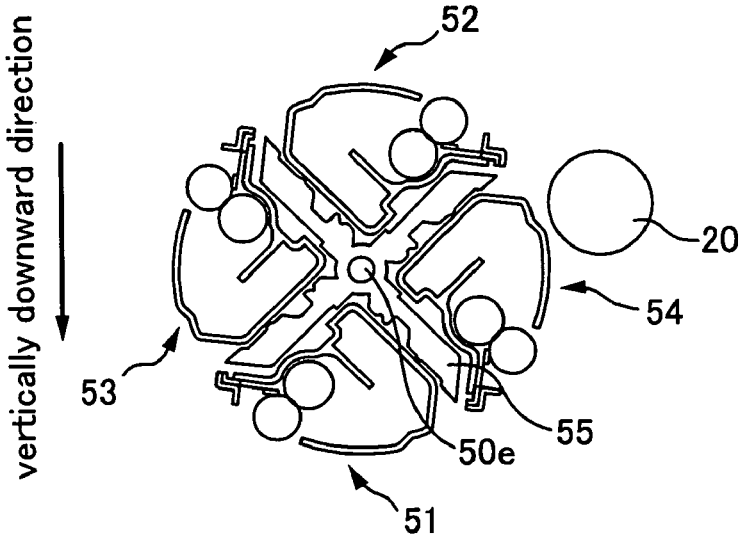
FIG. 8A shows a home position that is the standby position for when the printer is on standby for image formation to be carried out, that is also the halt position, and that serves as a reference position in the rotating direction of a YMCK developing device 50.
Figure 8B:
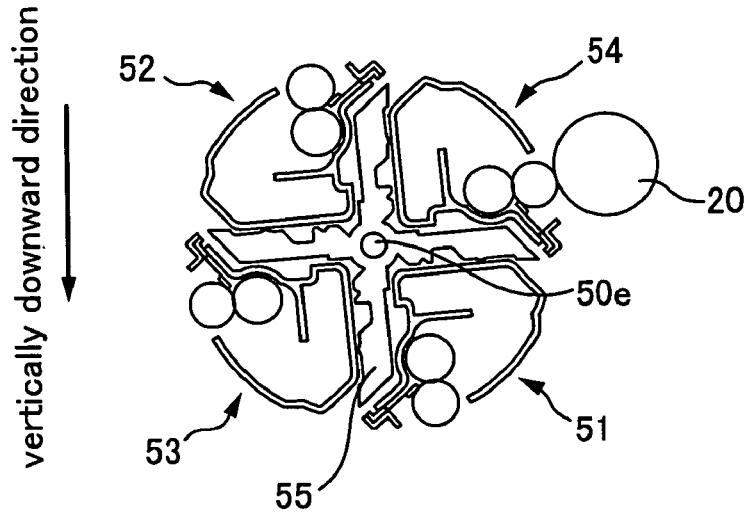
FIG. 8B shows a connector attach/detach position where a developing-unit-side connector 51*b* of a black developing unit 51, which is attached to the YMCK developing device 50, and an apparatus-side connector 34, which is provided on the apparatus side, come into opposition.
Figure 8C:
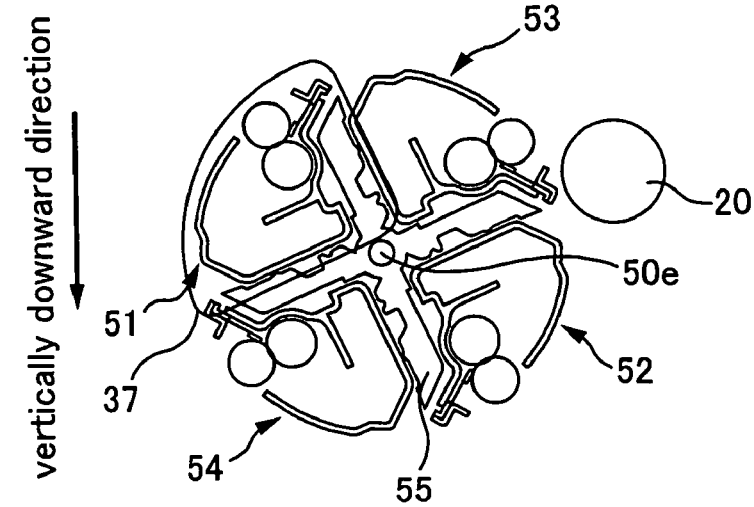
FIG. 8C shows an attach/detach position where the black developing unit 51 is attached and detached.

FIG. 8A, FIG. 8B, and FIG. 8C are diagrams showing three stop positions of the rotating YMCK developing device 50. FIG. 8A shows the home position (referred to as "HP position" below) that is the standby position for when the printer is on standby for image formation to be carried out, that is also the halt position, and that serves as the reference position in the rotating direction of the YMCK developing device 50. FIG. 8B shows the connector attach/detach position where the developing-unit-side connector 51*b* of the black developing unit 51, which is attached to the YMCK developing device 50, and the apparatus-side connector 34, which is provided on the apparatus side, come into opposition. FIG. 8C shows the attach/detach position where the black developing unit 51 is attached and detached.

In FIG. 8B and FIG. 8C, the connector attach/detach position and the developing unit attach/detach position are described with regard to the black developing unit 51, but these positions become the connector attach/detach position and the developing unit attach/detach position for each of the other developing units when the YMCK developing device 50 is rotated at 90° intervals.

First, the HP position shown in FIG. 8A will be described. An HP detector 31 (FIG. 5) for detecting the HP position is provided on the side of one end of the rotating shaft 50*e* of the YMCK developing device 50. The HP detector 31 is structured of a disk that is for generating signals and that is fixed to one end of the rotating shaft 50*e*, and an HP sensor that is made up of, for example, a photointerrupter having a light emitting section and a light receiving section. The peripheral section of the disk is arranged such that it is located between the light emitting section and the light receiving section of the HP sensor. When a slit formed in the disk moves to a detecting position of the HP sensor, the signal that is output from the HP sensor changes from "L" to "H". The device is constructed such that the HP position of the YMCK developing device 50 is detected based on this change in signal level and the number of pulses of the pulse motor, and by taking this HP position as a reference, each of the developing units can be positioned at the developing position etc.

FIG. 8B shows the connector attach/detach position of the black developing unit 51 which is achieved by rotating the pulse motor for a predetermined number of pulses from the above-mentioned HP position. At this connector attach/detach position, the developing-unit-side connector 51*b* of the black developing unit 51, which is attached to the YMCK developing device 50, and the apparatus-side connector 34, which is provided on the apparatus side, come into opposition, and it becomes possible to connect or separate these connecters.

Figure 9A:
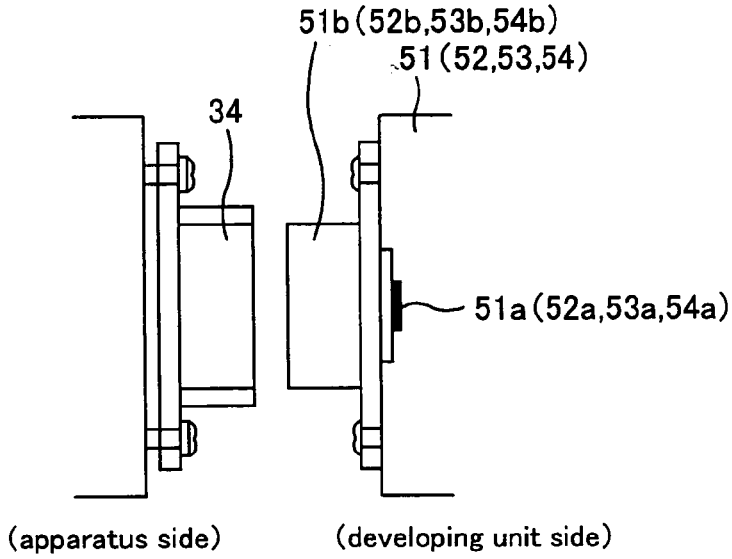
FIG. 9A is a diagram showing a separated position where the apparatus-side connector 34 and the developing-unit-side connector 51*b* of the black developing unit 51 are separated from each other.
Figure 9B:
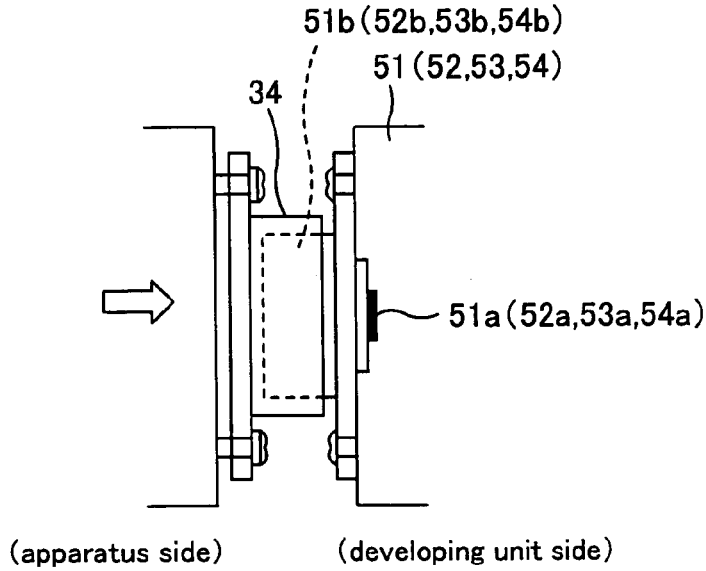
FIG. 9B is a diagram showing an abutting position where the apparatus-side connector 34 and the developing-unit-side connector 51*b* of the black developing unit 51 are in abutment against each other.

Further description is made with reference to FIG. 9A and FIG. 9B. FIG. 9A is a diagram showing a separated position where the apparatus-side connector 34 and the developing-unit-side connector 51*b* of the black developing unit 51 are separated from each other. FIG. 9B is a diagram showing an abutting position where the apparatus-side connector 34 and the developing-unit-side connector 51*b* of the black developing unit 51 are in abutment against each other.

FIG. 9A shows a state in which the apparatus-side connector 34 and the developing-unit-side connector 51*b* of the black developing unit 51 are separated from each other. The apparatus-side connector 34 is structured such that it can move toward, and move away from, the black developing unit 51. When necessary, the apparatus-side connector 34 moves in the direction toward the black developing unit 51 (the direction of the arrow shown in FIG. 9B). In this way, the apparatus-side connector 34 abuts against the developing-unit-side connector 51*b* of the black developing unit 51 as shown in FIG. 9B. Thus, the developing-unit-side memory 51*a* attached to the black developing unit 51 is electrically connected to the unit controller 102 of the control unit 100, and communication between the developing-unit-side memory 51 and the apparatus is established.

On the contrary, the apparatus-side connector 34 moves, from the state shown in FIG. 9B in which the apparatus-side connector 34 and the developing-unit-side connector 51*b* of the black developing unit 51 abut against each other, in the direction moving away from the black developing unit 51 (the direction opposite to the direction of the arrow shown in FIG. 9B). In this way, the apparatus-side connector 34 is separated from the developing-unit-side connector 51*b* of the black developing unit 51, as shown in FIG. 9A.

It should be noted that the movement of the apparatus-side connector 34 is achieved by, for example, a not-shown mechanism structured of a pulse motor, a plurality of gears connected to the pulse motor, and an eccentric cam connected to those gears. More specifically, by rotating the pulse motor for a predetermined number of pulses, the above-mentioned mechanism moves the apparatus-side connector 34 from the predetermined separated position for a distance that corresponds to the above-mentioned number of pulses to position the apparatus-side connector 34 at the predetermined abutting position. On the contrary, by rotating the pulse motor backwards for a predetermined number of pulses, the above-mentioned mechanism moves the apparatus-side connector 34 from the predetermined abutting position for a distance that corresponds to the above-mentioned number of pulses to position the apparatus-side connector 34 at the predetermined separated position.

Further, the connector attach/detach position for the black developing unit 51 is the developing position for the yellow developing unit 54 where the developing roller 510 of the yellow developing unit 54 and the photoconductor 20 oppose each other. That is, the connector attach/detach position of the YMCK developing device 50 for the black developing unit 51 is the developing position of the YMCK developing device 50 for the yellow developing unit 54. Further, the position achieved when the pulse motor rotates the YMCK developing device 50 counterclockwise by 90° becomes the connector attach/detach position for the cyan developing unit 53 and the developing position for the black developing unit 51, and by rotating the YMCK developing device 50 at 90° intervals, the connector attach/detach position and the developing position for each of the developing units are successively achieved.

One of the two frame side plates that support the YMCK developing device 50 and that form the casing of the printer 10 is provided with an attach/detach dedicated opening 37 through which one developing unit can pass. The attach/detach dedicated opening 37 is formed at a position where only a relevant developing unit (here, the black developing unit 51) can be pulled out and be detached in the direction of the rotating shaft 50*e*, as shown in FIG. 8C, when the YMCK developing device 50 is rotated and then halted at a developing unit attach/detach position which is set for each developing unit. Further, the attach/detach dedicated opening 37 is formed slightly larger than the outer shape of a developing unit. At the developing unit attach/detach position, not only is it possible to detach the developing unit, but it is also possible to insert a new developing unit through this attach/detach dedicated opening 37 in the direction of the rotating shaft 50*e* and attach the developing unit to the support frame 55. While the YMCK developing device 50 is located at positions other than the developing unit attach/detach position, the attachment/detachment of that developing unit is restricted by the frame side plates.

It should be noted that a lock mechanism, which is not shown, is provided for certainly positioning and fixing the YMCK developing device 50 at the positions described above.

===Overview of Control Unit===

Next, the configuration of the control unit 100 will be described with reference to FIG. 5. The control unit 100 has a main controller 101 and a unit controller 102.

The main controller 101 includes a CPU 111, an interface 112 for establishing communication with the computer 702, an image memory 113 for storing image data PD that have been input from the computer 702, and a main-controller-side memory 114 that is made up of, for example, an electrically rewritable EEPROM 114*a*, a RAM 114*b*, and a programmable ROM in which various programs for control are written.

The CPU 111 of the main controller 101 manages control of writing and reading of image data PD, which have been input via the interface, to and from the image memory 113, as well as manages overall control of the apparatus in synchronism with the CPU 120 of the unit controller 102 according to control signals COM that have been input from the computer 702.

Further, the EEPROM 114*a* stores apparatus-type information indicative of whether the printer 10 is to be used as a color printer or as a monochrome printer. Although detailed description will be given further below, the CPU 111 receives, from the unit controller 102 at predetermined timings, developing-unit attachment information which indicates where, among the four attach/detach sections, the developing units are currently attached. Based on the attachment information, the CPU 111 rewrites the apparatus-type information in the EEPROM 114*a*, if necessary. It should be noted that the apparatus-type information is 1-bit information that is written in the EEPROM 114*a*; value "0" indicates that the printer 10 is to be used as a color printer, and value "1" indicates that the printer 10 is to be used as a monochrome printer.

Further, a device ID, which is sent to the computer 702 when the printer 10 communicates with the computer 702 in order for the computer to recognize the device that is able to establish communication with the computer, is stored in the EEPROM 114*a*. It should be noted that in a first embodiment described further below, different from the apparatus-type information, the device ID has the same (i.e., matching) value for when the printer 10 is being used as a color printer and for when it is being used as a monochrome printer.

The unit controller 102 includes, for example, a CPU 120, a unit-controller-side memory 116 that is made up of, for example, an electrically rewritable EEPROM 116*a*, a RAM, and a programmable ROM in which various programs for control are written, and various drive control circuits for driving and controlling the units in the apparatus body (i.e., the charging unit 30, the exposing unit 40, the first transferring unit 60, the cleaning unit 75, the second transferring unit 80, the fusing unit 90, and the displaying unit 95) and the YMCK developing device 50.

The CPU 120 of the unit controller 102 is electrically connected to each of the drive control circuits and controls the drive control circuits according to control signals from the CPU 111 of the main controller 101. More specifically, the CPU 120 controls each of the units and the YMCK developing device 50 according to signals received from the main controller 101 while detecting the state of each of the units and the YMCK developing device 50 by receiving signals from sensors etc. provided in each unit.

The CPU 120 also controls each of the drive control circuits according to the apparatus-type information described above. More specifically, if the value of the apparatus-type information is "0", then the CPU 120 controls the units and the YMCK developing device 50 of the printer 10 to function as a color printer, and if the value of the apparatus-type information is "1", then the CPU 120 controls the units and the YMCK developing device 50 of the printer 10 to function as a monochrome printer.

The EEPROM 116*a* stores the developing-unit attachment information which indicates where, among the four attach/detach sections, the developing units are currently attached. Although detailed description will be given further below, after detachment and attachment of a developing unit, the CPU 120 determines whether the developing unit has been attached to the corresponding attach/detach section, and according to the determination results, it rewrites the attachment information in the EEPROM 116*a*, if necessary. It should be noted that the attachment information is written in the EEPROM 116*a* as 4-bit information, i.e., 1-bit information for each attach/detach section; value "0" indicates that no developing unit is attached, and value "1" indicates that a developing unit is attached.

Further, the CPU 120 of the unit controller 102 is connected, via a serial interface (I/F) 121, to a non-volatile storage element 122 (which is referred to below as "apparatus-side memory") which is, for example, a serial EEPROM. Data necessary for controlling the apparatus are stored in the apparatus-side memory 122. The CPU 120 is not only connected to the apparatus-side memory 122, but is also connected, via the serial interface 121, to the developing-unit-side memories 51*a*, 52*a*, 53*a*, and 54*a* which are provided on the respective developing units 51, 52, 53, and 54. Therefore, data can be exchanged between the apparatus-side memory 122 and the developing-unit-side memories 51*a*, 52*a*, 53*a*, and 54*a*, and also, it is possible to input chip-select signals CS to the developing-unit-side memories 51*a*, 52*a*, 53*a*, and 54*a* via the input/output port 123. The CPU 120 is also connected to the HP detector 31 via the input/output port 123.

<<<First Embodiment of Operations of Image Forming System>>>

===Operations Carried Out by the Image Forming System===

Next, a first embodiment of operations carried out by the image forming system 700 is described below.

As described above, when the developing units are attached to each of the attach/detach sections 50*a*, 50*b*, 50*c*, and 50*d*, the printer 10 according to the present embodiment can be used as a color printer for forming color images by developing the latent image borne on the photoconductor 20 using the toner T contained in each of the developing units, whereas when a developing unit is attached to only one of the attach/detach sections 50*a*, 50*b*, 50*c*, or 50*d*, then the printer 10 can be used as a monochrome printer for forming monochrome images by developing the latent image borne on the photoconductor 20 using the toner T contained in that developing unit.

Below, operations of the image forming system 700 for when the printer 10 is switched from a monochrome printer to a color printer, and operations of the image forming system 700 for when the printer 10 is switched from a color printer to a monochrome printer are described. The various operations of the printer 10 described below are mainly achieved by the main controller 101 or the unit controller 102 in the printer 10. Particularly, in the present first embodiment, the operations are achieved by the CPU executing programs that are stored in the programmable ROM. The programs are made of codes for achieving the various operations described below.

<Switching from Monochrome Printer to Color Printer>

Figure 10:
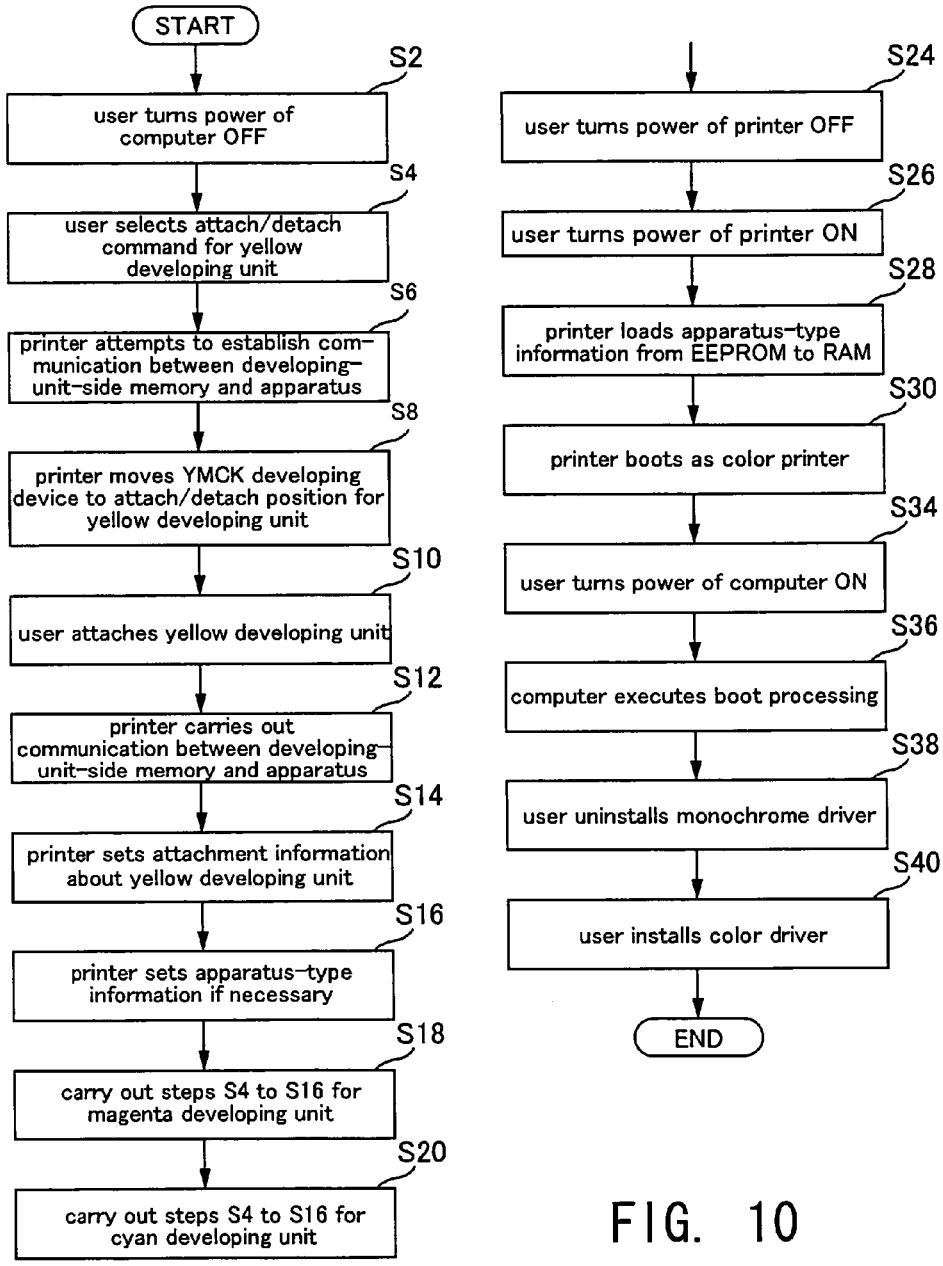
FIG. 10 is a flowchart for illustrating operations of the image forming system 700 according to a first embodiment for when the printer 10 is switched from a monochrome printer to a color printer.

First, operations of the image forming system 700 for when the printer 10 is switched from a monochrome printer to a color printer will be described with reference to FIG. 10. FIG. 10 is a flowchart for illustrating operations of the image forming system 700 for when the printer 10 is switched from a monochrome printer to a color printer.

This flowchart starts from a state in which the power of the printer 10 and the computer 702, which structure the image forming system 700, has already been turned ON and the system is on standby for image formation to be carried out. The standby position of the YMCK developing device 50 at this time is the HP position shown in FIG. 8A.

It should be noted that the printer 10, before switching is performed, is used as a monochrome printer, and therefore, the developing unit is attached to only one of the four attach/detach sections, as shown in FIG. 4. That is, the black developing unit 51 is attached to the attach/detach section 50*a*, but no developing unit is attached to the other attach/detach sections 50*b*, 50*c*, and 50*d*. Further, the monochrome driver described above is installed to the computer 702 as the printer driver 796.

First, the user turns the power of the computer 702 OFF to disconnect the electrical connection between the computer 702 and the printer 10 (step S2).

Then, the user operates a menu button provided, for example, on the displaying unit 95, and by selecting the attach/detach command for a certain developing unit, the user gives an instruction to the printer 10 that he/she wishes to attach or detach a developing unit. At the time of giving this instruction, the user designates the developing unit that is targeted for attachment/detachment.

In the present embodiment, the user first selects the attach/detach command for the yellow developing unit 54 (step S4). The unit controller 102 comprehends this command with the displaying unit drive control circuit. More specifically, the unit controller 102 determines which, among the black developing unit 51, the magenta developing unit 52, the cyan developing unit 53, and the yellow developing unit 54, is the developing unit targeted for attachment/detachment. In the present embodiment, the developing unit targeted for attachment/detachment is the yellow developing unit 54. Therefore, the unit controller 102 rotates the pulse motor for a predetermined number of pulses to rotate the YMCK developing device 50 and to move the position of the YMCK developing device 50 from the HP position to the connector attach/detach position for the yellow developing unit 54.

Then, the unit controller 102 halts the YMCK developing device 50 at the connector attach/detach position. In this halted state, the unit controller 102 moves the apparatus-side connector 34 and attempts to establish communication with the developing-unit-side memory of the developing unit (step S6). In the present embodiment, the yellow developing unit 54 has not been attached yet, and therefore, communication cannot be established.

Next, the unit controller 102 rotates the pulse motor for a predetermined number of pulses to rotate the YMCK developing device 50 and to move the position of the YMCK developing device 50 from the connector attach/detach position for the yellow developing unit 54 to the attach/detach position for the yellow developing unit 54 (step S8).

In this state, the unit controller 102 notifies the user that the yellow developing unit 54 can be attached to (or be detached from) the attach/detach section by displaying a message on a displaying section etc. provided in the displaying unit 95.

Confirming the display, the user opens the outer cover of the printer 10 and attaches the yellow developing unit 54 to the attach/detach section 50*d* of the YMCK developing device 50 through the attach/detach dedicated opening 37 (step S10). After the user attaches the yellow developing unit 54 and closes the outer cover of the printer 10, the unit controller 102 detects this and moves the position of the YMCK developing device 50 from the attach/detach position for the yellow developing unit 54 to the connector attach/detach position for the yellow developing unit 54.

Then, the unit controller 102 halts the YMCK developing device 50 at the connector attach/detach position. In this halted state, the unit controller 102 moves the apparatus-side connector 34 and makes the apparatus-side connector 34 and the developing-unit-side connector 54*b* of the yellow developing unit 54 abut against each other. In this state, the developing-unit-side memory 54*a* of the yellow developing unit 54 is electrically connected to the unit controller 102 of the control unit 100, and communication is established between the developing-unit-side memory 54*a* and the apparatus body (step S12). The unit controller 102 also determines whether the communication has succeeded. If the communication has succeeded, then the unit controller 102 assumes that the yellow developing unit 54 has been attached, and sets the attachment information for the yellow developing unit 54 in the EEPROM 116*a* to "1". On the other hand, if it is determined that the communication has failed, then the unit controller 102 assumes that the yellow developing unit 54 has not been attached, and sets the attachment information for the yellow developing unit 54 in the EEPROM 116*a* to "0" (step S14). In the present embodiment, it is assumed that the communication has succeeded, and the attachment information for the yellow developing unit 54 in the EEPROM 116*a* is changed from "0" to "1".

After finishing the above-described processes relating to the attachment information, the unit controller 102 sends the attachment information for all four developing units to the main controller 101. The main controller 101 receives the attachment information and sets the above-described apparatus-type information based on the attachment information (step S16).

An algorithm according to which the main controller 101 sets the apparatus-type information based on the attachment information of the four developing units is described below. If the value of only one of the four pieces of attachment information is "1", which indicates that a developing unit is attached, then the main controller 101 sets the value of the apparatus-type information in the EEPROM 114*a* to "1", which indicates that the printer is to be used as a monochrome printer. On the other hand, if the value of two or more pieces of attachment information is "1", then the main controller 101 sets the value of the apparatus-type information to "0", which indicates that the printer is to be used as a color printer. In both cases, however, if the value of the attachment information for the black developing unit 51 is "0", then the main controller 101 does not execute the operation of setting the apparatus-type information. (That is, if the black developing unit 51, which should be attached regardless of whether the printer is to be used as a color printer or as a monochrome printer, is not attached, the apparatus-type information is not rewritten and the value of the apparatus-type information is kept the same.) The relationship between the values of the attachment information and the operations of setting the apparatus-type information is as shown in FIG. 11.

In the present embodiment, the values of the attachment information of the developing units are: "1" for the black developing unit, "0" for the magenta developing unit, "0" for the cyan developing unit, and "1" for the yellow developing unit (i.e., the values match case "J" of FIG. 11). Therefore, the main controller 101 rewrites the value of the apparatus-type information from "1", which indicates "monochrome printer", to "0", which indicates "color printer".

Next, the processes from step S4 through step S16 described above are carried out for the cyan developing unit 53 and the magenta developing unit 52 (step S18 and step S20). As a result of carrying out these processes, the values of the attachment information for the cyan developing unit 53 and the magenta developing unit 52 are rewritten from "0" to "1". It should be noted that in step S18, the values of the attachment information of the developing units received by the main controller 101 are: "1" for the black developing unit, "0" for the magenta developing unit, "1" for the cyan developing unit, and "1" for the yellow developing unit (i.e., the values match case "L" of FIG. 11). Therefore, the value of the apparatus-type information after step S18 stays at "0". Similarly, in step S20, the values of the attachment information of the developing units received by the main controller 101 are "1" for the black developing unit, "1" for the magenta developing unit, "1" for the cyan developing unit, and "1" for the yellow developing unit (i.e., the values match case "Q" of FIG. 11). Therefore, the value of the apparatus-type information after step S20 stays at "0".

Next, the user temporarily halts power supply to the printer by turning the power of the printer 10 OFF, for example (step S24). The user then supplies power to the printer again by turning the power of the printer 100N, for example (step S26).

When power is supplied to the printer 10, the main controller 101 detects this and loads the apparatus-type information from the EEPROM 114*a* to the RAM 114*b* (step S28). Here, the value "0", which indicates "color printer", is loaded to the RAM 114*b*. The CPU 120 of the unit controller 102 then controls the drive control circuits based on the apparatus-type information that has been loaded to the RAM 114*b*. More specifically, as a result of referencing the apparatus-type information in the RAM 114*b*, the printer 10 boots as a color printer, and the units and the YMCK developing device 50 of the printer 10 are controlled to function as a color printer (step S30). It should be noted that the printer 10 according to the present embodiment does not update the device ID stored in the EEPROM 114*a* when switching of the printer is performed.

Next, the user turns the power of the computer 702 ON in order to electrically connect the computer 702 to the printer 10 (step S34). Due to this user operation, the computer 702 carries out boot processing (step S36), and starts up.

After the computer 702 has started up, the user uninstalls the monochrome driver installed to the computer 702 (step S38), and then installs the color driver that has been prepared (step S40). In this way, the user will be able to instruct image formation using the color driver.

<Switching from Color Printer to Monochrome Printer>

Figure 12:
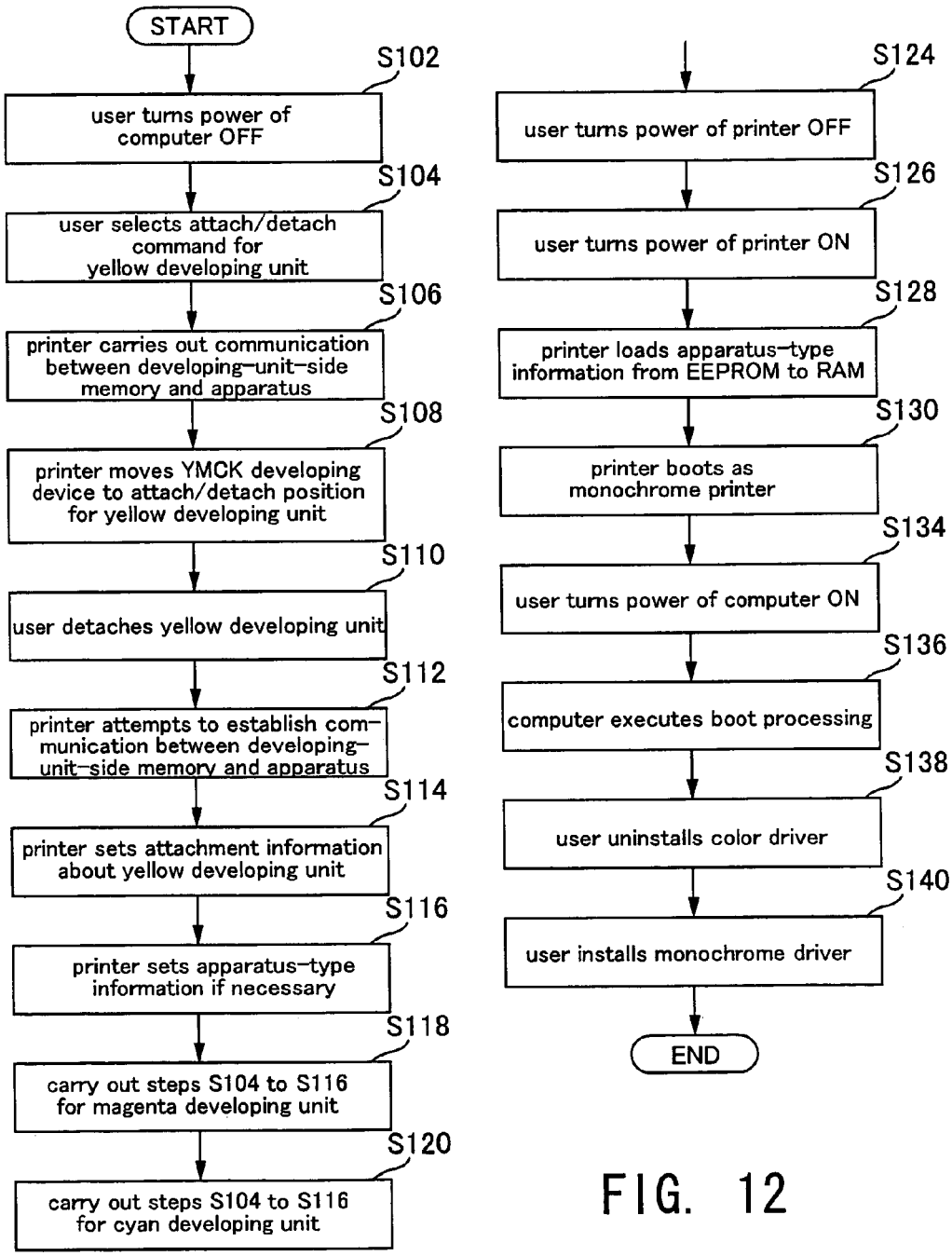
FIG. 12 is a flowchart for illustrating operations of the image forming system 700 according to the first embodiment for when the printer 10 is switched from a color printer to a monochrome printer.

Next, operations of the image forming system 700 for when the printer 10 is switched from a color printer to a monochrome printer will be described with reference to FIG. 12. FIG. 12 is a flowchart for illustrating operations of the image forming system 700 for when the printer 10 is switched from a color printer to a monochrome printer.

This flowchart starts from a state in which the power of the printer 10 and the computer 702, which structure the image forming system 700, has already been turned ON and the printer 10 is on standby for image formation to be carried out. The standby position of the YMCK developing device 50 at this time is the HP position shown in FIG. 8A.

It should be noted that the printer 10, before switching is performed, is used as a color printer, and therefore, the developing units are attached to all four attach/detach sections, as shown in FIG. 3. That is, the black developing unit 51 is attached to the attach/detach section 50*a*, the magenta developing unit 52 is attached to the attach/detach section 50*b*, the cyan developing unit 53 is attached to the attach/detach section 50*c*, and the yellow developing unit 54 is attached to the attach/detach section 50*d*. Further, the color driver described above is installed to the computer 702 as the printer driver 796.

First, the user turns the power of the computer 702 OFF to disconnect the electrical connection between the computer 702 and the printer 10 (step S102.)

Then, the user operates a menu button provided, for example, on the displaying unit 95, and by selecting the attach/detach command for a certain developing unit, the user gives an instruction to the printer 10 that he/she wishes to attach or detach a developing unit. At the time of giving this instruction, the user designates the developing unit that is targeted for attachment/detachment.

In the present embodiment, the user first selects the attach/detach command for the yellow developing unit 54 (step S104). The unit controller 102 comprehends this command with the displaying unit drive control circuit. More specifically, the unit controller 102 determines which, among the black developing unit 51, the magenta developing unit 52, the cyan developing unit 53, and the yellow developing unit 54, is the developing unit targeted for attachment/detachment. In the present embodiment, the developing unit targeted for attachment/detachment is the yellow developing unit 54. Therefore, the unit controller 102 rotates the pulse motor for a predetermined number of pulses to rotate the YMCK developing device 50 and to move the position of the YMCK developing device 50 from the HP position to the connector attach/detach position for the yellow developing unit 54.

Then, the unit controller 102 halts the YMCK developing device 50 at the connector attach/detach position. In this halted state, the unit controller 102 moves the apparatus-side connector 34 and makes the apparatus-side connector 34 and the developing-unit-side connector 54*b* of the yellow developing unit 54 abut against each other. In this state, the developing-unit-side memory 54*a* of the yellow developing unit 54 is electrically connected to the unit controller 102 of the control unit 100, and communication is established between the developing-unit-side memory 54*a* and the apparatus body (step S106).

After finishing the communication and separating the apparatus-side connector 34 from the developing-unit-side connector 54*b*, the unit controller 102 rotates the pulse motor for a predetermined number of pulses to rotate the YMCK developing device 50 and to move the position of the YMCK developing device 50 from the connector attach/detach position for the yellow developing unit 54 to the attach/detach position for the yellow developing unit 54 (step S108).

In this state, the unit controller 102 notifies the user that the yellow developing unit 54 can be detached from (or be attached to) the attach/detach section by displaying a message on the displaying section etc. provided in the displaying unit 95.

Confirming the display, the user opens the outer cover of the printer 10 and detaches the yellow developing unit 54, which is arranged inside the attach/detach dedicated opening 37, from the YMCK developing device 50 through the attach/detach dedicated opening 37 (step S110). After the user detaches the yellow developing unit 54 and closes the outer cover of the printer 10, the unit controller 102 detects this and moves the position of the YMCK developing device 50 from the attach/detach position for the yellow developing unit 54 to the connector attach/detach position for the yellow developing unit 54.

Then, the unit controller 102 halts the YMCK developing device 50 at the connector attach/detach position. In this halted state, the unit controller 102 moves the apparatus-side connector 34 and attempts to establish communication with the developing-unit-side memory of the developing unit (step S112). If communication succeeds, then the unit controller 102 assumes that the yellow developing unit 54 is attached, and sets the attachment information for the yellow developing unit 54 in the EEPROM 116*a* to "1". On the other hand, if communication fails, then the unit controller 102 assumes that the yellow developing unit 54 is not attached, and sets the attachment information for the yellow developing unit 54 in the EEPROM 116*a* to "0" (step S114). In the present embodiment, since the yellow developing unit 54 has been detached at step S110, it is assumed that the communication has failed, and the attachment information for the yellow developing unit 54 in the EEPROM 116*a* is changed from "1" to "0".

After finishing the above-described processes relating to the attachment information, the unit controller 102 sends the attachment information for all four developing units to the main controller 101. The main controller 101 receives the attachment information and sets the above-described apparatus-type information based on the attachment information (step S116).

In the present embodiment, the value of the attachment information only for the yellow developing unit 54 is "0" (and this situation matches case "P" of FIG. 11). Therefore, the main controller 101 sets the value of the apparatus-type information to "0", which indicates "color printer", in accordance with the algorithm described above. In this example, however, the value of the apparatus-type information is not changed because before detachment of the yellow developing unit 54, all four developing units were attached and the value of the apparatus-type information was "0" (the situation for case "Q" of FIG. 11).

Next, the processes from step S104 through step S116 described above are carried out for the cyan developing unit 53 and the magenta developing unit 52 (step S118 and step S120). As a result of carrying out these processes, the values of the attachment information for the cyan developing unit 53 and the magenta developing unit 52 are rewritten from "1" to "0". The values of the attachment information of the developing units received by the main controller 101 become: "1" for the black developing unit, "0" for the magenta developing unit, "0" for the cyan developing unit, and "0" for the yellow developing unit (i.e., the values match case "I" of FIG. 11). Therefore, the main controller 101 changes the value of the apparatus-type information from "0", which indicates "color printer", to "1", which indicates "monochrome printer", in accordance with the algorithm described above.

Next, the user temporarily halts power supply to the printer by turning the power of the printer 10 OFF, for example (step S124). The user then supplies power to the printer again by turning the power of the printer 10 ON, for example (step S126).

When power is supplied to the printer 10, the main controller 101 detects this and loads the apparatus-type information from the EEPROM 114*a* to the RAM 114*b* (step S128). Here, the value "1", which indicates "monochrome printer", is loaded to the RAM 114*b*. The CPU 120 of the unit controller 102 then controls the drive control circuits based on the apparatus-type information that has been loaded to the RAM 114*b*. More specifically, as a result of referencing the apparatus-type information in the RAM 114*b*, the printer 10 boots as a monochrome printer, and the units and the YMCK developing device 50 of the printer 10 are controlled to function as a monochrome printer (step S130). It should be noted that the printer 10 according to the present embodiment does not update the device ID stored in the EEPROM 114*a* when switching of the printer is performed.

Next, the user turns the power of the computer 702 ON in order to electrically connect the computer 702 to the printer 10 (step S134). Due to this user operation, the computer 702 carries out boot processing (step S136), and starts up.

After the computer 702 has started up, the user uninstalls the color driver installed to the computer 702 (step S138), and then installs the monochrome driver that has been prepared (step S140). In this way, the user will be able to instruct image formation using the monochrome driver.

It should be noted that in the foregoing embodiment, the power of the computer 702 was turned OFF in order to disconnect the electrical connection between the computer 702 and the printer 10 (step S2 and step S102). This, however, is not a limitation. For example, it is possible to disconnect the cable connecting the computer 702 and the printer 10. Furthermore, in the foregoing embodiment, the power of the computer 702 was turned ON in order to re-establish the electrical communication between the computer 702 and the printer 10 (step S34 and step S134). This, however, is not a limitation. For example, it is possible to connect the computer 702 and the printer 10 with a cable.

===Operations of the Image Forming System for when the User Performs Switching of the Printer without Turning the Power of the Computer OFF===

As described above, the device ID of the printer 10 for when the printer 10 is being used as a color printer matches the device ID of the printer 10 for when the printer 10 is being used as a single-color printer. In this way, it is possible to achieve a printer 10 etc. that is convenient for users.

More specifically, as described in the section of the "Description of the Related Art", it is preferable to use a single-color driver that suits the single-color printer as the printer driver 796 when the printer 10 is being used as a single-color printer, and to use a color driver that suits the color printer as the printer driver 796 when the printer 10 is being used as a color printer. Therefore, when the printer 10 is switched from the single-color printer to the color printer, or from the color printer to the single-color printer, it is recommended that the procedures shown in the flowchart of FIG. 10 or FIG. 12 are carried out. That is, it is recommended that the user turns the power of the computer 702 OFF, performs switching, and then turns the power of the computer 702 ON again to install the printer driver 796 that suits the printer 10 that has been switched.

However, there are cases in which the user inadvertently performs switching of the printer 10 without turning the power of the computer 702 OFF (i.e., while the power of the computer 702 is still ON).

Below, operations of the image forming system 700 for when the user performs switching of the printer 10 without turning the power of the computer 702 OFF are described by comparing a "present example" according to the present embodiment and a "comparative example". It should be noted that the "comparative example" is an example in which the device ID of the printer 10 for when the printer 10 is being used as a color printer is different from the device ID of the printer 10 for when the printer 10 is being used as a single-color printer, and the "present example" is an example in which the device ID of the printer 10 for when the printer 10 is being used as a color printer matches the device ID of the printer 10 for when the printer 10 is being used as a single-color printer. Further, only a case of switching of the printer 10 from the single-color printer to the color printer will be described below as an example, and a case of switching of the printer 10 from the color printer to the single-color printer is omitted.

Figure 13:
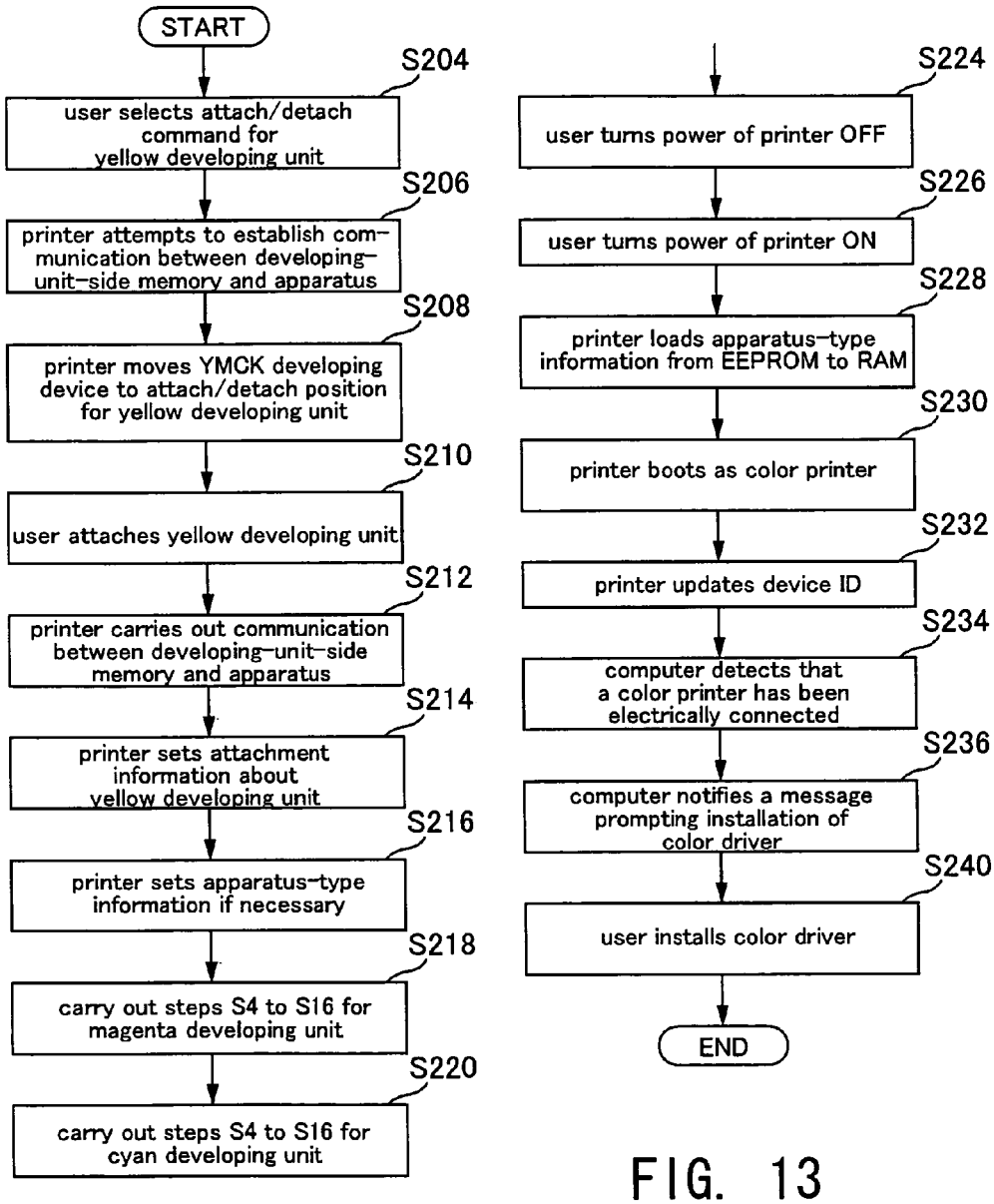
FIG. 13 is a flowchart of a comparative example for describing the operations of the image forming system 700 when the printer 10 is switched without turning the power of the computer 702 OFF.

First, the comparative example is described with reference to FIG. 13. FIG. 13 is a flowchart of the comparative example for describing the operations of the image forming system 700 when the printer 10 is switched without turning the power of the computer 702 OFF.

This flowchart starts from a state in which the power of the printer 10 and the computer 702, which structure the image forming system 700, has already been turned ON and the system is on standby for image formation to be carried out. It should be noted that the printer 10, before switching is performed, is used as a monochrome printer, and therefore, the developing unit is attached to only one of the four attach/detach sections, as shown in FIG. 4. Further, the monochrome driver described above is installed to the computer 702 as the printer driver 796.

In the flowchart shown in FIG. 10, the user turned the power of the computer 702 OFF to disconnect the electrical connection between the computer 702 and the printer 10 (step S2). In the description below, however, the user performs switching of the printer 10 without turning the power of the computer 702 OFF.

Therefore, in the description below, the user performs the operations as those described in step S4 through step S26 with the power of the computer 7020N (step S204 through step S226).

When the power of the printer 10 is supplied again (step S226), the main controller 101 detects this and loads the apparatus-type information from the EEPROM 114*a* to the RAM 114*b* (step S228). Here, the value "0", which indicates "color printer", is loaded to the RAM 114*b*. The CPU 120 of the unit controller 102 then controls the drive control circuits based on the apparatus-type information that has been loaded to the RAM 114*b*. More specifically, as a result of referencing the apparatus-type information in the RAM 114*b*, the printer 10 boots as a color printer, and the units and the YMCK developing device 50 of the printer 10 are controlled to function as a color printer (step S230).

Further, in this comparative example, the device ID of the printer 10 for when the printer 10 is being used as a color printer is different from the device ID of the printer 10 for when the printer 10 is being used as a single-color printer as described above. That is, different from the example shown in the flowchart of FIG. 9, following step S228, the printer 10 references the apparatus-type information that has been loaded from the EEPROM 114*a* to the RAM 114*b*, and updates the device ID stored in the EEPROM 114*a* (step S232). Since the apparatus-type information in the RAM 114*b* has the value "0", which indicates "color printer", the device ID is updated to the device ID indicative of a color printer (which is referred to below as "color-printer device ID"). That is, the device ID is updated when the printer 10 is switched from a monochrome printer to a color printer.

As described above, in this comparative example, the user performs switching of the printer 10 without turning the power of the computer 702 OFF. Therefore, the updating of the device ID (step S232) triggers a so-called plug-and-play function.

More specifically, since the device ID has been updated to the color-printer device ID at step S232, the computer 702 recognizes that a new device (i.e., the color printer) has been electrically connected by receiving the color-printer device ID from the printer 10 (step S234). The computer 702 then carries out settings relating to the color printer (e.g., allocation of hardware resources such as I/O ports), and also makes a notification of a message prompting the user to install the color driver (step S236). In response to this notification, the user inserts a CD-ROM etc. into the computer 702 to install the color driver (step S240), and then the user can instruct image formation using the color driver.

Now, consideration is made on the operations of the image forming system in this comparative example from the viewpoint of user convenience. As described above, it is preferable to provide the user with some variety of choices in the timing for installing the printer driver 796 (i.e., when to install the printer driver 796), in consideration, for example, of the necessity of preparing the printer driver 796 to be installed. In the procedure shown in the flowchart of FIG. 9, this objective is achieved by adjusting the timing at which the user turns the power of the computer 702 ON.

In this comparative example, however, the user performs switching of the printer 10 without turning the power of the computer 702 OFF. Therefore, following switching of the printer 10, it automatically becomes necessary to carry out a task of installing the printer driver 796. Therefore, it is not possible to provide the user with a variety of choices in the timing for installing the driver in consideration, for example, of the necessity of preparing the printer driver 796.

Figure 14:
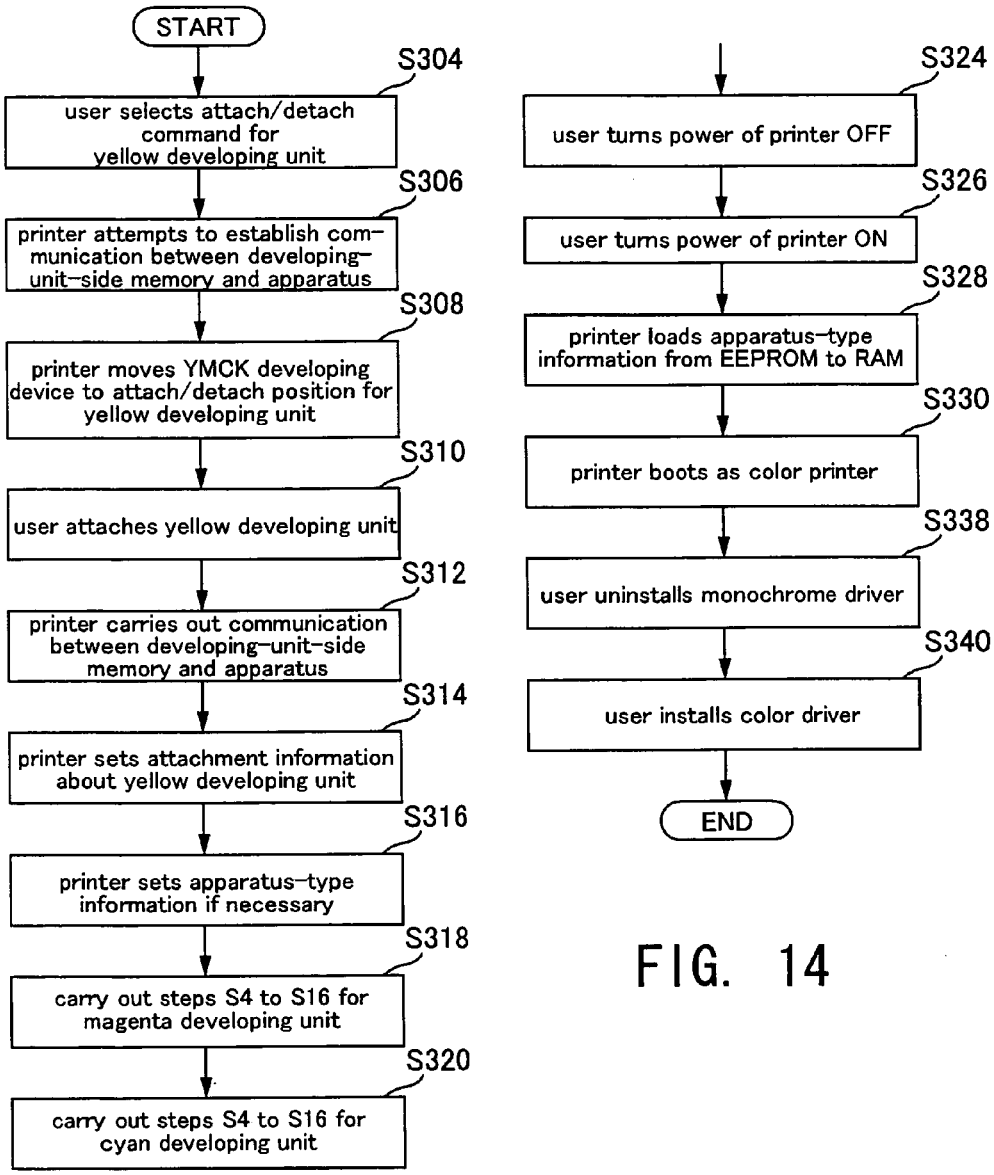
FIG. 14 is a flowchart of a present example according to the first embodiment for describing the operations of the image forming system 700 when the printer 10 is switched without the power of the computer 702 being turned OFF.

Next, the present example is described with reference to FIG. 14. FIG. 14 is a flowchart of the present example for describing the operations of the image forming system 700 when the printer 10 is switched without the power of the computer 702 being turned OFF.

This flowchart starts from a state in which the power of the printer 10 and the computer 702, which structure the image forming system 700, has already been turned ON and the system is on standby for image formation to be carried out. It should be noted that the printer 10, before switching is performed, is used as a monochrome printer, and therefore, the developing unit is attached to only one of the four attach/detach sections, as shown in FIG. 4. Further, the monochrome driver described above is installed to the computer 702 as the printer driver 796.

In the description below, the user performs switching of the printer 10 without turning the power of the computer 702 OFF, as in the comparative example. Therefore, in the description below, the user performs the operations as those described in step S4 through step S26 with the power of the computer 7020N (step S304 through step S326).

When the power of the printer 10 is supplied again (step S326), the main controller 101 detects this and loads the apparatus-type information from the EEPROM 114*a* to the RAM 114*b* (step S328). Here, the value "0", which indicates "color printer", is loaded to the RAM 114*b*. The CPU 120 of the unit controller 102 then controls the drive control circuits based on the apparatus-type information that has been loaded to the RAM 114*b*. More specifically, as a result of referencing the apparatus-type information in the RAM 114*b*, the printer 10 boots as a color printer, and the units and the YMCK developing device 50 of the printer 10 are controlled to function as a color printer (step S330).

In the present example, the device ID of the printer 10 for when the printer 10 is being used as a color printer matches the device ID of the printer 10 for when the printer 10 is being used as a single-color printer. Therefore, different from the comparative example, the plug-and-play function does not activate after switching of the printer 10.

If the user wishes to install the color driver at this timing, then the user may uninstall the monochrome driver installed to the computer 702 (step S338), and then install the color driver that has been prepared (step S340). In this way, the user will be able to instruct image formation using the color driver.

Now, consideration is made on the operations of the image forming system also in the present example from the viewpoint of user convenience. As described above, in the comparative example, since the user performed switching of the printer 10 without turning the power of the computer 702 OFF, it automatically became necessary to carry out a task of installing the printer driver 796 following switching of the printer 10. Therefore, it was not possible to provide the user with a variety of choices in the timing for installing the driver in consideration, for example, of the necessity of preparing the printer driver 796.

On the contrary, in the present example, it does not automatically become necessary to carry out a task of installing the printer driver 796 following switching of the printer 10, even when the user performs switching of the printer 10 without turning the power of the computer 702 OFF. Therefore, it becomes possible to provide the user with a variety of choices in the timing for installing the driver in consideration, for example, of the necessity of preparing the printer driver 796, and thus, achieve a printer etc. that is convenient for users.

The above described only the advantages of an example in which (1) the computer 702 has only the single-color driver among a color driver that corresponds to the printer 10 when the apparatus is used as the color printer and a single-color driver that corresponds to the printer 10 when the apparatus is used as the single-color printer; and (2) the device ID is not updated at the time when the printer 10 is switched from the single-color printer to the color printer. However, it should be noted that the same advantages are achieved for cases where the printer 10 only has the color driver and the device ID is not updated when the printer 10 is switched from the color printer to the single-color printer.

===Other Considerations===

In the foregoing embodiment, the single-color printer was a monochrome printer that forms monochrome images, when a developing unit is attached to only one of the plurality of attach/detach sections, by developing the latent image borne on the photoconductor 20 with the toner T contained in the developing unit, but this is not a limitation. More specifically, in the foregoing embodiment, the developing unit attached to the one attach/detach section was a black developing unit 51, and monochrome images were formed by developing the latent image with the toner T contained in the black developing unit 51, but this is not a limitation. The developing unit attached to that one attach/detach section may be a developing unit having toner of another color, and images in that color may be formed by developing the latent image with the toner contained in that developing unit.

Further, in the foregoing embodiment, the device ID was not updated at the time when the printer was switched from a single-color printer to a color printer or from a color printer to a single-color printer. This, however, is not a limitation. For example, the device ID may be updated at the time when the printer was switched from a single-color printer to a color printer or from a color printer to a single-color printer, with the device ID prior to updating being the same as the device ID after updating.

Further, in the foregoing embodiment, power supply to the printer was stopped and started again by turning the power of the printer ON and OFF. This, however, is not a limitation. For example, this can be achieved by resetting the printer.

Further, in the foregoing embodiment, a task of uninstalling the printer driver 796 was performed in step S38, step S138, and step S338. This uninstalling task, however, does not have to be performed.

<<<Second Embodiment of Operations of Image Forming System and Details on Setting Information>>>

A second embodiment of operations carried out by the image forming system 700 and details on the setting information will be described below. The setting information employed in the second embodiment will be described first.

===Setting Information===

The setting information that is recorded on the color driver and the monochrome driver and that can be changed is described below. The setting information is displayed on the user interface window described above. The user makes changes to the setting information through the user interface window using the input device 708. Details on the setting information are described below.

Figure 15:
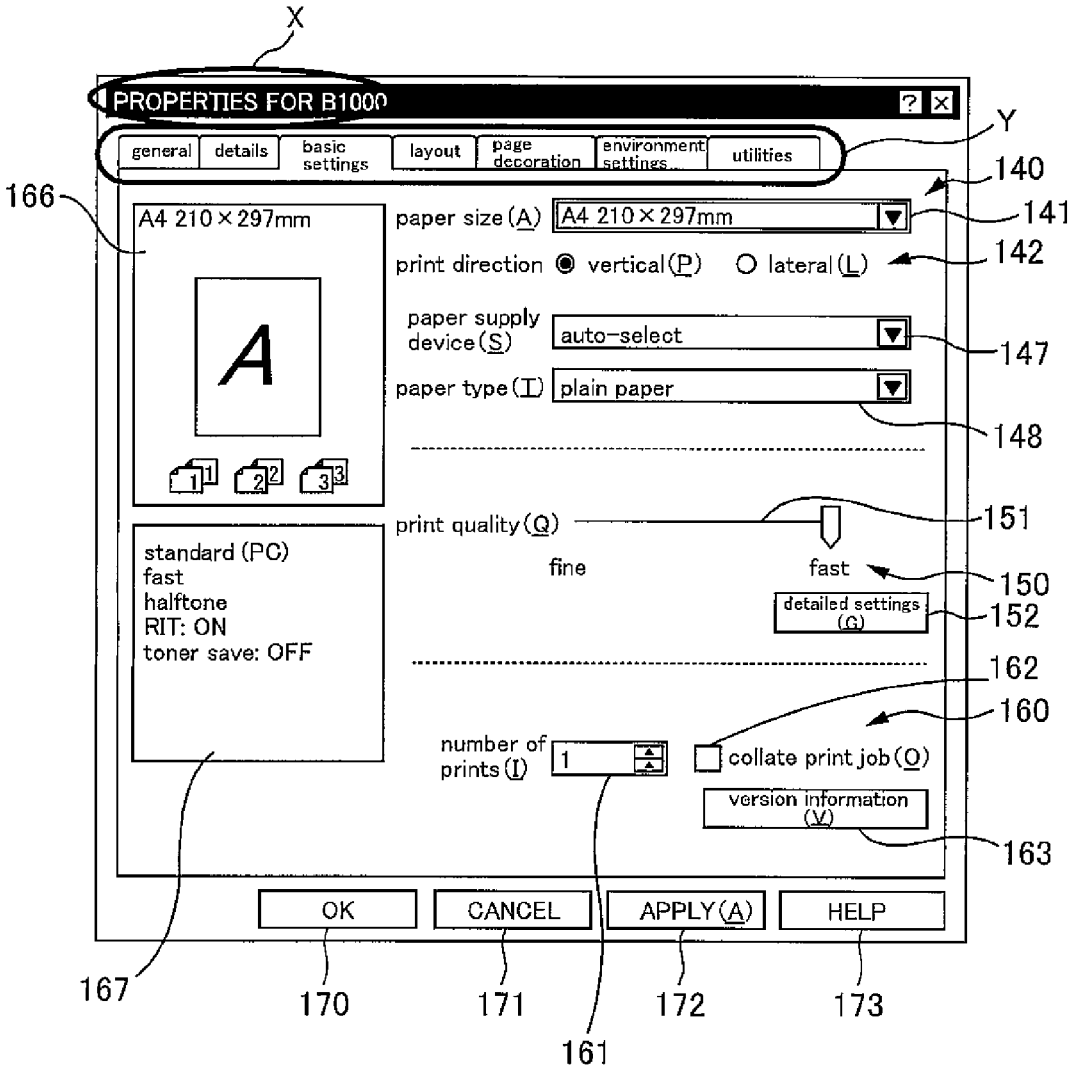
FIG. 15 is a diagram showing an example of a user interface window displayed on the display device 704 by a monochrome driver according to a second embodiment.
Figure 16:
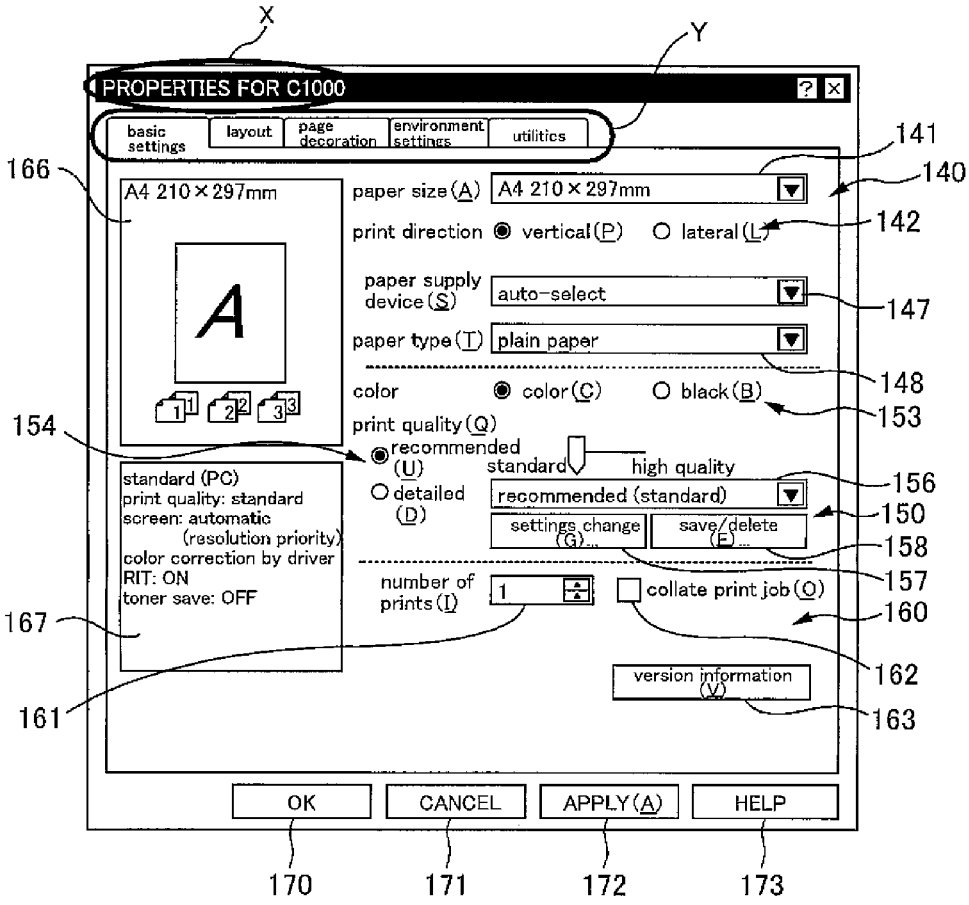
FIG. 16 is a diagram showing an example of a user interface window displayed on the display device 704 by a color driver according to the second embodiment.

FIG. 15 is a diagram showing an example of a user interface window displayed on the display device 704 by a monochrome driver. FIG. 16 is a diagram showing an example of a user interface window displayed on the display device 704 by a color driver.

It should be noted that the "setting information" according to the present embodiment is, for example, the "paper size" and the "paper supply device" shown in FIG. 15 and FIG. 16. The user can change the setting information to a specific setting value (for example, "A4 210×297 mm" for "paper size", and "auto-select" for "paper supply device") using the input device 708.

FIG. 15 and FIG. 16 show a properties dialog box, which is an example of the user interface window. The properties dialog box is for referencing, changing, and setting the various kinds of setting information. As shown in section "Y" in FIG. 15 and FIG. 16, the properties dialog box includes, for example, a basic settings dialog box, a layout dialog box, a page decoration dialog box, and an environment settings dialog box, such that they can be selected. In the present embodiment, it is assumed that the basic settings dialog box has been selected.

Further, as shown in section "X" in FIG. 15 and FIG. 16, the properties dialog box also shows a device name indicating that the printer 10 is being used as a monochrome printer (for example, "B1000") and a device name indicating that the printer 10 is being used as a color printer (for example, "C1000"), in order to clearly show whether the targeted printer 10 is being used as a color printer or a monochrome printer.

As shown in FIG. 15 and FIG. 16, the basic settings dialog box is provided with five regions, that is, a region 140 showing information about the print medium on which images are to be formed etc., a region 150 showing information about images, a region 160 showing the number of prints etc., a region 166 showing as an image the direction in which printing is performed on the medium (i.e., the print direction of the print medium), and a region 167 showing the contents that have been set in a list. Outside these regions are provided an OK button 170 for confirming the items that have been set, a cancel button 171 for quitting the settings, an apply button 172 for confirming the settings with the dialog box still being displayed, and a help button 173 for causing an explanation of a displayed item to be displayed. The information displayed on the display device 704 contains various input-operating sections to which various instructions etc. can be input by operating the input device 708, such as the mouse 708B, of the computer 702. The input-operating sections are user interfaces such as radio buttons, checkboxes, slide bars, selection boxes, and buttons. By operating the input-operating sections, it is possible to enter commands for changing settings, commands for executing operations, and so forth.

The region 140 showing information about the print medium etc. is provided with a size selection box 141 that allows the size of the medium to be selected through a pull-down menu, direction-select radio buttons 142 for selecting the direction (vertical or lateral) in which printing is performed on the print medium, a paper-supply selection box 147 that allows the paper supply tray to be selected through a pull-down menu, and a medium selection box 148 that allows the type of print medium to be selected through a pull-down menu.

When the user selects the desired print-medium size from the pull-down menu incorporated in the size selection box 141, the print-medium size can be set, and the print-medium size that has been set is displayed in the size selection box 141. Further, the print direction is set when the user selects either one of the two direction-select radio buttons 142 related to the two print directions (vertical or lateral). A mark is shown in the button that has been set through the direction-select radio buttons 142 to show the print direction that has been set.

The contents that have been set through the size selection box 141 and the direction-select radio buttons 142 are displayed in the region 166 showing the print direction of the print medium as an image. More specifically, the region 166 showing the print direction of the print medium as an image shows the medium size, and a rectangle having a length-to-width ratio corresponding to the medium size arranged in the direction that has been set through the direction-select radio buttons 142, wherein a letter such as "A" is shown in the rectangle to indicate the print direction.

When the user selects the desired paper supply tray from the pull-down menu incorporated in the paper-supply selection box 147, the paper supply tray can be set, and the name of the paper supply tray that has been set is displayed in the paper-supply selection box 147. Further, when the user selects the desired type of print medium from the pull-down menu incorporated in the medium selection box 148, the type of print medium can be set, and the type of print medium that has been set is displayed in the medium selection box 148. For example, when "auto-select" is selected in the paper-supply selection box 147 and "plain paper" is selected in the medium selection box 148, then settings will be made such that plain paper is supplied from a paper supply tray to which plain paper having the preselected medium size has been set.

The region 160 showing the number of prints etc. is provided with a number-of-prints selection box 161 for setting the number of prints, an output order checkbox 162 for selecting whether or not to collate pages when two or more copies are to be printed, and a version display button 163 for displaying the version information of the printer driver. The value "1" is displayed in the number-of-prints selection box 161 as a default, indicating that settings are made such that one copy will be printed. By entering the desired number of prints in the number-of-prints selection box 161, settings can be made such that the number of prints entered is output, and the number of prints that has been set is displayed in the number-of-prints selection box 161. Further, by placing a check in the output order checkbox 162, settings can be made to collate pages, and the settings are displayed in the output order checkbox 162. When the user clicks on the version display button 163, a dialog box showing the version information of the printer driver will be displayed. Further, the contents that have been set through the number-of-prints selection box 161 and the output order checkbox 162 are also displayed in the region 166 showing the print direction of the print medium as an image.

Among the five regions, that is, among the region 140 showing information about the print medium etc., the region 150 showing information about images, the region 160 showing the number of prints etc., the region 166 showing the print direction of the print medium as an image, and the region 167 showing the contents that have been set in a list, the four regions except for the region 150 showing information about images are displayed in the same way both for when the printer 10 is being used as a color printer and when the printer 10 is being used as a monochrome printer.

The region 150 showing information about images in the basic settings dialog box for when the printer 10 is being used as a monochrome printer is provided with: a quality-designating slide bar 151 showing a straight line having, as the print qualities, "fine mode" on one end for printing high-quality images by taking time and "fast mode" on the other end for printing in a short amount of time, and a marker that is movable between the ends; and a detailed settings display button 152 for allowing detailed settings and for displaying items that can be set in detail.

On the other hand, the region 150 showing information about images in the basic settings dialog box for when the printer 10 is being used as a color printer is provided with: radio buttons 153 for entering a command for selecting whether to print color images or to print monochrome images; and quality radio buttons 154 that is made of two buttons for entering a command for selecting the print qualities. The quality radio buttons 154 include: a recommended button for printing with a printing method that is set in advance; and a detailed settings button for setting the printing method freely.

When the "recommended button" is selected, the printing method that is generally recommended is selected, and a slide bar appears for allowing selection from between two resolution levels, that is, a "standard mode", for printing at a resolution of, for example, 300 dpi, and a "high-quality mode", for printing at a resolution of, for example, 600 dpi.

Further, when the "recommended button" is selected, a selection box 156, a settings change button 157, and a save/delete button 158 become active.

The selection box 156 shows, as a pull-down menu, a plurality of printing methods such as a "graphic mode", a "photographic mode", and a "fine mode" which are prepared in advance to suit the image to be printed. A printing method can be selected from this pull-down menu, and the selected printing method is displayed in this selection box 156.

On the other hand, selecting the settings change button 157 causes a detailed settings dialog box to be displayed. Further, the save/delete button 158 allows the contents of the settings made in the detailed settings dialog box to be saved in a memory, or allows settings that have already been saved to be deleted.

===Operations Carried Out by the Image Forming System===

Next, a second embodiment of operations carried out by the image forming system 700 is described below.

As described above, when the developing units are attached to each of the attach/detach sections 50*a*, 50*b*, 50*c*, and 50*d*, the printer 10 according to the present embodiment can be used as a color printer for forming color images by developing the latent image borne on the photoconductor 20 using the toner T contained in each of the developing units, whereas when a developing unit is attached to only one of the attach/detach sections 50*a*, 50*b*, 50*c*, or 50*d*, then the printer 10 can be used as a monochrome printer for forming monochrome images by developing the latent image borne on the photoconductor 20 using the toner T contained in that developing unit.

Below, operations of the image forming system 700 for when (1) a user gives instructions to execute color-image formation when the printer 10 is being used as a color printer, (2) the printer 10 is then switched from a color printer to a monochrome printer, and (3) the user gives instructions to execute monochrome-image formation when the printer 10 is being used as a monochrome printer are described. The various operations of the printer 10 described below are mainly achieved by the main controller 101 or the unit controller 102 in the printer 10. Particularly, in the present embodiment, the operations are achieved by the CPU executing programs that are stored in the programmable ROM. The programs are made of codes for achieving the various operations described below.

It should be noted that in the present embodiment, the color driver described above is used as the printer driver 796 when the printer 10 is being used as a color printer, whereas the monochrome driver described above is used as the printer driver 796 when the printer 10 is being used as a monochrome printer.

<Operations of the Image Forming System for when a User Gives Instructions to Execute Color-Image Formation in a State where the Printer 10 is Being Used as a Color Printer>

Figure 17:
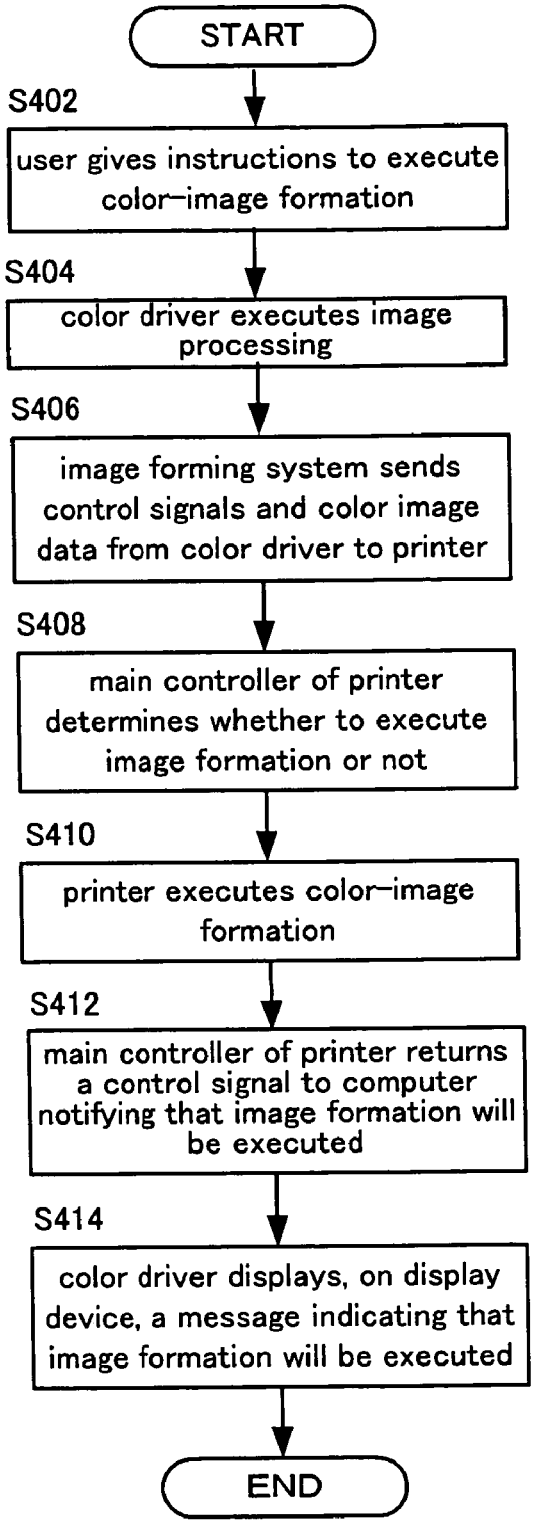
FIG. 17 is a flowchart for illustrating operations of the image forming system 700 according to the second embodiment for when a user gives instructions to perform color-image formation in a state where the printer 10 is being used as a color printer.

First, operations of the image forming system 700 for when a user gives instructions to execute color-image formation in a state where the printer 10 is being used as a color printer is described with reference to FIG. 17. FIG. 17 is a flowchart for illustrating operations of the image forming system 700 for when a user gives instructions to perform color-image formation in a state where the printer 10 is being used as a color printer.

This flowchart starts from a state in which the power of the printer 10 and the computer 702 has already been turned ON and the system is on standby for execution of image formation. Further, since the printer 10 is being used as a color printer, the developing units are attached to all four attach/detach sections, as shown in FIG. 3. That is, the black developing unit 51 is attached to the attach/detach section 50*a*, the magenta developing unit 52 is attached to the attach/detach section 50*b*, the cyan developing unit 53 is attached to the attach/detach section 50*c*, and the yellow developing unit 54 is attached to the attach/detach section 50*d*.

First, the user operates the above-described application program 795 to give instructions to the image forming system 700 to execute image formation (step S402). According to these instructions, image data AD in the application program is transferred from the application program 795 to the image processing section 797 of the printer driver 796. At this time, the user also enters information instructing execution of color-image formation, as well as the setting information about the print media etc., using the input device 708 through the user interface window displayed on the display device 704 by the display interface section 801 of the printer driver 796 (step S402).

The input interface section 803 of the printer driver 796 that has received the information indicative of execution of color-image formation, as well as the setting information about the print media etc., sends the information to the user interface processing section 805. The user interface processing section 805 processes the received information, and sends, as control signals COM, the information indicative of execution of color-image formation to the printer 10, and the information indicative of execution of color-image formation, as well as the setting information about the print media etc., to the image processing section 797.

The image processing section 797 receives, as control signals COM, the information indicative of execution of color-image formation, as well as the setting information about the print media etc., and based on this information, it processes the image data AD that it received from the application program 795 (step S404). That is, image processing for carrying out color-image formation is executed by the image processing section 797. After the image processing is finished, color-image data PD, which have been obtained by the processing, are sent to the printer 10.

Finally, the control signals COM, which are indicative of execution of color-image formation, and the color-image data PD are sent from the printer driver 796 to the printer 10

(step S406). Through these operations, the printer driver 796 instructs the printer 10 to carry out image formation.

The printer 10 receives the color-image data PD and the control signals COM, which are indicative of execution of color-image formation, from the computer 702 via the interface (I/F) 112. The printer 10 temporarily stores the received color-image data PD in the image memory 113 of the main controller 101. The CPU 111 of the main controller 101 then determines whether image formation is to be executed or not according to the information in the control signals COM (step S408).

The way in which the CPU 111 determines whether image formation is to be executed or not is described below. The printer 10 with its power turned ON has apparatus-type information, in the RAM 114*b* of the main controller 101, that indicates whether the printer 10 is being used as a color printer or as a monochrome printer. (Details of this will be given further below.) The CPU 111 determines whether image formation is to be executed or not by comparing the apparatus-type information and the information in the control signals COM.

More specifically, if the apparatus-type information indicates that the printer 10 is being used as a color printer and the information in the control signals COM indicates execution of color-image formation, then the CPU 111 selects execution of image formation. The CPU 111 selects execution of image formation also for the case where the apparatus-type information indicates "monochrome printer" and the information in the control signals COM indicates execution of monochrome-image formation, and for the case where the apparatus-type information indicates "color printer" and the information in the control signals COM indicates execution of monochrome-image formation.

On the other hand, if the apparatus-type information indicates that the printer 10 is being used as a monochrome printer and the information in the control signals COM indicates execution of color-image formation, then the CPU 111 selects not to execute image formation. The relationship between execution/non-execution of image formation, the apparatus-type information, and the information in the control signals COM is as shown in FIG. 18.

In the present example, the apparatus-type information indicates "color printer" and the information in the control signals COM indicates execution of color-image formation. Therefore, the CPU 111 of the main controller 101 selects execution of image formation. Then, under control of the unit controller 102 according to commands from the main controller 101, the printer 10 carries out the operations described in the section of "Example of operation of image forming apparatus <Forming color images>" above. In this way, a color image is formed on the medium (step S410). At this time, the main controller 101 returns, to the computer 702, a control signal COM indicating that image formation is going to be executed (step S412).

The user interface processing section 805 of the computer 702 receives the control signal COM and interprets its contents. Then, it gives out a command to the display interface section 801 to display a message indicating that image formation will be executed. Receiving this command, the display interface section 801 displays, on the display device 704, a message indicating that image formation will be executed (step S414).

<Switching from Color Printer to Monochrome Printer>

Figure 19:
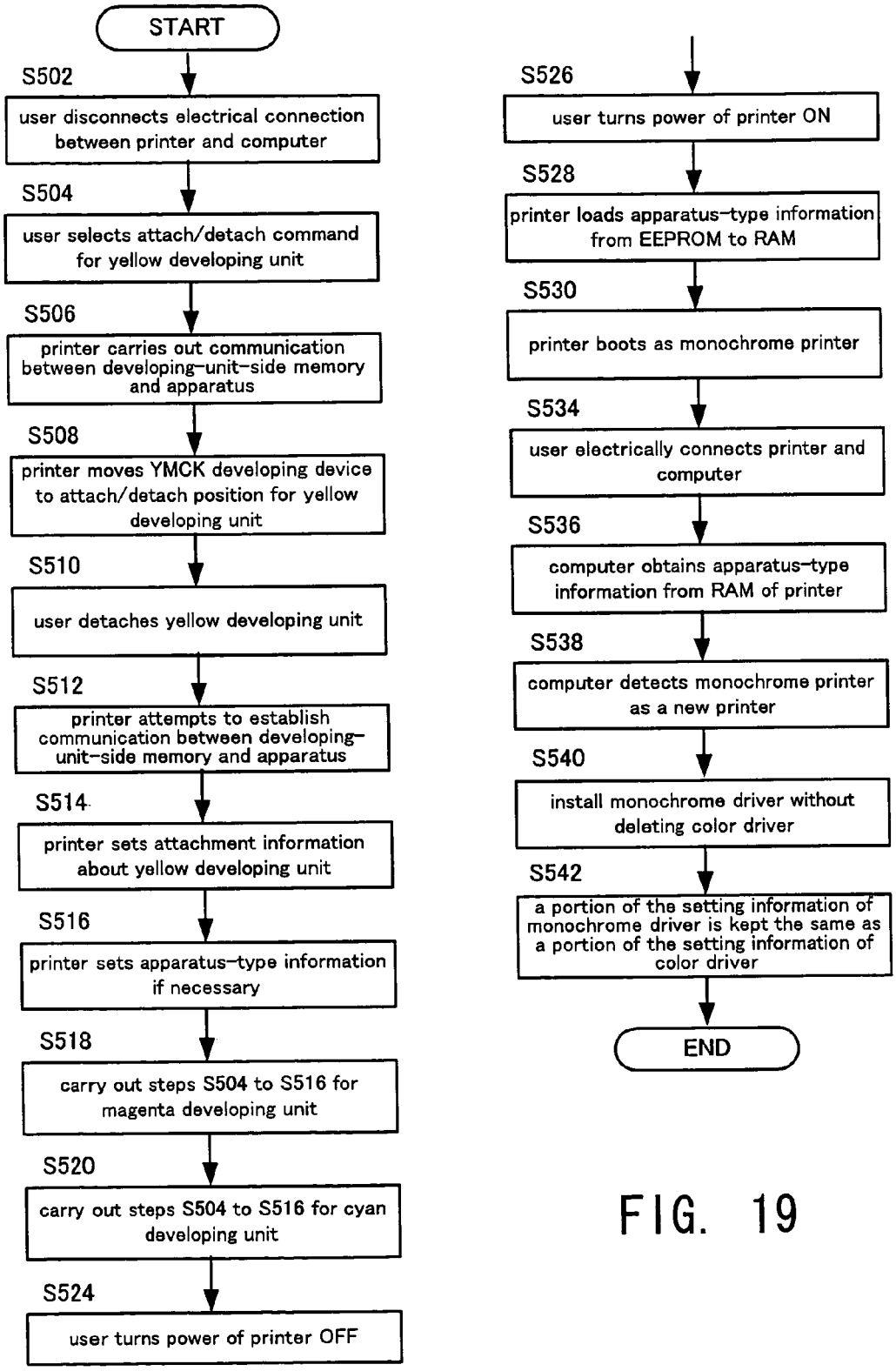
FIG. 19 is a flowchart for illustrating the procedure for switching the printer 10 from a color printer to a monochrome printer according to the second embodiment.

Next, switching of the printer 10 from a color printer to a monochrome printer will be described with reference to FIG. 19. FIG. 19 is a flowchart for illustrating the procedure for switching the printer 10 from a color printer to a monochrome printer.

This flowchart starts from a state in which the power of the printer 10 has already been turned ON and the printer 10 is on standby for image formation to be carried out. The standby position of the YMCK developing device 50 at this time is the HP position shown in FIG. 8A.

Further, the printer 10, before switching is performed, is used as a color printer, and therefore, the developing units are attached to all four attach/detach sections, as shown in FIG. 3. That is, the black developing unit 51 is attached to the attach/detach section 50*a*, the magenta developing unit 52 is attached to the attach/detach section 50*b*, the cyan developing unit 53 is attached to the attach/detach section 50*c*, and the yellow developing unit 54 is attached to the attach/detach section 50*d*.

First, if the printer 10 is electrically connected to a computer 702, then the user disconnects the electrical connection by, for example, turning the power of the computer OFF or disconnecting the cable that connects the printer 10 and the computer (step S502.)

Then, the user operates a menu button provided, for example, on the displaying unit 95, and by selecting the attach/detach command for a certain developing unit, the user gives an instruction to the printer 10 that he/she wishes to attach or detach a developing unit. At the time of giving this instruction, the user designates the developing unit that is targeted for attachment/detachment.

In the present embodiment, the user first selects the attach/detach command for the yellow developing unit 54 (step S504). The unit controller 102 comprehends this command with the displaying unit drive control circuit. More specifically, the unit controller 102 determines which, among the black developing unit 51, the magenta developing unit 52, the cyan developing unit 53, and the yellow developing unit 54, is the developing unit targeted for attachment/detachment. In the present embodiment, the developing unit targeted for attachment/detachment is the yellow developing unit 54. Therefore, the unit controller 102 rotates the pulse motor for a predetermined number of pulses to rotate the YMCK developing device 50 and to move the position of the YMCK developing device 50 from the HP position to the connector attach/detach position for the yellow developing unit 54.

Then, the unit controller 102 halts the YMCK developing device 50 at the connector attach/detach position. In this halted state, the unit controller 102 moves the apparatus-side connector 34 and makes the apparatus-side connector 34 and the developing-unit-side connector 54*b* of the yellow developing unit 54 abut against each other. In this state, the developing-unit-side memory 54*a* of the yellow developing unit 54 is electrically connected to the unit controller 102 of the control unit 100, and communication is established between the developing-unit-side memory 54*a* and the apparatus body (step S506).

After finishing the communication and separating the apparatus-side connector 34 from the developing-unit-side connector 54*b*, the unit controller 102 rotates the pulse motor for a predetermined number of pulses to rotate the YMCK developing device 50 and to move the position of the YMCK developing device 50 from the connector attach/detach position for the yellow developing unit 54 to the attach/detach position for the yellow developing unit 54 (step S508).

In this state, the unit controller 102 notifies the user that the yellow developing unit 54 can be detached from (or be attached to) the attach/detach section by displaying a message on the displaying section etc. provided in the displaying unit 95.

Confirming the display, the user opens the outer cover of the printer 10 and detaches the yellow developing unit 54, which is arranged inside the attach/detach dedicated opening 37, from the YMCK developing device 50 through the attach/detach dedicated opening 37 (step S510). After the user detaches the yellow developing unit 54 and closes the outer cover of the printer 10, the unit controller 102 detects this and moves the position of the YMCK developing device 50 from the attach/detach position for the yellow developing unit 54 to the connector attach/detach position for the yellow developing unit 54.

Then, the unit controller 102 halts the YMCK developing device 50 at the connector attach/detach position. In this halted state, the unit controller 102 moves the apparatus-side connector 34 and attempts to establish communication with the developing-unit-side memory of the developing unit (step S512). If communication succeeds, then the unit controller 102 assumes that the yellow developing unit 54 is attached, and sets the attachment information for the yellow developing unit 54 in the EEPROM 116*a* to "1". On the other hand, if communication fails, then the unit controller 102 assumes that the yellow developing unit 54 is not attached, and sets the attachment information for the yellow developing unit 54 in the EEPROM 116*a* to "0" (step S514). In the present embodiment, since the yellow developing unit 54 has been detached at step S510, it is assumed that the communication has failed, and the attachment information for the yellow developing unit 54 in the EEPROM 116*a* is changed from "1" to "0".

After finishing the above-described processes relating to the attachment information, the unit controller 102 sends the attachment information for all four developing units to the main controller 101. The main controller 101 receives the attachment information and sets the above-described apparatus-type information based on the attachment information (step S516).

An algorithm according to which the main controller 101 sets the apparatus-type information based on the attachment information of the four developing units is described below. If the value of only one of the four pieces of attachment information is "1", which indicates that a developing unit is attached, then the main controller 101 sets the value of the apparatus-type information in the EEPROM 114*a* to "1", which indicates that the printer is to be used as a monochrome printer. On the other hand, if the value of two or more pieces of attachment information is "1", then the main controller 101 sets the value of the apparatus-type information to "0", which indicates that the printer is to be used as a color printer. In both cases, however, if the value of the attachment information for the black developing unit 51 is "0", then the main controller 101 does not execute the operation of setting the apparatus-type information. (That is, if the black developing unit 51, which should be attached regardless of whether the printer is to be used as a color printer or as a monochrome printer, is not attached, the apparatus-type information is not rewritten and the value of the apparatus-type information is kept the same.) The relationship between the values of the attachment information and the operations of setting the apparatus-type information is as shown in FIG. 20.

In the present embodiment, the value of the attachment information only for the yellow developing unit 54 is "0" (and this situation matches case "P" of FIG. 20). Therefore, the main controller 101 sets the value of the apparatus-type information to "0", which indicates "color printer", in accordance with the algorithm described above. In this example, however, the value of the apparatus-type information is not changed because before detachment of the yellow developing unit 54, all four developing units were attached and the value of the apparatus-type information was "0" (the situation for case "Q" of FIG. 20).

Next, the processes from step S504 through step S516 described above are carried out for the cyan developing unit 53 and the magenta developing unit 52 (step S518 and step S520). As a result of carrying out these processes, the values of the attachment information for the cyan developing unit 53 and the magenta developing unit 52 are rewritten from "1" to "0". The values of the attachment information of the developing units received by the main controller 101 are: "1" for the black developing unit, "0" for the magenta developing unit, "0" for the cyan developing unit, and "0" for the yellow developing unit (i.e., the values match case "I" of FIG. 20). Therefore, the main controller 101 changes the value of the apparatus-type information from "0", which indicates "color printer", to "1", which indicates "monochrome printer", in accordance with the algorithm described above.

Next, the user temporarily halts power supply to the printer by turning the power of the printer 10 OFF, for example (step S524). The user then supplies power to the printer again by turning the power of the printer 100N, for example (step S526).

When power is supplied to the printer 10, the main controller 101 detects this and loads the apparatus-type information from the EEPROM 114*a* to the RAM 114*b* (step S528). Here, the value "1", which indicates "monochrome printer", is loaded to the RAM 114*b*. The CPU 120 of the unit controller 102 then controls the drive control circuits based on the apparatus-type information that has been loaded to the RAM 114*b*. More specifically, as a result of referencing the apparatus-type information in the RAM 114*b*, the printer 10 boots as a monochrome printer, and the units and the YMCK developing device 50 of the printer 10 are controlled to function as a monochrome printer (step S530).

The user then connects the printer 10 and the computer 702 with a cable and turns the power of the computer 7020N, to thus electrically connect the printer 10 and the computer 702 (step S534). Then, the user makes settings for the printer through the operating system running on the computer 702. At this time, the control unit 100 of the computer obtains the apparatus-type information from the RAM 114*b* of the printer 10 (step S536). The apparatus-type information obtained at this time is "1", which indicates "monochrome printer". This value is different from the apparatus-type information "0" that has been stored before turning the power ON, and therefore, the computer 702 detects the printer 10 as a new printer (step S538).

The computer 702 then notifies the user that a new printer has been detected. The user installs, to the computer 702, a monochrome driver, which is supplied in the form of a CD-ROM etc., for causing the printer 10 to operate as a monochrome printer (step S540). Since the printer 10 is detected as a new printer, the user installs, to the computer 702, the monochrome driver for causing the printer 10 to operate as a monochrome printer, without deleting the color driver which has been installed for causing the printer 10 to operate as a color printer. That is, when the switching task for switching the printer from a color printer to a monochrome printer is completed, both the monochrome driver for causing the printer to operate as a monochrome printer and the color driver for causing the printer to operate as a color printer co-exist in the computer 702.

The computer 702 then loads the setting information of the two co-existing drivers, that is, the monochrome driver and the color driver, and changes a portion of the initial setting values of the setting information of the monochrome driver to specific setting values of the setting information of the color driver. In this way, at least a portion of the setting information of the monochrome driver is kept the same as a portion of the color driver (step S542). This is described in further detail with reference to FIG. 21 and FIG. 22. It should be noted that FIG. 21 is a diagram showing an example of a user interface window displayed on the display device 704 by the color driver, and FIG. 22 is a diagram showing an example of a user interface window displayed on the display device 704 by the monochrome driver.

Figure 21:
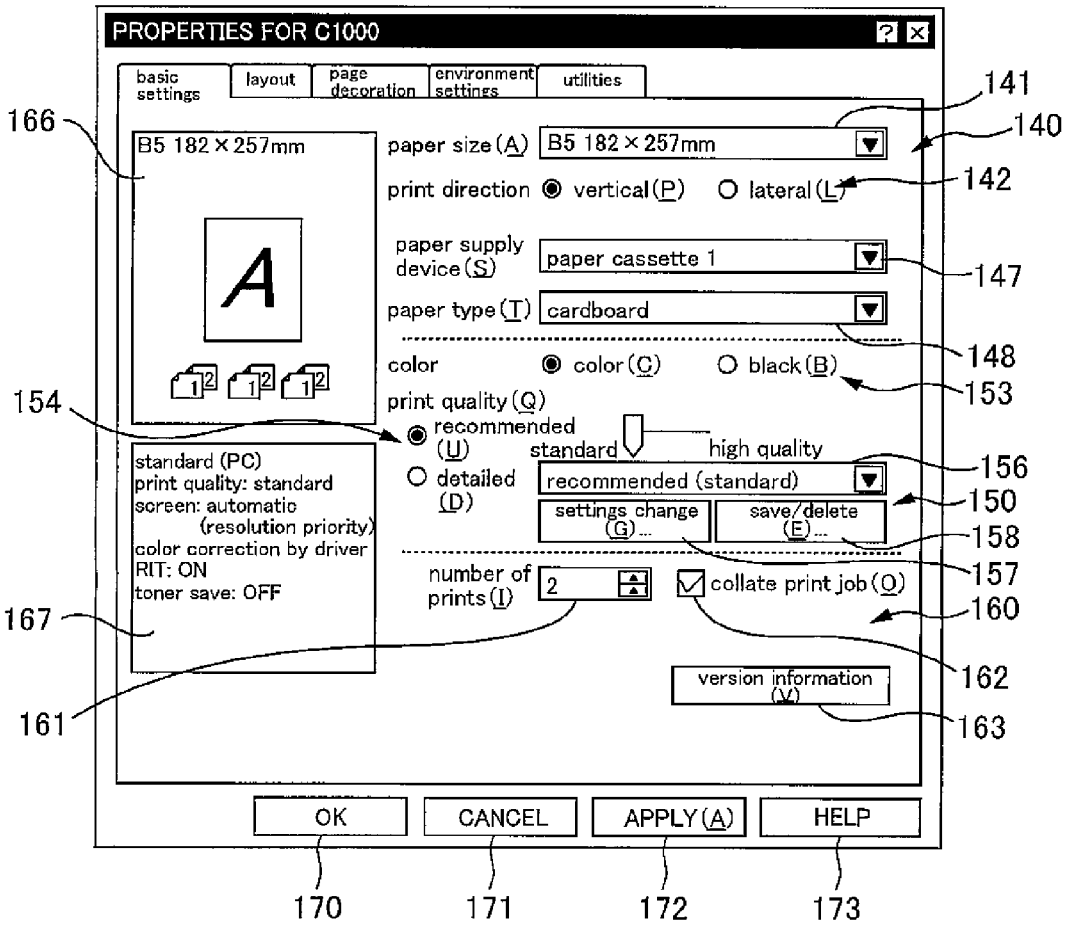
FIG. 21 is a diagram showing an example of a user interface window displayed on the display device 704 by the color driver according to the second embodiment.

Here, it is assumed, for example, that while the printer 10 was being used as a color printer before switching, the user set, in the basic settings dialog box using the color driver, the medium size to "B5 182×257 mm" in the size selection box 141, the paper supply tray to "paper cassette 1" in the paper-supply selection box 147, the type of print medium to "cardboard" in the medium selection box 148, and the number of prints to "2" in the number-of-prints selection box 161, as shown in FIG. 21.

Figure 22:
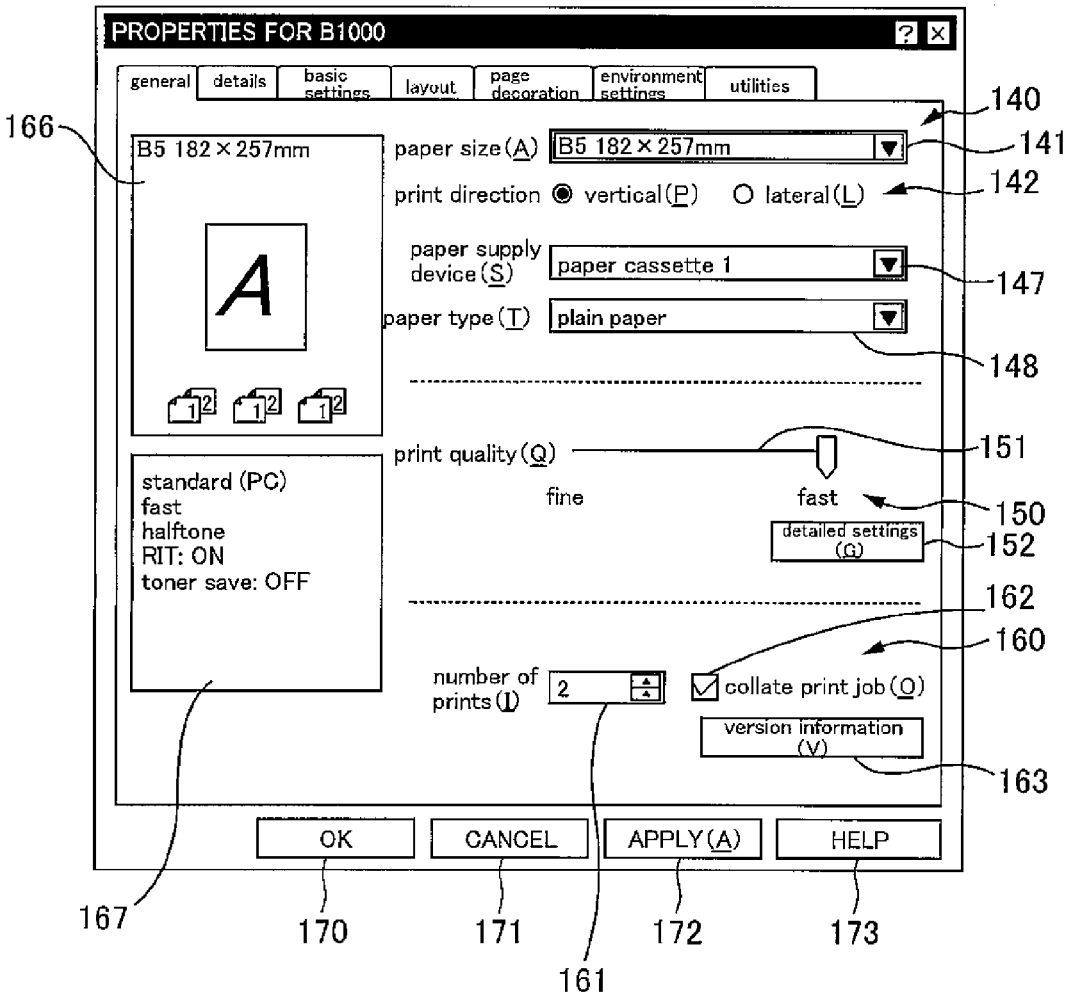
FIG. 22 is a diagram showing an example of a user interface window displayed on the display device 704 by the monochrome driver according to the second embodiment.

After the printer 10 is switched from the color printer to the monochrome printer and the basic setting properties dialog box is displayed on the display device 704 by the monochrome driver, the setting information will be set to the values shown in FIG. 22. That is, the medium size is set to "B5 182×257 mm", the paper supply tray is set to "paper cassette 1", the type of print medium is set to "plain paper", and the number of prints is set to "2". This indicates that the monochrome driver inherits specific setting values of the color driver for the medium size, the paper supply tray, and the number of prints, but does not inherit specific setting values of the color driver for the print medium.

As described above, when the user selects the monochrome driver and the monochrome driver activates, at least a portion of the setting information of the monochrome driver is kept the same as a portion of the setting information of the color driver that was changed by the user.

<Operations of the Image Forming System for when a User Gives Instructions to Execute Monochrome-Image Formation in a State where the Printer 10 is Being Used as a Monochrome Printer>

Figure 23:
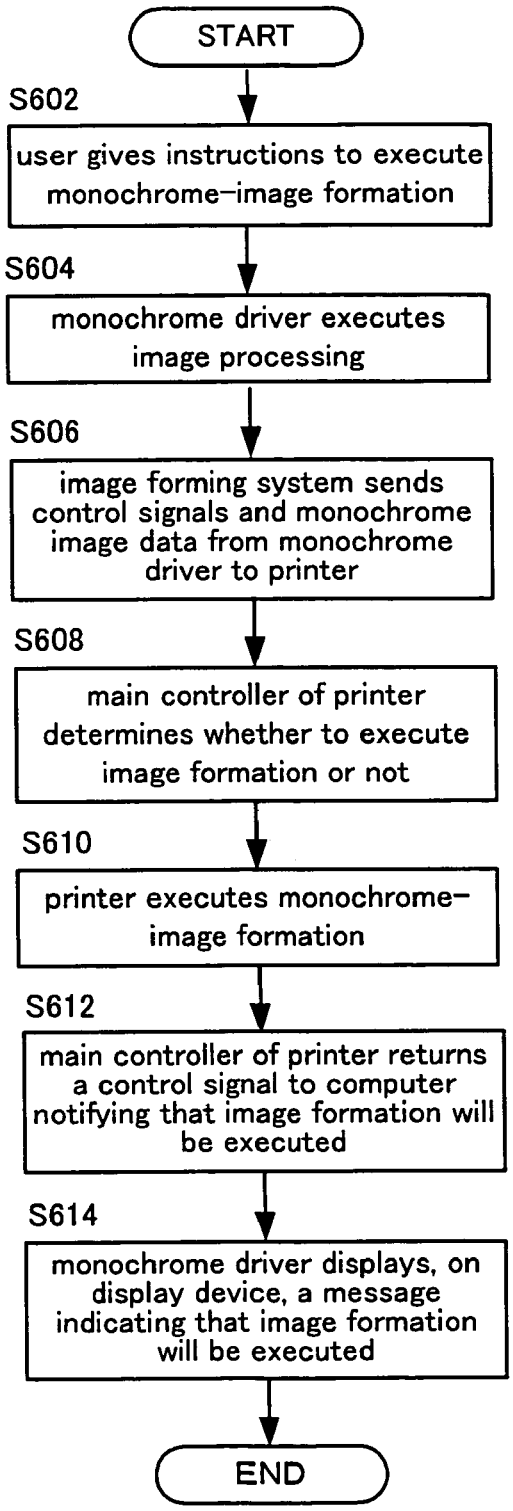
FIG. 23 is a flowchart for illustrating operations of the image forming system 700 according to the second embodiment for when a user gives instructions to perform monochrome-image formation in a state where the printer 10 is being used as a monochrome printer.

Next, operations of the image forming system 700 for when a user gives instructions to execute monochrome-image formation in a state where the printer 10 is being used as a monochrome printer is described with reference to FIG. 23. FIG. 23 is a flowchart for illustrating operations of the image forming system 700 for when a user gives instructions to perform monochrome-image formation in a state where the printer 10 is being used as a monochrome printer.

This flowchart starts from a state in which the power of the printer 10 and the computer 702 has already been turned ON and the system is on standby for execution of image formation. Further, since the printer 10 is being used as a monochrome printer, only one developing unit is attached to one of the four attach/detach sections, as shown in FIG. 4. That is, the black developing unit 51 is attached to the attach/detach section 50*a*, whereas no developing unit is attached to the other attach/detach sections 50*b*, 50*c*, and 50*d*.

First, the user operates the above-described application program 795 to give instructions to the image forming system 700 to execute image formation (step S602). According to these instructions, image data AD in the application program is transferred from the application program 795 to the image processing section 797 of the printer driver 796. At this time, the user also enters the setting information about the print media etc. using the input device 708 through the user interface window displayed on the display device 704 by the display interface section 801 of the printer driver 796.

It should be noted that in the present example, the information for making the user select either execution of color-image formation or execution of monochrome-image formation is not displayed, because the printer driver 796 is a monochrome driver. In other words, information specific to a color printer is displayed on the user interface window of the display device 704 when the printer 10 is being used as a color printer, but it is not displayed on the user interface window of the display device 704 when the printer 10 is being used as a monochrome printer. The user interface processing section 805 sends the information indicating execution of monochrome-image formation to the printer 10 and the image processing section 797 as control signals COM, without the information indicating execution of monochrome-image formation being entered.

The input interface section 803 of the printer driver 796 that has received the setting information about the print media etc. sends the information to the user interface processing section 805. The user interface processing section 805 processes the received information, and sends the information to the image processing section 797 as control signals COM.

The image processing section 797 receives, as control signals COM, the information indicative of execution of monochrome-image formation, as well as the setting information about the print media etc., and based on this information, it processes the image data AD that it received from the application program 795 (step S604). That is, image processing for carrying out monochrome-image formation is executed by the image processing section 797. After the image processing is finished, monochrome-image data PD, which have been obtained by the processing, are sent to the printer 10.

Finally, the control signals COM, which are indicative of execution of monochrome-image formation, and the monochrome-image data PD are sent from the printer driver 796 to the printer 10 (step S606). Through these operations, the printer driver 796 instructs the printer 10 to carry out image formation.

The printer 10 receives the monochrome-image data PD and the control signals COM, which are indicative of execution of monochrome-image formation, from the computer 702 via the interface (I/F) 112. The printer 10 temporarily stores the received monochrome-image data PD in the image memory 113 of the main controller 101. The CPU 111 of the main controller 101 then determines whether image formation is to be executed or not according to the criterion for determination shown in FIG. 18 (step S608).

In the present example, the apparatus-type information indicates "monochrome printer" and the information in the control signals COM indicates execution of monochrome-image formation. Therefore, the CPU 111 of the main controller 101 selects to execute image formation. Then, under control of the unit controller 102 according to commands from the main controller 101, the printer 10 carries out the operations described in the section of "Example of operation of image forming apparatus <Forming monochrome images>" above. In this way, a monochrome image is formed on the medium (step S610). At this time, the main controller 101 returns, to the computer 702, a control signal COM indicating that image formation is going to be executed (step S612).

The user interface processing section 805 of the computer 702 receives the control signal COM and interprets its contents. Then, it gives out a command to the display interface section 801 to display a message indicating that image formation will be executed. Receiving this command, the display interface section 801 displays, on the display device 704, a message indicating that image formation will be executed (step S614).

===Image Forming System that is Convenient for Users===

As described above, in the image forming system 700 according to the present embodiment, at least a portion of the setting information of the monochrome driver that is used after switching is kept the same as a portion of the setting information of the color driver that was used before switching when the printer is switched from a color printer to a monochrome printer. In this way, it is possible to achieve an image forming system 700 that is convenient for users.

More specifically, as described in the section of the "Description of the Related Art", the user often sets the setting information to specific setting values before instructing the printer driver to execute image formation. When the printer 10 is switched, however, the setting values of the setting information of a printer driver that was used before switching of the printer 10 may differ from the initial setting values of the setting information of a printer driver that is used after switching. In this case, the user has to change the initial setting values of the latter printer driver to the specific setting values in order to execute image formation after switching of the printer 10 using those specific setting values, which are different from the initial setting values of printer driver that is used after switching of the printer 10. Therefore, when switching of the printer 10 is performed, the user will have to carry out burdensome tasks.

For example, if the printer 10 is switched from a color printer to a monochrome printer in a situation where the user instructed the image forming system to form images by setting the medium size to "B5 182×257 mm" in the size selection box 141 in the basic setting properties dialog box that was displayed by the color driver while the printer 10 was being used as a color printer before switching, then after switching, the initial setting value "A4 210×297 mm" will be displayed in the size selection box 141 displayed by the monochrome driver. Therefore, if the user wishes to form images using "B5 182×257 mm", which was the specific setting value set for the medium size, when the printer 10 is being used as a monochrome printer, then the user will have to change the initial setting value "A4 210×297 mm" to "B5 182×257 mm" in the size selection box 141.

In view of the above, according to the present second embodiment, at least a portion of the setting information of the monochrome driver that is used after switching is kept the same as a portion of the setting information of the color driver that was used before switching when the printer is switched from a color printer to a monochrome printer. In this way, "B5 182×257 mm" will be shown in the size selection box 141 displayed by the monochrome driver, instead of the initial setting value "A4 210×297 mm" in the example described above. Therefore, the user does not have to change the initial setting value "A4 210×297 mm" to "B5 182×257 mm" in the size selection box 141.

The description above was about an example in which at least a portion of the setting information of the monochrome driver that is used after switching is kept the same as a portion of the setting information of the color driver that was used before switching when the printer 10 is switched from a color printer to a monochrome printer. It should be noted that the same effects can be achieved in a case where at least a portion of the setting information of the color driver that is used after switching is kept the same as a portion of the setting information of the monochrome driver that was used before switching when the printer 10 is switched from a monochrome printer to a color printer.

As described above, it is possible to achieve an image forming system 700 that is convenient for users by keeping at least a portion of the setting information of the printer driver 796 that is used after switching to be the same as a portion of the setting information of the printer driver 796 that was used before switching when the printer is switched from the monochrome printer to the color printer or from the color printer to the monochrome printer.

===Other Considerations===

The present second embodiment described above relates to an image forming system (for example, the image forming system 700) that is provided with an image forming apparatus (for example, the printer 10) that has a plurality of attach/detach sections (for example, the attach/detach sections 50*a*, 50*b*, 50*c*, and 50*d*) to and from each of which a developer container (for example, the developing unit 51, 52, 53, and 54) for containing developer (for example, the toner T) can be attached and detached, and an image bearing body (for example, the photoconductor 20) for bearing a latent image; and a computer (for example, the computer 702) that is capable of communicating with the image forming apparatus and that has at least one control program (for example, the printer driver 796) for instructing the image forming apparatus to perform image formation; wherein when a developer container is attached to each of the plurality of attach/detach sections, the image forming apparatus is usable as a color image forming apparatus (for example, the color printer) for forming a color image by developing the latent image borne on the image bearing body with the developer contained in each developer container; wherein when a developer container is attached to only one (for example, the attach/detach section 50*a*) of the plurality of attach/detach sections, the image forming apparatus is usable as a single-color image forming apparatus (for example, the monochrome printer) for forming a single-color image by developing the latent image borne on the image bearing body with the developer contained in the developer container; wherein when the image forming apparatus is used as a color image forming apparatus, a color control program (for example, the color driver) instructs the color image forming apparatus to perform image formation using setting information that is changeable and that is recorded on the color control program; and wherein when the image forming apparatus is used as a single-color image forming apparatus, a single-color control program (for example, the monochrome driver) instructs the single-color image forming apparatus to perform image formation using setting information that is changeable and that is recorded on the single-color control program.

Further, in the foregoing embodiment, the information that is changeable by a user included medium information about a medium on which an image is formed. This, however, is not a limitation.

For example, the information that is changeable by the user does not have to include the medium information about a medium on which an image is formed.

However, the image forming system 700 can form images according to various information that has been set about the media, and on the other hand, the user often makes the image forming system 700 form images by using the above-mentioned information which is set to specific setting values. Therefore, if the specific setting value about the medium information of the printer driver used before switching of the printer 10 is different from the initial setting value about the medium information of the printer driver used after switching of the printer 10, then the user will have to change the initial setting value to the specific setting value. The foregoing embodiment is therefore more preferable in terms that the effect of the present invention, that is, the effect of being able to achieve an image forming system 700 that is convenient for users, is achieved more advantageously.

Further, in the foregoing embodiment, the medium information included information about the size of the medium. This, however, is not a limitation.

For example the medium information does not have to include information about the size of the medium.

However, the image forming system 700 can form images on media of various sizes, and on the other hand, the user often makes the image forming system 700 form images with respect to media of a specific size. Therefore, if the specific setting value about the size of the medium of the printer driver used before switching of the printer 10 is different from the initial setting value about the size of the medium of the printer driver used after switching of the printer 10, then the user will have to change the initial setting value to the specific setting value. The foregoing embodiment is therefore more preferable in terms that the effect of the present invention, that is, the effect of being able to achieve an image forming system 700 that is convenient for users, is achieved more advantageously.

Further, in the foregoing embodiment, the information that is changeable by a user was provided in the printer 10, and included information about a paper supply tray 92 for containing a medium on which an image is formed. This, however, is not a limitation.

For example, the information that is changeable by a user does not have to be provided in the printer 10, and does not have to include information about a paper supply tray 92 for containing a medium on which an image is formed.

However, the printer 10 often has a plurality of paper supply tray 92*s*, and each paper supply tray 92 is able to contain media of different sizes. On the other hand, the user often makes the image forming system 700 form images after selecting a specific paper supply tray 92. Therefore, if the specific setting value about the paper supply tray of the printer driver used before switching of the printer 10 is different from the initial setting value about the paper supply tray of the printer driver used after switching of the printer 10, then the user has to change the initial setting value to the specific setting value. The foregoing embodiment is therefore more preferable in terms that the effect of the present invention, that is, the effect of being able to achieve an image forming system 700 that is convenient for users, is achieved more advantageously.

Further, in the foregoing embodiment, the printer 10 had information indicative of whether the printer 10 is being used as the color printer or whether the printer 10 is being used as the monochrome printer. This, however, is not a limitation.

For example, the printer 10 does not have to have information indicative of whether the printer 10 is being used as the color printer or whether the printer 10 is being used as the monochrome printer.

If, however, the printer 10 is provided with information indicative of whether the printer 10 is being used as the color printer or as the monochrome printer, then by using the information indicative of whether the printer 10 is being used as the color printer or as the monochrome printer, it becomes possible to find out whether the printer 10 is being used either as a color printer or a monochrome printer when switching of the printer 10 is to be performed.

Therefore, the foregoing embodiment is more preferable.

Further, in the foregoing embodiment, the single-color image forming apparatus was a monochrome printer 10 that forms monochrome images, when a black developing unit 51 was attached to only one attach/detach section 50*a* of the plurality of attach/detach sections 50*a*, 50*b*, 50*c*, and 50*d*, by developing the latent image borne on the photoconductor 20 with the toner T contained in the black developing unit 51. This, however, is not a limitation.

That is, in the foregoing embodiment, the developing unit attached to the one attach/detach section was the black developing unit, and the latent image was developed with the toner contained in the black developing unit to form a monochrome image, but this is not a limitation. For example, the developing unit attached to the one attach/detach section may be a developing unit containing toner of a different color, and the latent image may be developed with the toner contained in that developing unit to form an image of a different color.

However, if the single-color image forming apparatus is a monochrome printer, then even when the printer 10 is switched to a monochrome printer for forming monochrome images, which is used most often, it is possible to minimize the amount of changes in the setting information of the monochrome driver that is used after switching of the printer 10.

Therefore, the foregoing embodiment is more preferable.

<<<Other Embodiments>>>

In the foregoing, an image forming apparatus, an image forming system, etc. according to the present invention were described according to the above-described embodiments thereof. However, the foregoing embodiments of the invention are for the purpose of facilitating understanding of the present invention and are not to be interpreted as limiting the present invention. The present invention can be altered and improved without departing from the gist thereof, and needless to say, the present invention includes its equivalents.

It should be noted that in the foregoing embodiments, the system was described as having a configuration in which the printer is connected directly to the computer, as shown in FIG. 1. The printer, however, may be connected to the computer via a network.

Further, in the foregoing embodiments, the computer was described to include a display device such as a CRT (Cathode Ray Tube), a liquid crystal display device, or a plasma display, an input device such as a keyboard and a mouse, a reading device such as an FD (Flexible Disk) device, a CD-ROM drive device, an MO (Magneto Optical) disk drive device, a DVD (Digital Versatile Disk) device, an internal memory such as a RAM, and an external memory such as a hard disk drive unit. This, however, is not a limitation, and some of the devices described above do not have to be provided. Further, for example, the printer may have some of the functions and/or mechanisms of the computer.

Further, in the foregoing embodiments, an intermediate transferring type laser beam printer was described as an example of the image forming apparatus, but the present invention is also applicable to laser beam printers that are not of the intermediate transferring type. Further, in the foregoing embodiments, a printer was described as an example of the image forming apparatus, but the present invention is also applicable to various other types of image forming apparatuses, such as copying machines and facsimiles.

Further, in the foregoing embodiments, an image forming apparatus provided with a rotary-type developing device was described as an example. This, however, is not a limitation, and the present invention is applicable to, for example, image forming apparatuses provided with tandem-type developing devices.

Further, in the foregoing embodiments, communication between the developing-unit-side memories and the main body of the apparatus was carried out by making the apparatus-side connector abut against the developing-unit-side connectors. This, however, is not a limitation. Communication may be achieved without making the members of the developing units and a member of the main body of the apparatus coming into contact with each other.

Further, the photoconductor is not limited to a so-called photoconductive roller having a structure in which a photoconductive layer is provided on the outer peripheral surface of a cylindrical, conductive base. The photoconductor can be a so-called photoconductive belt structured by providing a photoconductive layer on a surface of a belt-like conductive base, for example.

What is claimed is:

1. An image forming apparatus comprising:

a plurality of attach/detach sections to and from each of which a developer container for containing developer can be attached and detached; and an image bearing body for bearing a latent image;

wherein when a developer container is attached to each of said plurality of attach/detach sections, said image forming apparatus is usable as a color image forming apparatus for forming a color image by developing the latent image borne on said image bearing body with the developer contained in each said developer container;

wherein when a developer container is attached to only one of said plurality of attach/detach sections, said image forming apparatus is usable as a single-color image forming apparatus for forming a single-color image by developing the latent image borne on said image bearing body with the developer contained in said developer container;

wherein said image forming apparatus has a device ID that is sent to a computer when said image forming apparatus communicates with said computer and that is used by said computer to recognize devices capable of communicating with said computer; and wherein the device ID of said image forming apparatus for when said image forming apparatus is being used as said color image forming apparatus matches the device ID of said image forming apparatus for when said image forming apparatus is being used as said single-color image forming apparatus.

2. An image forming apparatus according to claim 1, wherein said image forming apparatus has information indicative of whether said image forming apparatus is being used as said color image forming apparatus or whether said image forming apparatus is being used as said single-color image forming apparatus.

3. An image forming apparatus according to claim 1, wherein said single-color image forming apparatus is a monochrome image forming apparatus that forms monochrome images, when a developer container is attached to only one of said plurality of attach/detach sections, by developing the latent image borne on said image bearing body with the developer contained in said developer container.

4. An image forming apparatus according to claim 1, wherein said device ID is not updated at the time when said image forming apparatus is switched from said single-color image forming apparatus to said color image forming apparatus or from said color image forming apparatus to said single-color image forming apparatus.

5. An image forming apparatus comprising:

a plurality of attach/detach sections to and from each of which a developer container for containing developer can be attached and detached; and an image bearing body for bearing a latent image;

wherein when a developer container is attached to each of said plurality of attach/detach sections, said image forming apparatus is usable as a color image forming apparatus for forming a color image by developing the latent image borne on said image bearing body with the developer contained in each said developer container;

wherein when a developer container is attached to only one of said plurality of attach/detach sections, said image forming apparatus is usable as a single-color image forming apparatus for forming a single-color image by developing the latent image borne on said image bearing body with the developer contained in said developer container;

wherein said image forming apparatus has a device ID that is sent to a computer when said image forming apparatus communicates with said computer and that is used by said computer to recognize devices capable of communicating with said computer;

wherein the device ID of said image forming apparatus for when said image forming apparatus is being used as said color image forming apparatus matches the device ID of said image forming apparatus for when said image forming apparatus is being used as said single-color image forming apparatus;

wherein said image forming apparatus has information indicative of whether said image forming apparatus is being used as said color image forming apparatus or whether said image forming apparatus is being used as said single-color image forming apparatus;

wherein said single-color image forming apparatus is a monochrome image forming apparatus that forms monochrome images, when a developer container is attached to only one of said plurality of attach/detach sections, by developing the latent image borne on said image bearing body with the developer contained in said developer container; and wherein said device ID is not updated at the time when said image forming apparatus is switched from said single-color image forming apparatus to said color image forming apparatus or from said color image forming apparatus to said single-color image forming apparatus.

6. An image forming system comprising:

an image forming apparatus that includes a plurality of attach/detach sections to and from each of which a developer container for containing developer can be attached and detached and an image bearing body for bearing a latent image; and a computer that is capable of communicating with said image forming apparatus;

wherein when a developer container is attached to each of said plurality of attach/detach sections, said image forming apparatus is usable as a color image forming apparatus for forming a color image by developing the latent image borne on said image bearing body with the developer contained in each said developer container;

wherein when a developer container is attached to only one of said plurality of attach/detach sections, said image forming apparatus is usable as a single-color image forming apparatus for forming a single-color image by developing the latent image borne on said image bearing body with the developer contained in said developer container;

wherein said image forming apparatus has a device ID that is sent to said computer when said image forming apparatus communicates with said computer and that is used by said computer to recognize devices capable of communicating with said computer; and wherein the device ID of said image forming apparatus for when said image forming apparatus is being used as said color image forming apparatus matches the device ID of said image forming apparatus for when said image forming apparatus is being used as said single-color image forming apparatus.

7. An image forming system according to claim 6, wherein said image forming apparatus has information indicative of whether said image forming apparatus is being used as said color image forming apparatus or whether said image forming apparatus is being used as said single-color image forming apparatus.

8. An image forming system according to claim 6, wherein said single-color image forming apparatus is a monochrome image forming apparatus that forms monochrome images, when a developer container is attached to only one of said plurality of attach/detach sections, by developing the latent image borne on said image bearing body with the developer contained in said developer container.

9. An image forming system according to claim 6, wherein said device ID is not updated at the time when said image forming apparatus is switched from said single-color image forming apparatus to said color image forming apparatus or from said color image forming apparatus to said single-color image forming apparatus.

10. An image forming system according to claim 9, wherein:

among a color driver that corresponds to the image forming apparatus when said apparatus is used as said color image forming apparatus, and a single-color driver that corresponds to the image forming apparatus when said apparatus is used as said single-color image forming apparatus, said computer has only said color driver; and said device ID is not updated at the time when said image forming apparatus is switched from said color image forming apparatus to said single-color image forming apparatus.

11. An image forming system according to claim 9, wherein:

among a color driver that corresponds to the image forming apparatus when said apparatus is used as said color image forming apparatus, and a single-color driver that corresponds to the image forming apparatus when said apparatus is used as said single-color image forming apparatus, said computer has only said single-color driver; and said device ID is not updated at the time when said image forming apparatus is switched from said single-color image forming apparatus to said color image forming apparatus.

12. An image forming system comprising:

an image forming apparatus that includes a plurality of attach/detach sections to and from each of which a developer container for containing developer can be attached and detached and an image bearing body for bearing a latent image; and a computer that is capable of communicating with said image forming apparatus;

wherein when a developer container is attached to each of said plurality of attach/detach sections, said image forming apparatus is usable as a color image forming apparatus for forming a color image by developing the latent image borne on said image bearing body with the developer contained in each said developer container;

wherein when a developer container is attached to only one of said plurality of attach/detach sections, said image forming apparatus is usable as a single-color image forming apparatus for forming a single-color image by developing the latent image borne on said image bearing body with the developer contained in said developer container;

wherein said image forming apparatus has a device ID that is sent to said computer when said image forming apparatus communicates with said computer and that is used by said computer to recognize devices capable of communicating with said computer;

wherein the device ID of said image forming apparatus for when said image forming apparatus is being used as said color image forming apparatus matches the device ID of said image forming apparatus for when said image forming apparatus is being used as said single-color image forming apparatus;

wherein said image forming apparatus has information indicative of whether said image forming apparatus is being used as said color image forming apparatus or whether said image forming apparatus is being used as said single-color image forming apparatus;

wherein said single-color image forming apparatus is a monochrome image forming apparatus that forms monochrome images, when a developer container is attached to only one of said plurality of attach/detach sections, by developing the latent image borne on said image bearing body with the developer contained in said developer container;

wherein among a color driver that corresponds to the image forming apparatus when said apparatus is used as said color image forming apparatus, and a single-color driver that corresponds to the image forming apparatus when said apparatus is used as said single-color image forming apparatus, said computer has only said single-color driver; and wherein said device ID is not updated at the time when said image forming apparatus is switched from said single-color image forming apparatus to said color image forming apparatus.

13. An image forming system comprising:

an image forming apparatus that has a plurality of attach/detach sections to and from each of which a developer container for containing developer can be attached and detached, and an image bearing body for bearing a latent image; and a computer that is capable of communicating with said image forming apparatus and that has at least one control program for instructing said image forming apparatus to perform image formation;

wherein when a developer container is attached to each of said plurality of attach/detach sections, said image forming apparatus is usable as a color image forming apparatus for forming a color image by developing the latent image borne on said image bearing body with the developer contained in each said developer container;

wherein when a developer container is attached to only one of said plurality of attach/detach sections, said image forming apparatus is usable as a single-color image forming apparatus for forming a single-color image by developing the latent image borne on said image bearing body with the developer contained in said developer container;

wherein when said image forming apparatus is used as a color image forming apparatus, a color control program instructs said color image forming apparatus to perform image formation using setting information that is changeable and that is recorded on said color control program; wherein when said image forming apparatus is used as a single-color image forming apparatus, a single-color control program instructs said single-color image forming apparatus to perform image formation using setting information that is changeable and that is recorded on said single-color control program; and wherein when said image forming apparatus is switched from said single-color image forming apparatus to said color image forming apparatus or from said color image forming apparatus to said single-color image forming apparatus, at least a portion of the setting information of the control program that is used after said switching is kept the same as a portion of the setting information of the control program that was used before said switching, said portion of the setting information of the control program that was used before said switching having been the setting information set by a user.

14. An image forming system according to claim 13, wherein said setting information of said color control program and said setting information of said single-color control program include information that is changeable by a user.

15. An image forming system according to claim 14, wherein said information that is changeable by a user includes medium information about a medium on which an image is formed.

16. An image forming system according to claim 15, wherein said medium information includes information about the size of said medium.

17. An image forming system according to claim 14, wherein said information that is changeable by a user is provided in said image forming apparatus, and includes information about a medium-supplying section for containing a medium on which an image is formed.

18. An image forming system according to claim 13, wherein said image forming apparatus has information indicative of whether said image forming apparatus is being used as said color image forming apparatus or whether said image forming apparatus is being used as said single-color image forming apparatus.

19. An image forming system according to claim 13, wherein said single-color image forming apparatus is a monochrome image forming apparatus that forms monochrome images, when a developer container is attached to only one of said plurality of attach/detach sections, by developing the latent image borne on said image bearing body with the developer contained in said developer container.

20. An image forming system comprising:

an image forming apparatus that has a plurality of attach/detach sections to and from each of which a developer container for containing developer can be attached and detached, and an image bearing body for bearing a latent image; and a computer that is capable of communicating with said image forming apparatus and that has at least one control program for instructing said image forming apparatus to perform image formation;

wherein when a developer container is attached to each of said plurality of attach/detach sections, said image forming apparatus is usable as a color image forming apparatus for forming a color image by developing the latent image borne on said image bearing body with the developer contained in each said developer container;

wherein when a developer container is attached to only one of said plurality of attach/detach sections, said image forming apparatus is usable as a single-color image forming apparatus for forming a single-color image by developing the latent image borne on said image bearing body with the developer contained in said developer container;

wherein when said image forming apparatus is used as a color image forming apparatus, a color control program instructs said color image forming apparatus to perform image formation using setting information that is changeable and that is recorded on said color control program;

wherein when said image forming apparatus is used as a single-color image forming apparatus, a single-color control program instructs said single-color image forming apparatus to perform image formation using setting information that is changeable and that is recorded on said single-color control program;

wherein when said image forming apparatus is switched from said single-color image forming apparatus to said color image forming apparatus or from said color image forming apparatus to said single-color image forming apparatus, at least a portion of the setting information of the control program that is used after said switching is kept the same as a portion of the setting information of the control program that was used before said switching, said portion of the setting information of the control program that was used before said switching having been the setting information set by a user;

wherein said setting information of said color control program and said setting information of said single-color control program include information that is changeable by a user;

wherein said information that is changeable by a user includes medium information about a medium on which an image is formed;

wherein said medium information includes information about the size of said medium;

wherein said information that is changeable by a user is provided in said image forming apparatus, and includes information about a medium-supplying section for containing the medium on which an image is formed;

wherein said image forming apparatus has information indicative of whether said image forming apparatus is being used as said color image forming apparatus or whether said image forming apparatus is being used as said single-color image forming apparatus; and wherein said single-color image forming apparatus is a monochrome image forming apparatus that forms monochrome images, when a developer container is attached to only one of said plurality of attach/detach sections, by developing the latent image borne on said image bearing body with the developer contained in said developer container.

21. A computer-readable storage medium having recorded thereon a control program that is for a computer being capable of communicating with an image forming apparatus, and that is for instructing said image forming apparatus to perform image formation, said image forming apparatus having a plurality of attach/detach sections to and from each of which a developer container for containing developer can be attached and detached, and an image bearing body for bearing a latent image, wherein when a developer container is attached to each of said plurality of attach/detach sections, said image forming apparatus is usable as a color image forming apparatus for forming a color image by developing the latent image borne on said image bearing body with the developer contained in each said developer container, wherein when a developer container is attached to only one of said plurality of attach/detach sections, said image forming apparatus is usable as a single-color image forming apparatus for forming a single-color image by developing the latent image borne on said image bearing body with the developer contained in said developer container, wherein when said image forming apparatus is used as a color image forming apparatus and said control program is a color control program, said control program instructs said color image forming apparatus to perform image formation using setting information that is changeable and that is recorded on said color control program, wherein when said image forming apparatus is used as a single-color image forming apparatus and said control program is a single-color control program, said control program instructs said single-color image forming apparatus to perform image formation using setting information that is changeable and that is recorded on said single-color control program, and wherein when said image forming apparatus is switched from said single-color image forming apparatus to said color image forming apparatus or from said color image forming apparatus to said single-color image forming apparatus, at least a portion of the setting information of the control program that is used after said switching is kept the same as a portion of the setting information of the control program that was used before said switching, said portion of the setting information of the control pro&ram that was used before said switching having been the setting information set by a user.

* * * * *